US011598153B2

(12) United States Patent
Graham et al.

(10) Patent No.: US 11,598,153 B2
(45) Date of Patent: Mar. 7, 2023

(54) DRILL BIT CUTTER ELEMENTS AND DRILL BITS INCLUDING SAME

(71) Applicant: National Oilwell DHT, L.P., Conroe, TX (US)

(72) Inventors: Ryan Basson Graham, The Woodlands, TX (US); Reza Rahmani, The Woodlands, TX (US); Olivia N. Pacheco, Katy, TX (US)

(73) Assignee: NATIONAL OILWELL VARCO, L.P., Houston, TX (US)

( * ) Notice: Subject to any disclaimer, the term of this patent is extended or adjusted under 35 U.S.C. 154(b) by 37 days.

(21) Appl. No.: 17/270,147

(22) PCT Filed: Sep. 10, 2019

(86) PCT No.: PCT/US2019/050431
§ 371 (c)(1),
(2) Date: Feb. 22, 2021

(87) PCT Pub. No.: WO2020/055882
PCT Pub. Date: Mar. 19, 2020

(65) Prior Publication Data

US 2021/0172258 A1 Jun. 10, 2021

Related U.S. Application Data

(60) Provisional application No. 62/729,382, filed on Sep. 10, 2018.

(51) Int. Cl.
*E21B 10/567* (2006.01)
*E21B 10/55* (2006.01)
*E21B 10/43* (2006.01)

(52) U.S. Cl.
CPC ..... *E21B 10/5673* (2013.01); *E21B 10/43* (2013.01); *E21B 10/55* (2013.01)

(58) Field of Classification Search
CPC ..... E21B 10/5673; E21B 10/5676
See application file for complete search history.

(56) References Cited

U.S. PATENT DOCUMENTS 4,359,335 A * 11/1982 Garner ..... E21B 10/5673 175/379
4,491,188 A * 1/1985 Grappendorf ..... E21B 10/5673 175/430

(Continued)

FOREIGN PATENT DOCUMENTS

CN 106089089 A 11/2016
CN 106089091 A 11/2016

(Continued)

OTHER PUBLICATIONS

American Heritage Dictionary definition for "facet", accessed Jun. 2, 2022 via ahdictionary.com.*

(Continued)

*Primary Examiner* — Blake Michener
(74) *Attorney, Agent, or Firm* — Conley Rose, P.C.

(57) ABSTRACT

A cutter element for a drill bit includes a base portion having a central axis, a first end, and a second end. In addition, the cutter element includes a cutting layer fixably mounted to the first end of the base portion. The cutting layer includes a cutting face distal the base portion. The cutting face includes an elongate raised ridge having a first end at a radially outer surface of the cutting layer and a second end at the radially outer surface of the cutting layer. The raised ridge defines a maximum height of the cutter element measured axially from the second end of the base portion to the cutting face. The cutting face also includes a first planar lateral side surface and a second planar lateral side surface. Each planar lateral side surface extends from the raised ridge to the radially outer surface of the cutting layer.

46 Claims, 31 Drawing Sheets

(56) References Cited

U.S. PATENT DOCUMENTS

| | | | | |
|---|---|---|---|---|
| 4,722,405 | A * | 2/1988 | Langford, Jr. | E21B 10/5676 75/242 |
| 5,028,177 | A | 7/1991 | Meskin et al. | |
| 5,172,777 | A * | 12/1992 | Siracki | E21B 10/52 175/430 |
| 5,346,026 | A * | 9/1994 | Pessier | E21B 10/5735 175/374 |
| 5,752,573 | A * | 5/1998 | Scott | E21B 10/16 175/430 |
| 6,044,920 | A | 4/2000 | Massa et al. | |
| 6,045,440 | A * | 4/2000 | Johnson | E21B 10/5673 451/540 |
| 6,059,054 | A | 5/2000 | Portwood et al. | |
| 6,196,340 | B1 | 3/2001 | Jensen et al. | |
| 6,241,035 | B1 | 6/2001 | Portwood | |
| 6,513,608 | B2 | 2/2003 | Eyre et al. | |
| 6,550,556 | B2 | 4/2003 | Middlemiss et al. | |
| 6,604,588 | B2 | 8/2003 | Eyre et al. | |
| 8,011,456 | B2 | 9/2011 | Sherwood, Jr. | |
| 8,087,478 | B2 | 1/2012 | Patel | |
| 8,191,656 | B2 | 6/2012 | Dourfaye et al. | |
| 8,360,175 | B2 | 1/2013 | Fan et al. | |
| 8,764,862 | B2 | 7/2014 | Atkins et al. | |
| 8,919,463 | B2 | 12/2014 | Setlur et al. | |
| 9,051,794 | B2 * | 6/2015 | Hall | B24D 99/005 |
| 9,097,075 | B2 | 8/2015 | Lin | |
| 9,115,553 | B2 | 8/2015 | Zhang et al. | |
| 9,279,290 | B2 | 3/2016 | Stewart et al. | |
| 9,328,565 | B1 * | 5/2016 | Cannon | E21B 10/5673 |
| 9,404,308 | B1 | 8/2016 | Qian et al. | |
| 2003/0062201 | A1 | 4/2003 | Eyre et al. | |
| 2005/0247486 | A1 | 11/2005 | Zhang et al. | |
| 2008/0053710 | A1 | 3/2008 | Moss | |
| 2008/0099251 | A1 * | 5/2008 | Hall | E21B 10/5673 175/428 |
| 2008/0308320 | A1 | 12/2008 | Kolochalam et al. | |
| 2009/0057031 | A1 | 3/2009 | Patel et al. | |
| 2010/0059287 | A1 * | 3/2010 | Durairajan | E21B 10/5673 175/420.2 |
| 2010/0263939 | A1 | 10/2010 | Hall et al. | |
| 2011/0266070 | A1 | 11/2011 | Scott et al. | |
| 2013/0199856 | A1 * | 8/2013 | Bilen | E21B 10/58 175/428 |
| 2014/0196959 | A1 * | 7/2014 | Hall | E21B 10/43 175/432 |
| 2015/0129322 | A1 * | 5/2015 | Hall | E21B 10/5673 175/430 |
| 2015/0259988 | A1 * | 9/2015 | Chen | E21B 10/5735 175/430 |
| 2016/0130881 | A1 | 5/2016 | Alsup et al. | |
| 2017/0058615 | A1 | 3/2017 | Liang et al. | |
| 2019/0390520 | A1 * | 12/2019 | Ramachandran | E21B 10/5676 |
| 2020/0087758 | A1 * | 3/2020 | Zhao | E21B 10/5676 |
| 2020/0157890 | A1 * | 5/2020 | Cuillier De Maindreville | E21B 10/55 |
| 2020/0347680 | A1 | 11/2020 | Tian et al. | |
| 2022/0074271 | A1 * | 3/2022 | Rahmani | E21B 10/5673 |

FOREIGN PATENT DOCUMENTS

| | | | |
|---|---|---|---|
| CN | 205778558 | U | 12/2016 |
| CN | 107448149 | A | 12/2017 |
| CN | 207004435 | U | 2/2018 |
| CN | 207728311 | U | 8/2018 |
| WO | 97/19247 | A1 | 5/1997 |
| WO | 2017/053475 | A1 | 3/2017 |

OTHER PUBLICATIONS

PCT/US2019/050431 International Search Report and Written Opinion dated Dec. 4, 2019 (16 p.).

PCT/US2019/050431 Submission of Informal Comments to the Written Opinion dated Dec. 4, 2019; Submission filed Mar. 4, 2020 (4 p.).

European Search Report dated Apr. 8, 2022, for European Application No. 19860318.5 (7 p.).

* cited by examiner

DRILL BIT CUTTER ELEMENTS AND DRILL BITS INCLUDING SAME

CROSS-REFERENCE TO RELATED APPLICATIONS

This application is a 35 U.S.C. § 371 U.S. National Phase entry of PCT/US2019/050431 filed Sep. 10, 2019, and entitled "Drill Bit Cutter Elements and Drill Bits Including Same," which claims benefit of U.S. provisional patent application Ser. No. 62/729,382 filed Sep. 10, 2018, and entitled "Drill Bit Cutter Elements and Drill Bits Including same," each of which is hereby incorporated herein by reference in its entirety for all purposes.

STATEMENT REGARDING FEDERALLY SPONSORED RESEARCH OR DEVELOPMENT

Not applicable.

BACKGROUND

The disclosure relates generally to drill bits for drilling a borehole in an earthen formation for the ultimate recovery of oil, gas, or minerals. More particularly, the disclosure relates to fixed cutter bits and cutter elements used on such bits.

An earth-boring drill bit is typically mounted on the lower end of a drill string and is rotated by rotating the drill string at the surface or by actuation of downhole motors or turbines, or by both methods. With weight applied to the drill string, the rotating drill bit engages the earthen formation and proceeds to form a borehole along a predetermined path toward a target zone. The borehole thus created will have a diameter generally equal to the diameter or "gage" of the drill bit.

Fixed cutter bits, also known as rotary drag bits, are one type of drill bit commonly used to drill boreholes. Fixed cutter bit designs include a plurality of blades angularly spaced about the bit face. The blades generally project radially outward along the bit body and form flow channels there between. In addition, cutter elements are often grouped and mounted on several blades. The configuration or layout of the cutter elements on the blades may vary widely, depending on a number of factors. One of these factors is the formation itself, as different cutter element layouts engage and cut the various strata with differing results and effectiveness.

The cutter elements disposed on the several blades of a fixed cutter bit are typically formed of extremely hard materials and include a layer of polycrystalline diamond ("PCD") material. In the typical fixed cutter bit, each cutter element or assembly comprises an elongate and generally cylindrical support member which is received and secured in a pocket formed in the surface of one of the several blades. In addition, each cutter element typically has a hard cutting layer of polycrystalline diamond or other superabrasive material such as cubic boron nitride, thermally stable diamond, polycrystalline cubic boron nitride, or ultrahard tungsten carbide (meaning a tungsten carbide material having a wear-resistance that is greater than the wear-resistance of the material forming the substrate) as well as mixtures or combinations of these materials. The cutting layer is exposed on one end of its support member, which is typically formed of tungsten carbide. For convenience, as used herein, the phrase "polycrystalline diamond cutter" or "PDC" may be used to refer to a fixed cutter bit ("PDC bit") or cutter element ("PDC cutter element") employing a hard cutting layer of polycrystalline diamond or other superabrasive material such as cubic boron nitride, thermally stable diamond, polycrystalline cubic boron nitride, or ultrahard tungsten carbide.

While the bit is rotated, drilling fluid is pumped through the drill string and directed out of the face of the drill bit. The fixed cutter bit typically includes nozzles or fixed ports spaced about the bit face that serve to inject drilling fluid into the flow passageways between the several blades. The flowing fluid performs several important functions. The fluid removes formation cuttings from the bit's cutting structure. Otherwise, accumulation of formation materials on the cutting structure may reduce or prevent the penetration of the cutting structure into the formation. In addition, the fluid removes cut formation materials from the bottom of the hole. Failure to remove formation materials from the bottom of the hole may result in subsequent passes by cutting structure to re-cut the same materials, thereby reducing the effective cutting rate and potentially increasing wear on the cutting surfaces. The drilling fluid and cuttings removed from the bit face and from the bottom of the hole are forced from the bottom of the borehole to the surface through the annulus that exists between the drill string and the borehole sidewall. Further, the fluid removes heat, caused by contact with the formation, from the cutter elements in order to prolong cutter element life. Thus, the number and placement of drilling fluid nozzles, and the resulting flow of drilling fluid, may significantly impact the performance of the drill bit.

Without regard to the type of bit, the cost of drilling a borehole for recovery of hydrocarbons may be very high and is proportional to the length of time it takes to drill to the desired depth and location. The time required to drill the well, in turn, is greatly affected by the cutting efficiency of the cutting structure on the drill bit. Accordingly, it is desirable to employ drill bits which will drill faster and longer, and which are usable over a wider range of formation hardness.

BRIEF SUMMARY OF THE DISCLOSURE

Embodiments of cutter elements for drill bits configured to drill boreholes in subterranean formations are disclosed herein. In one embodiment, a cutter element for a drill bit comprises a base portion having a central axis, a first end, a second end, and a radially outer cylindrical surface extending axially from the first end to the second end. In addition, the cutter element comprises a cutting layer fixably mounted to the first end of the base portion. The cutting layer includes a cutting face distal the base portion and a radially outer cylindrical surface extending axially from the cutting face to the radially outer cylindrical surface of the base portion. The radially outer cylindrical surface of the cutting layer is contiguous with the radially outer cylindrical surface of the base portion. The cutting face comprises an elongate raised ridge extending across the cutting face. The raised ridge has a first end at the radially outer cylindrical surface of the cutting layer and a second end at radially outer surface of the cutting layer. The raised ridge defines a maximum height of the cutter element measured axially from the second end of the base portion to the cutting face. The cutting face also comprises a first planar lateral side surface extending from the raised ridge to the radially outer cylindrical surface of the cutting layer, and a second planar lateral side surface extending from the raised ridge to the radially outer cylindrical surface of the cutting layer.

In another embodiment, a cutter element for a drill bit comprises a base portion having a central axis, a first end, a second end, and a radially outer surface extending axially from the first end to the second end. In addition, the cutter element comprises a cutting layer disposed at the first end of the base portion. The cutting layer includes a cutting face distal the base portion and a radially outer surface extending axially from the cutting face to the base portion. The cutting face comprises a planar central region. The cutting face also comprises a planar cutting region extending radially from the planar central region to the radially outer surface of the cutting layer. Further, the cutting face comprises a planar relief region extending radially from the planar central region to the radially outer surface of the cutting layer. Still further, the cutting face comprises a first planar lateral side region extending laterally from the planar central region, the planar cutting region, and the planar relief region to the radially outer surface of the cutting layer. Moreover, the cutting face comprises a second planar lateral side region extending laterally from the planar central region, the planar cutting region, and the planar relief region to the radially outer surface of the cutting layer. The first planar lateral side region slopes axially downward moving laterally from the planar central region, the planar cutting region, and the planar relief region toward the radially outer surface of the cutting layer. The second planar lateral side region slopes axially downward moving laterally from the planar central region, the planar cutting region, and the planar relief region to the radially outer surface of the cutting layer. The planar cutting region is circumferentially positioned between the first planar lateral side region and the second planar lateral side region. The planar relief region is circumferentially positioned between the first planar lateral side region and the second planar lateral side region. The central region is disposed between the first planar lateral side region and the second planar lateral side region.

Embodiments described herein comprise a combination of features and advantages intended to address various shortcomings associated with certain prior devices, systems, and methods. The foregoing has outlined rather broadly the features and technical advantages of the invention in order that the detailed description of the invention that follows may be better understood. The various characteristics described above, as well as other features, will be readily apparent to those skilled in the art upon reading the following detailed description, and by referring to the accompanying drawings. It should be appreciated by those skilled in the art that the conception and the specific embodiments disclosed may be readily utilized as a basis for modifying or designing other structures for carrying out the same purposes of the invention. It should also be realized by those skilled in the art that such equivalent constructions do not depart from the spirit and scope of the invention as set forth in the appended claims.

BRIEF DESCRIPTION OF THE DRAWINGS

For a detailed description of the preferred embodiments of the invention, reference will now be made to the accompanying drawings in which.

DETAILED DESCRIPTION OF THE PREFERRED EMBODIMENTS

Figure 1:
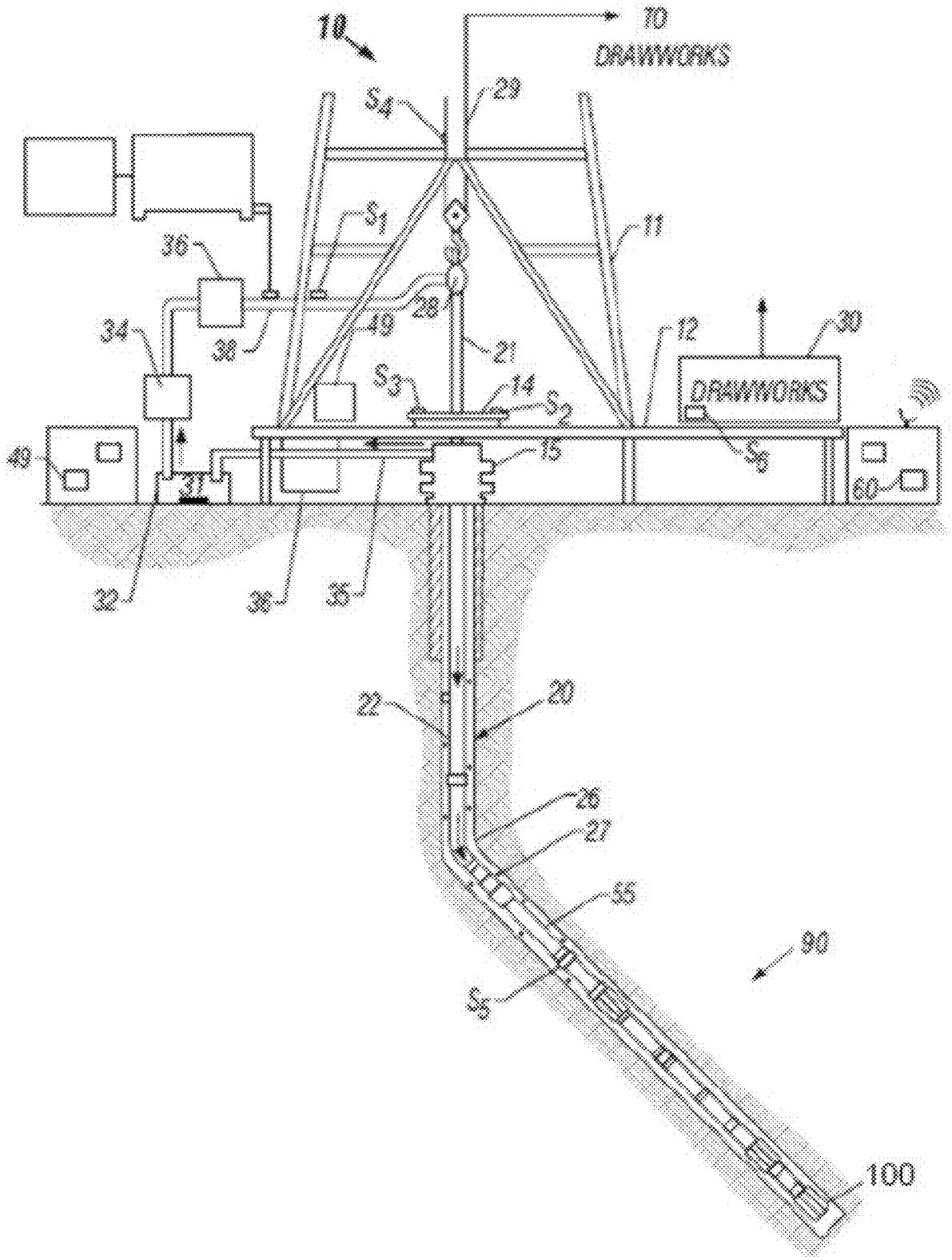
FIG. 1 is a schematic view of a drilling system including an embodiment of a drill bit with a plurality of cutter elements in accordance with the principles described herein.

The following discussion is directed to various exemplary embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial"

and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. Any reference to up or down in the description and the claims will be made for purposes of clarity, with "up", "upper", "upwardly" or "upstream" meaning toward the surface of the borehole and with "down", "lower", "downwardly" or "downstream" meaning toward the terminal end of the borehole, regardless of the borehole orientation.

As previously described, the length of time it takes to drill to the desired depth and location impacts the cost of drilling operations. The shape and positioning of the cutter elements impact bit durability and rate of penetration (ROP) and thus, are important to the success of a particular bit design. Embodiments described herein are directed to cutter elements for fixed cutter drill bits with geometries that offer the potential to improve bit durability and/or ROP. In some embodiments, cutter elements disclosed herein can be reused after the initial cutting edge is sufficiently worn, which offers the potential to enhance the useful life of such cutter elements.

Referring now to FIG. 1, a schematic view of an embodiment of a drilling system 10 in accordance with the principles described herein is shown. Drilling system 10 includes a derrick 11 having a floor 12 supporting a rotary table 14 and a drilling assembly 90 for drilling a borehole 26 from derrick 11. Rotary table 14 is rotated by a prime mover such as an electric motor (not shown) at a desired rotational speed and controlled by a motor controller (not shown). In other embodiments, the rotary table (e.g., rotary table 14) may be augmented or replaced by a top drive suspended in the derrick (e.g., derrick 11) and connected to the drillstring (e.g., drillstring 20).

Drilling assembly 90 includes a drillstring 20 and a drill bit 100 coupled to the lower end of drillstring 20. Drillstring 20 is made of a plurality of pipe joints 22 connected end-to-end, and extends downward from the rotary table 14 through a pressure control device 15, such as a blowout preventer (BOP), into the borehole 26. The pressure control device 15 is commonly hydraulically powered and may contain sensors for detecting certain operating parameters and controlling the actuation of the pressure control device 15. Drill bit 100 is rotated with weight-on-bit (WOB) applied to drill the borehole 26 through the earthen formation. Drillstring 20 is coupled to a drawworks 30 via a kelly joint 21, swivel 28, and line 29 through a pulley. During drilling operations, drawworks 30 is operated to control the WOB, which impacts the rate-of-penetration of drill bit 100 through the formation. In this embodiment, drill bit 100 can be rotated from the surface by drillstring 20 via rotary table 14 and/or a top drive, rotated by downhole mud motor 55 disposed along drillstring 20 proximal bit 100, or combinations thereof (e.g., rotated by both rotary table 14 via drillstring 20 and mud motor 55, rotated by a top drive and the mud motor 55, etc.). For example, rotation via downhole motor 55 may be employed to supplement the rotational power of rotary table 14, if required, and/or to effect changes in the drilling process. In either case, the rate-of-penetration (ROP) of the drill bit 100 into the borehole 26 for a given formation and a drilling assembly largely depends upon the WOB and the rotational speed of bit 100.

During drilling operations a suitable drilling fluid 31 is pumped under pressure from a mud tank 32 through the drillstring 20 by a mud pump 34. Drilling fluid 31 passes from the mud pump 34 into the drillstring 20 via a desurger 36, fluid line 38, and the kelly joint 21. The drilling fluid 31 pumped down drillstring 20 flows through mud motor 55 and is discharged at the borehole bottom through nozzles in face of drill bit 100, circulates to the surface through an annular space 27 radially positioned between drillstring 20 and the sidewall of borehole 26, and then returns to mud tank 32 via a solids control system 36 and a return line 35. Solids control system 36 may include any suitable solids control equipment known in the art including, without limitation, shale shakers, centrifuges, and automated chemical additive systems. Control system 36 may include sensors and automated controls for monitoring and controlling, respectively, various operating parameters such as centrifuge rpm. It should be appreciated that much of the surface equipment for handling the drilling fluid is application specific and may vary on a case-by-case basis.

Figure 2:
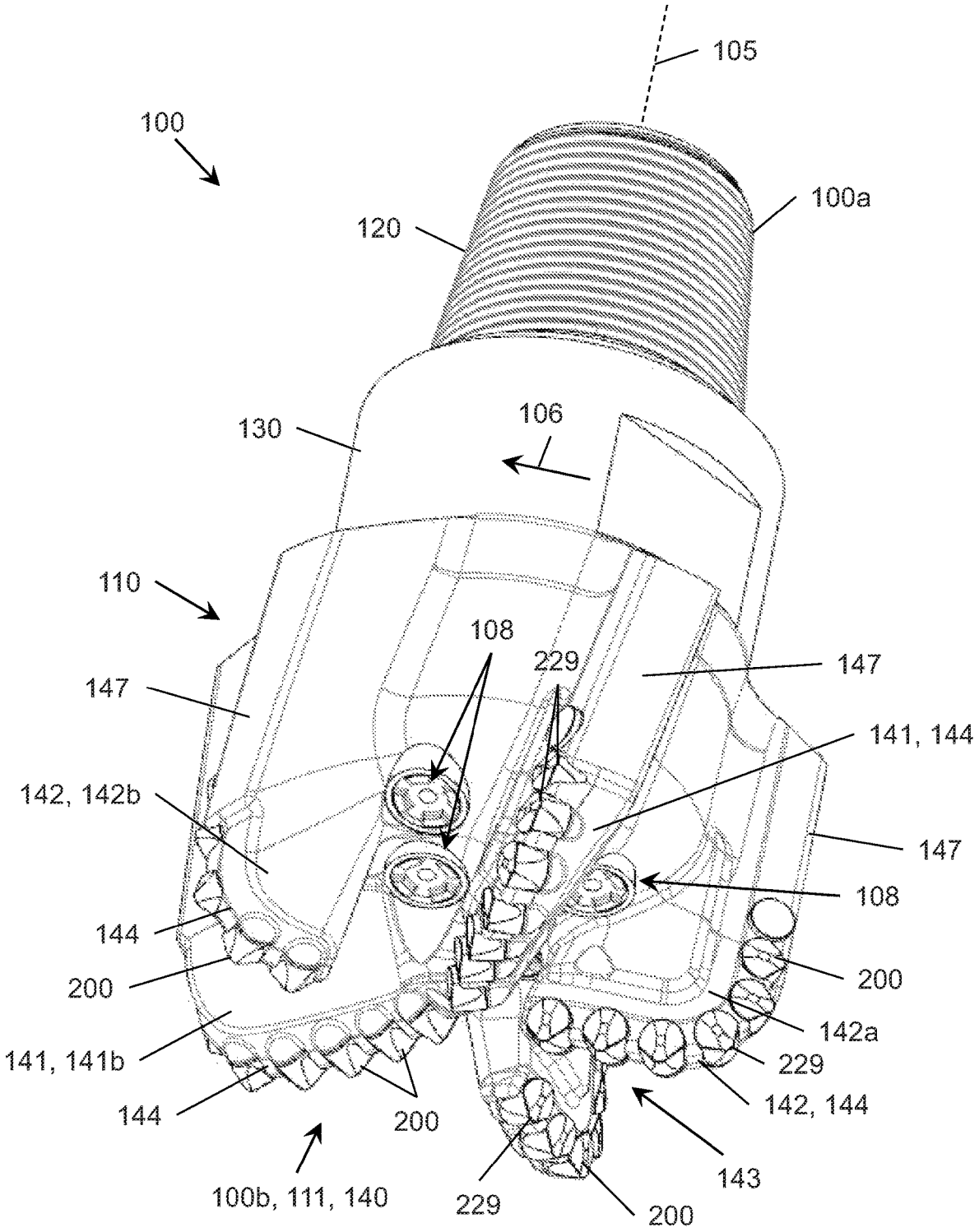
FIG. 2 is a perspective view of the drill bit of FIG. 1.
Figure 3:
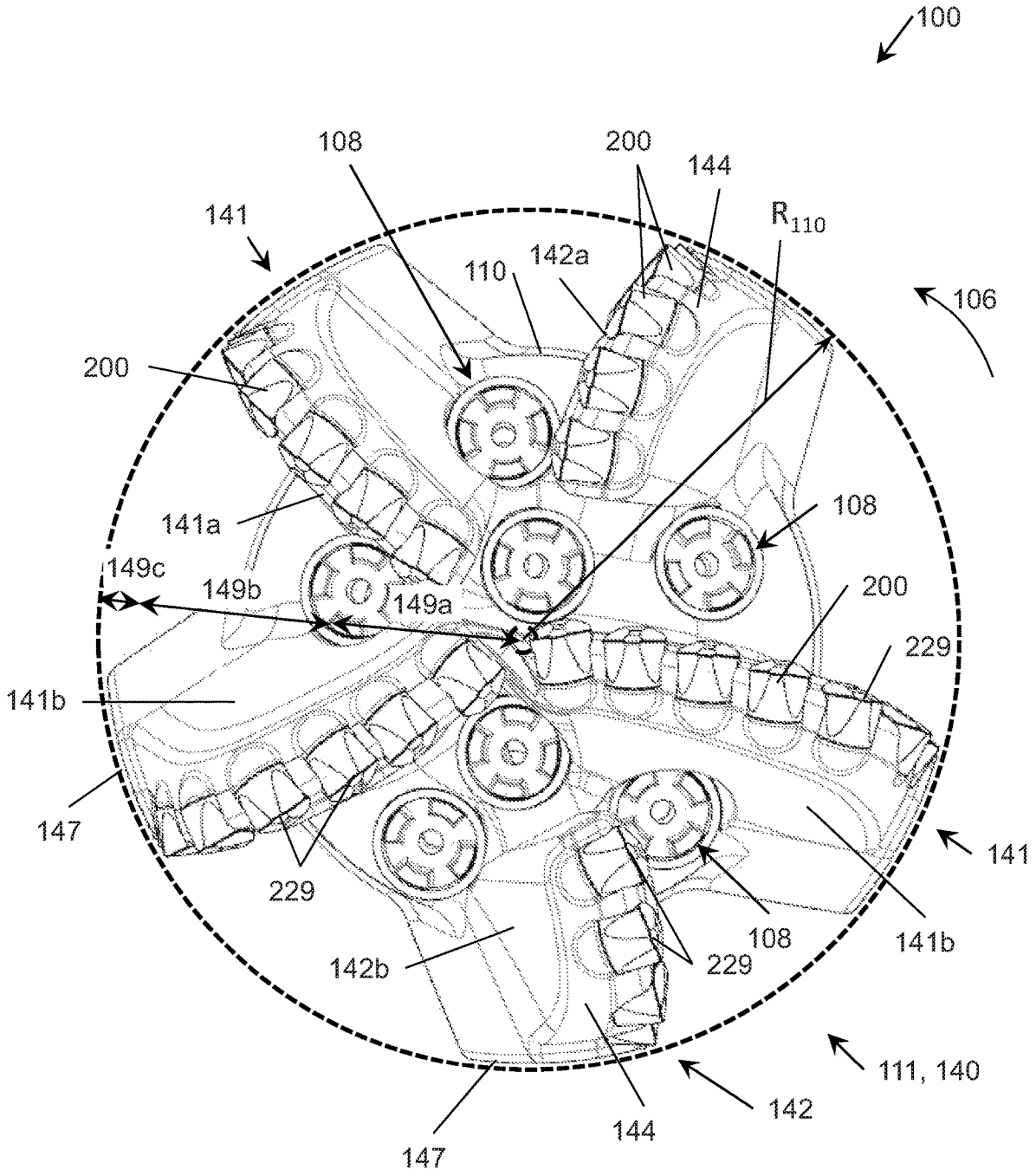
FIG. 3 is a face or bottom end view of the drill bit of FIG. 2.

Referring now to FIGS. 2 and 3, drill bit 100 is a fixed cutter bit, sometimes referred to as a drag bit, and is designed for drilling through formations of rock to form a borehole. Bit 100 has a central or longitudinal axis 105, a first or uphole end 100*a*, and a second or downhole end 100*b*. Bit 100 rotates about axis 105 in the cutting direction represented by arrow 106. In addition, bit 100 includes a bit body 110 extending axially from downhole end 100*b*, a threaded connection or pin 120 extending axially from uphole end 100*a*, and a shank 130 extending axially between pin 120 and body 110. Pin 120 couples bit 100 to drill string 20, which is employed to rotate the bit 100 to drill the borehole 26. Bit body 110, shank 130, and pin 120 are coaxially aligned with axis 105, and thus, each has a central axis coincident with axis 105.

The portion of bit body 110 that faces the formation at downhole end 100*b* includes a bit face 111 provided with a cutting structure 140. Cutting structure 140 includes a plurality of blades 141, 142, which extend from bit face 111. In this embodiment, cutting structure 140 includes three angularly spaced-apart primary blades 141, and three angularly spaced apart secondary blades 142. Further, in this embodiment, the plurality of blades (e.g., primary blades 141, and secondary blades 142) are uniformly angularly spaced on bit face 111 about bit axis 105. In this embodiment, bit 100 includes five total blades 141, 142—three primary blades 141 and two secondary blades 142. The five blades 141, 142 are uniformly angularly spaced about 72° apart. In other embodiments, the blades (e.g., blades 141, 142 may be non-uniformly circumferentially spaced about bit face 111). Although bit 100 is shown as having three primary blades 141 and two secondary blades 142, in other embodiments, the bit (e.g., bit 100) may comprise any suitable number of primary and secondary blades such as two primary blades and four secondary blades or three primary blades and three secondary blades.

In this embodiment, primary blades 141 and secondary blades 142 are integrally formed as part of, and extend from, bit body 110 and bit face 111. Primary blades 141 and secondary blades 142 extend generally radially along bit face 111 and then axially along a portion of the periphery of bit 100. In particular, primary blades 141 extend radially from proximal central axis 105 toward the periphery of bit body 110. Primary blades 141 and secondary blades 142 are separated by drilling fluid flow courses 143. Each blade 141, 142 has a leading edge or side 141*a*, 142*a*, respectively, and a trailing edge or side 141*b*, 142*b*, respectively, relative to the direction of rotation 106 of bit 100.

Referring still to FIGS. 2 and 3, each blade 141, 142 includes a cutter-supporting surface 144 for mounting a plurality of cutter elements 200. In particular, cutter elements 200 are arranged adjacent one another in a radially extending row proximal the leading edge of each primary blade 141 and each secondary blade 142. In this embodiment, each cutter element 200 has substantially the same size and geometry, which will be described in more detail below.

As will also be described in more detail below, each cutter element 200 has a cutting face 220. In the embodiments described herein, each cutter element 200 is mounted such that its cutting face 220 is generally forward-facing. As used herein, "forward-facing" is used to describe the orientation of a surface that is substantially perpendicular to, or at an acute angle relative to, the cutting direction of the bit (e.g., cutting direction 106 of bit 100).

Referring still to FIGS. 2 and 3, bit body 110 further includes gage pads 147 of substantially equal axial length measured generally parallel to bit axis 105. Gage pads 147 are circumferentially-spaced about the radially outer surface of bit body 110. Specifically, one gage pad 147 intersects and extends from each blade 141, 142. In this embodiment, gage pads 147 are integrally formed as part of the bit body 110. In general, gage pads 147 can help maintain the size of the borehole by a rubbing action when cutter elements 200 wear slightly under gage. Gage pads 147 also help stabilize bit 100 against vibration.

Figure 4:
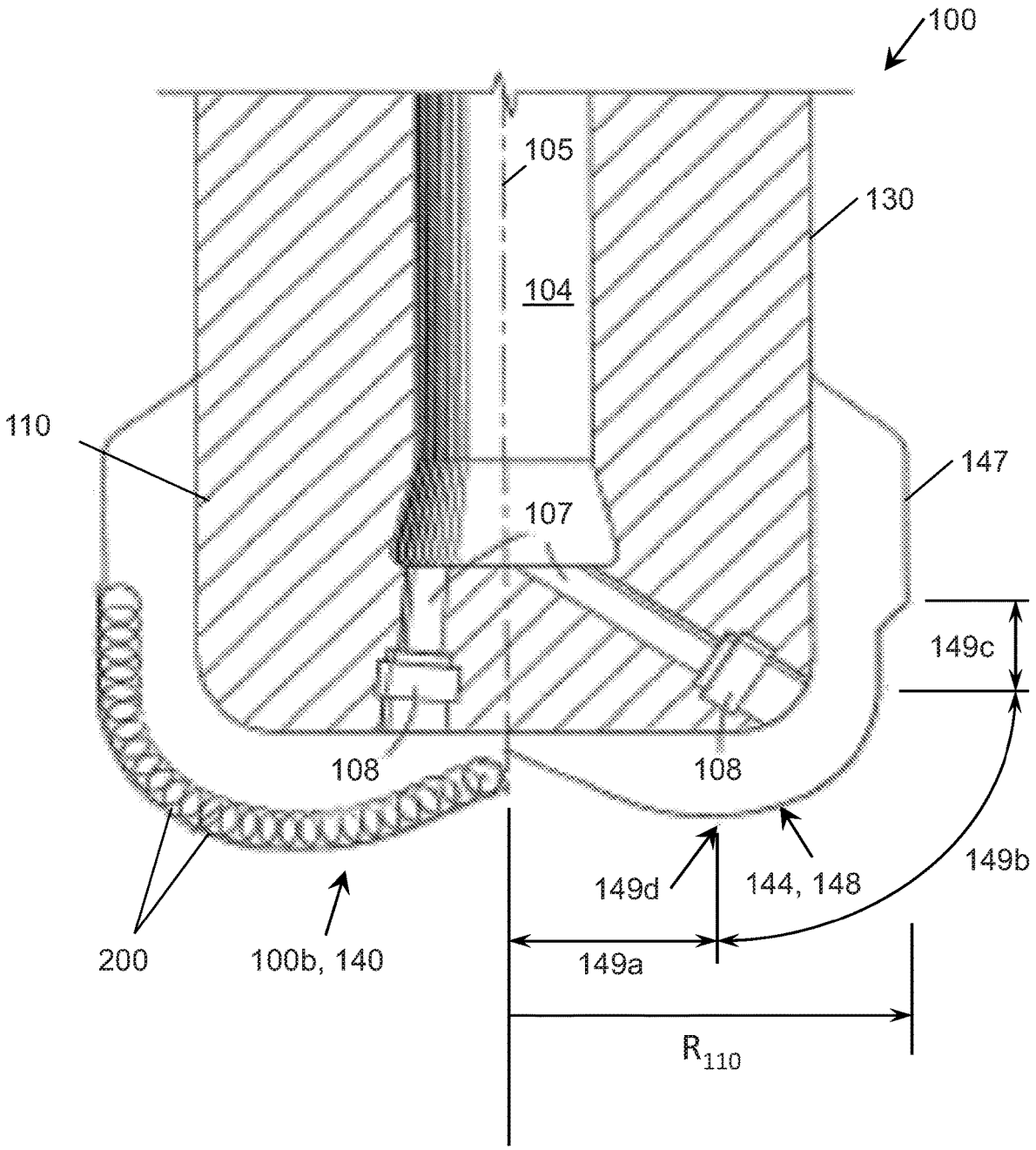
FIG. 4 is a partial cross-sectional view of the bit shown in FIG. 2 with the blades and the cutting faces of the cutter elements rotated into a single composite profile.

Referring now to FIG. 4, an exemplary profile of bit body 110 is shown as it would appear with blades 141, 142 and cutting faces 220 rotated into a single rotated profile. In rotated profile view, blades 141, 142 of bit body 110 form a combined or composite blade profile 148 generally defined by cutter-supporting surfaces 144 of blades 141, 142. In this embodiment, the profiles of surfaces 144 of blades 141, 142 are generally coincident with each other, thereby forming a single composite blade profile 148.

Composite blade profile 148 and bit face 111 may generally be divided into three regions conventionally labeled cone region 149*a*, shoulder region 149*b*, and gage region 149*c*. Cone region 149*a* comprises the radially innermost region of bit body 110 and composite blade profile 148 extending from bit axis 105 to shoulder region 149*b*. In this embodiment, cone region 149*a* is generally concave. Adjacent cone region 149*a* is the generally convex shoulder region 149*b*. The transition between cone region 149*a* and shoulder region 149*b*, typically referred to as the nose 149*d*, occurs at the axially outermost portion of composite blade profile 148 where a tangent line to the blade profile 148 has a slope of zero. Moving radially outward, adjacent shoulder region 149*b* is the gage region 149*c* which extends substantially parallel to bit axis 105 at the outer radial periphery of composite blade profile 148. As shown in composite blade profile 148, gage pads 147 define the gage region 149*c* and the outer radius $R_{110}$ of bit body 110. Outer radius $R_{110}$ extends to and therefore defines the full gage diameter of bit body 110. As used herein, the term "full gage diameter" refers to elements or surfaces extending to the full, nominal gage of the bit diameter.

Referring now to FIGS. 4 and 5, moving radially outward from bit axis 105, bit face 111 includes cone region 149*a*, shoulder region 149*b*, and gage region 149*c* as previously described. Primary blades 141 extend radially along bit face 111 from within cone region 149*a* proximal bit axis 105 toward gage region 149*c* and outer radius $R_{110}$. Secondary blades 142 extend radially along bit face 111 from proximal nose 149*d* toward gage region 149*c* and outer radius $R_{110}$. Thus, in this embodiment, each primary blade 141 and each secondary blade 142 extends substantially to gage region 149*c* and outer radius $R_{110}$. In this embodiment, secondary blades 142 do not extend into cone region 149*a*, and thus, secondary blades 142 occupy no space on bit face 111 within cone region 149*a*. Although a specific embodiment of bit body 110 has been shown in described, one skilled in the art will appreciate that numerous variations in the size, orientation, and locations of the blades (e.g., primary blades 141, secondary blades, 142, etc.), and cutter elements (e.g., cutter elements 200) are possible.

As best shown in FIG. 4, bit 100 includes an internal plenum 104 extending axially from uphole end 100*a* through pin 120 and shank 130 into bit body 110. Plenum 104 permits drilling fluid to flow from the drill string 20 into bit 100. Body 110 is also provided with a plurality of flow passages 107 extending from plenum 104 to downhole end 100*b*. A nozzle 108 is seated in the lower end of each flow passage 107. Together, passages 107 and nozzles 108 distribute drilling fluid around cutting structure 140 to flush away formation cuttings and to remove heat from cutting structure 140, and more particularly cutting elements 145, during drilling.

Referring now to FIGS. 5A-5E, one cutter element 200 is shown. Although only one cutter element 200 is shown in FIGS. 5A-5D, it is to be understood that all cutter elements 200 of bit 100 are the same. In general, bit 100 may include any number of cutter elements 200, and further, cutter elements 200 can be used in connection with different cutter elements (e.g., cutter elements having geometries different than cutter element 200) on bit 100.

In this embodiment, cutter element 200 includes a base or substrate 201 and a cutting disc or layer 210 bonded to the substrate 201. Cutting layer 210 and substrate 201 meet at a reference plane of intersection 209 that defines the location at which substrate 201 and cutting layer 210 are fixably attached. In this embodiment, substrate 210 is made of tungsten carbide and cutting layer 210 is made of an ultrahard material such as polycrystalline diamond (PCD) or other superabrasive material. Part and/or all of the diamond in cutting layer 210 may be leached, finished, polished, and/or otherwise treated to enhance durability, efficiency and/or effectiveness. While cutting layer 210 is shown as a single layer of material mounted to substrate 210, in general, the cutting layer (e.g., layer 210) may be formed of one or more layers of one or more materials. In addition, although substrate 201 is shown as a single, homogenous material, in general, the substrate (e.g., substrate 201) may be formed of one or more layers of one or more materials.

Substrate 201 has a central axis 205, a first end 201*a* bonded to cutting layer 210 at an interface disposed in a plane of intersection 209, a second end 201*b* opposite end 201*a* and distal cutting layer 210, and a radially outer surface 202 extending axially between ends 201*a*, 201*b*. In this embodiment, substrate 201 is generally cylindrical, and thus, outer surface 202 is generally cylindrical.

Referring still to FIGS. 5A-5E, cutting layer 210 has a first end 210*a* distal substrate 201, a second end 210*b* bonded to end 201*a* of substrate 201 at plane of intersection 209, and a radially outer surface 212 extending axially between ends 210*a*, 210*b*. In this embodiment, cutting layer 210 is generally disc-shaped, and thus, outer surface 212 is generally cylindrical. In addition, outer surfaces 202, 212 are coextensive and contiguous such that there is a generally smooth transition moving axially between outer surfaces 202, 212.

The outer surface of cutting layer 210 at first end 210*a* defines the cutting face 220 of cutter element 200 and is designed and shaped to engage and shear the formation during drilling operations. In this embodiment, a chamfer or bevel 211 is provided at the intersection of cutting face 220 and outer surface 212 about the entire outer periphery of cutting face 220.

Figure 5A:
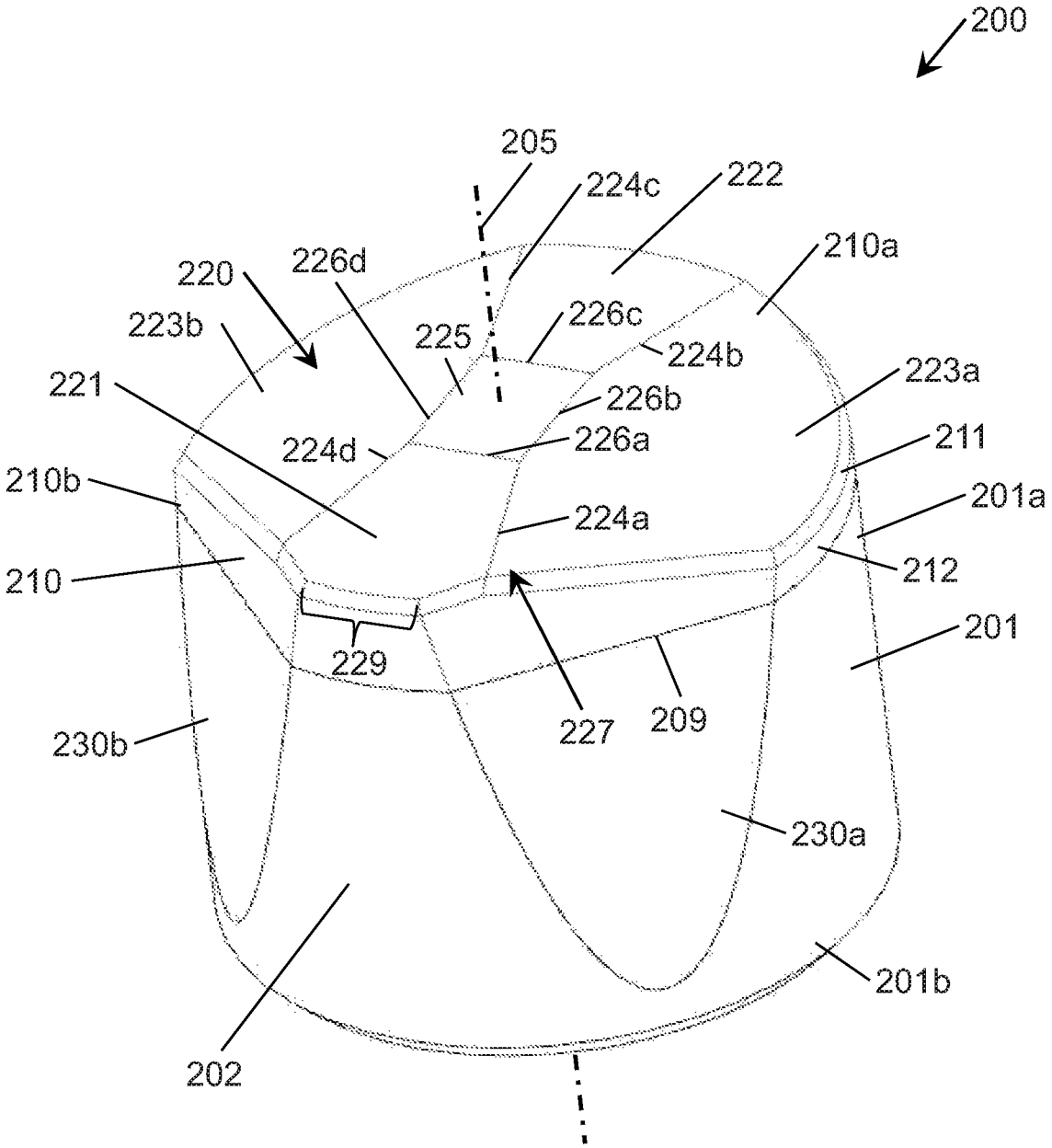
FIGS. 5A-5E are perspective, top, front side, lateral side, and rear side views, respectively, of one of the cutter elements of the drill bit of FIG. 2.
Figure 5B:
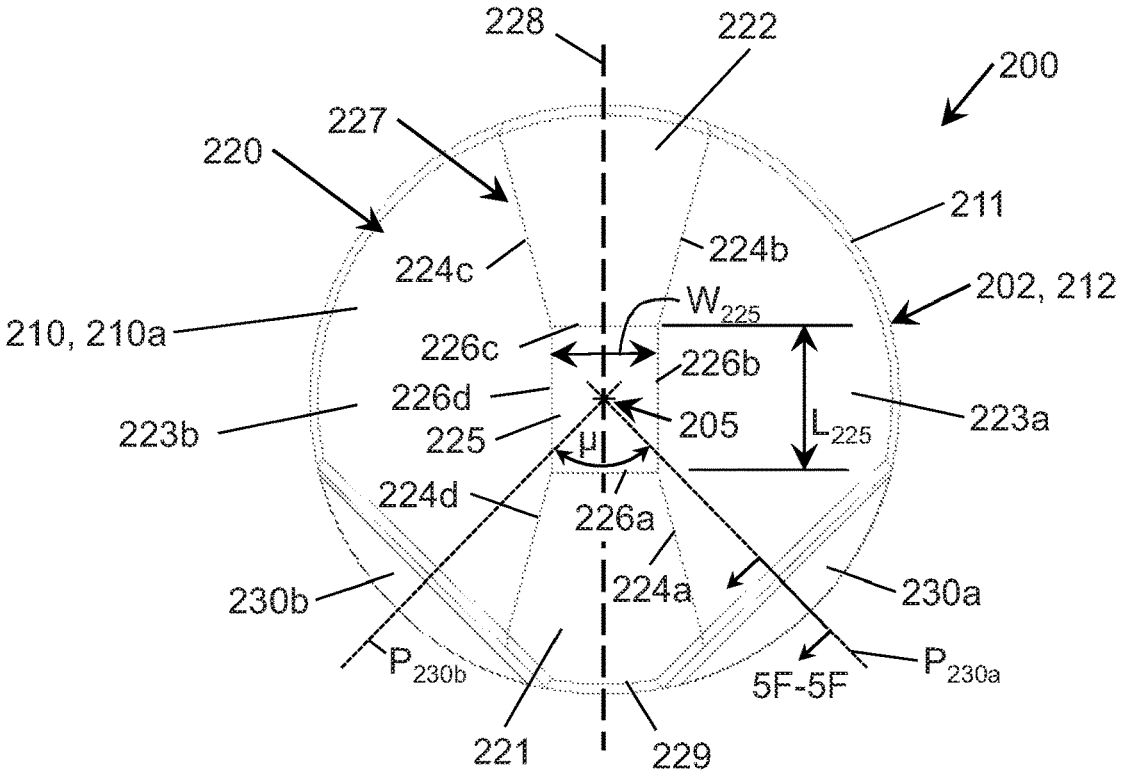
Figure 5C:
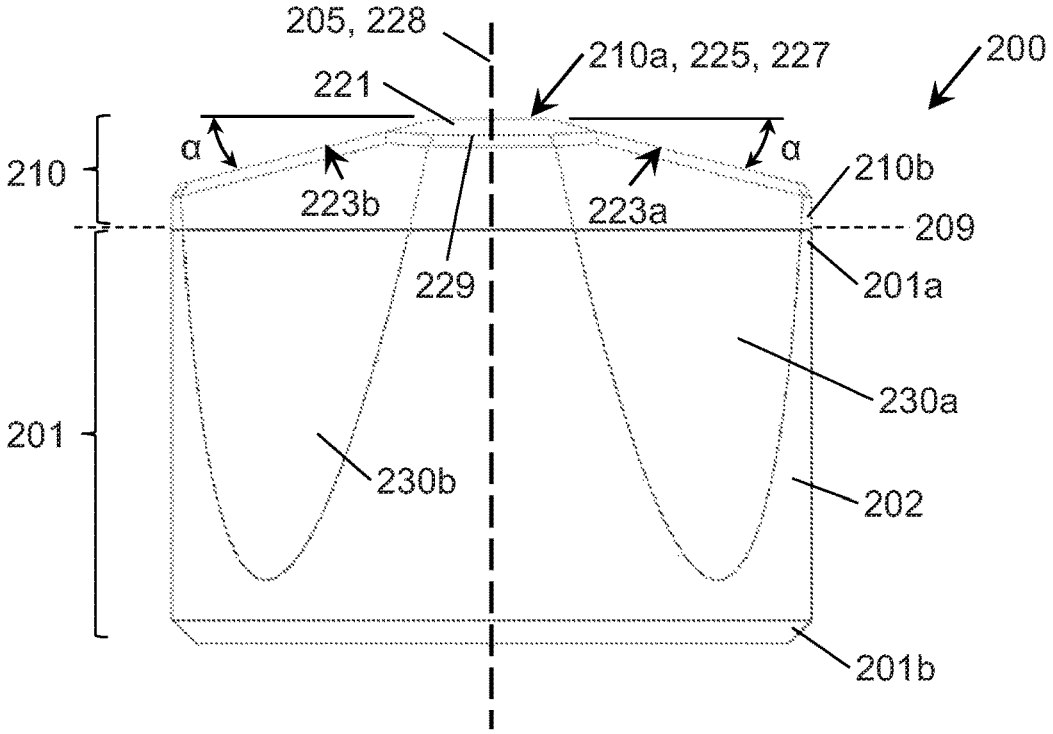
Figure 5D:
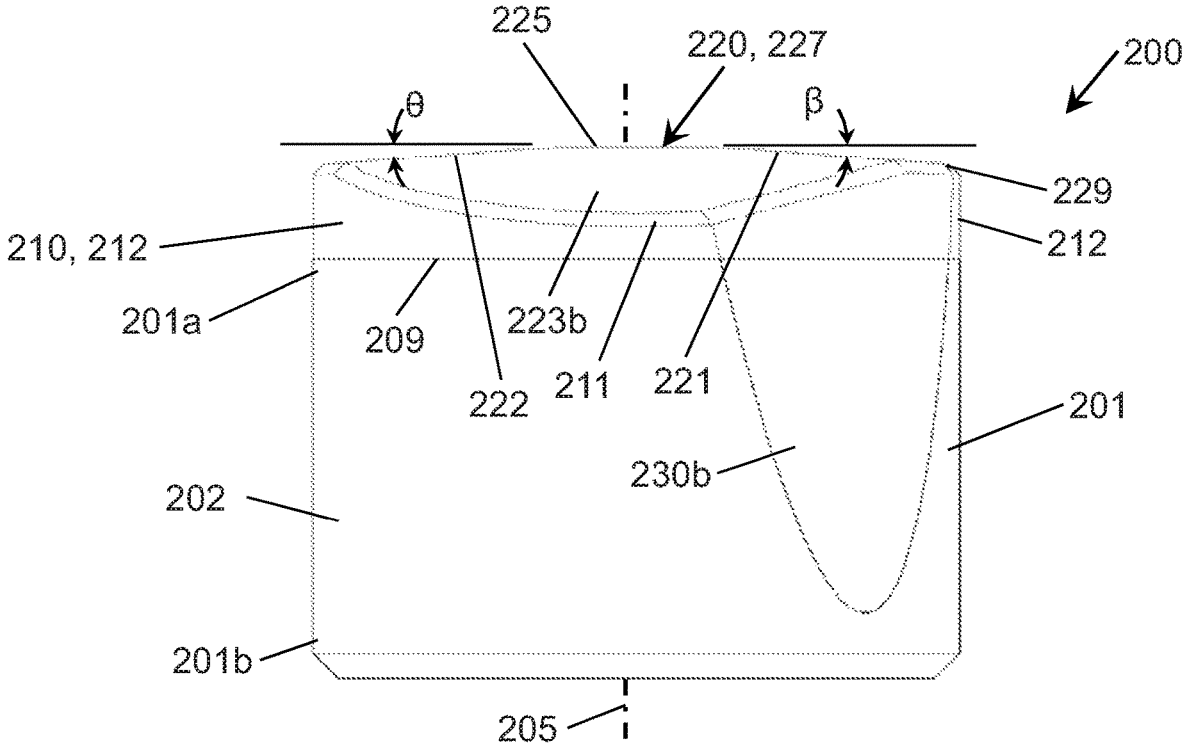
Figure 5E:
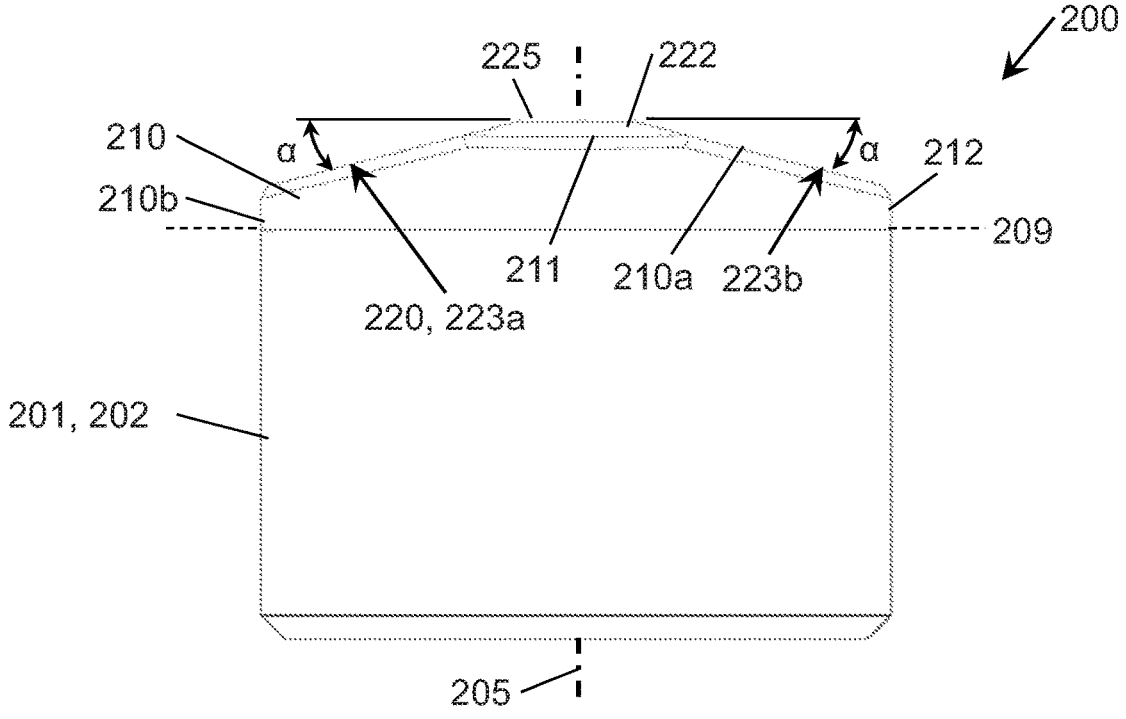

In this embodiment, cutting face 220 is generally convex or bowed outward in the front side view (FIG. 5C) and the lateral side view (FIG. 5D). In addition, in this embodiment, cutting face 220 is defined by a plurality of discrete regions or surfaces that intersect at linear boundaries or edges. More specifically, as best shown in FIGS. 5A and 5B, cutting face 220 includes a central region or surface 225, a cutting region or surface 221 extending radially from central region 225 to outer surface 212, a relief region or surface 222 extending radially from central region 225 to outer surface 212, and a pair of lateral side regions or surfaces 223*a*, 223*b* extending from regions 225, 221, 222 to outer surface 212. Regions 221, 222, 223*a*, 223*b* are circumferentially disposed about axis 205 and central region 225. In addition, regions 221, 222, 223*a*, 223*b* are positioned circumferentially adjacent each other with each region 221, 222 circumferentially disposed between regions 223*a*, 223*b* and each region 223*a*, 223*b* circumferentially disposed between regions 221, 222. Thus, region 221 extends circumferentially from region 223*a* to region 223*b*, region 222 extends circumferentially from region 223*a* to region 223*b*, region 223*a* extends circumferentially from region 221 to region 222, and region 223*b* extends circumferentially from region 221 to region 222. In this embodiment, the centerlines of regions 223*a*, 223*b* are angularly spaced 180° apart about axis 205 and the centerlines of regions 221, 222 are angularly spaced 180° apart about axis 205. Accordingly, regions 221, 222 extend radially in opposite directions from central region 225 to outer surface 212 and regions 223*a*, 223*b* extend radially in opposite directions from central region 225 to outer surface 212.

A linear boundary or edge is provided at the intersection of each circumferentially adjacent region 221, 222, 223*a*, 223*b*. As shown in FIGS. 5A and 5B, regions 221, 223*a* intersect at a linear edge 224*a*, regions 223*a*, 222 intersect at a linear edge 224*b*, regions 222, 223*b* intersect at a linear edge 224*c*, and regions 223*b*, 221 intersect at a linear edge 224*d*. Each linear edge 224*a*, 224*b*, 224*c*, 224*d* extends from central region 225 to outer surface 212. As best shown in the top view of cutter element 200 in FIG. 5B (looking at cutting face 220 as viewed parallel to central axis 205), in this embodiment, linear edges 224*a*, 224*d* taper or slope away from each other moving radially along cutting region 221 from central region 225 to outer surface 212, and linear edges 224*b*, 224*c* taper or slope away from each other moving radially along relief region 222 from central region 225 to outer surface 212. As a result, cutting region 221 has a width measured perpendicular to a reference plane 228 containing central axis 205 in top view that increases moving radially from central region 225 to outer surface 212, and similarly, relief region 222 has a width measured perpendicular to reference plane 228 in top view that increases moving radially from central region 225 to outer surface 212. However, in other embodiments, the width of the cutting region (e.g., cutting region 221) and the width of the relief region (e.g., relief region 222) may increase, decrease, or remain constant moving radially outward from the central region (e.g., central region 225) to the outer surface (e.g., outer surface 212).

Referring still to FIGS. 5A-5E, central region 225 is radially centered on cutting face 220 and centered relative to axis 205. In particular, axis 205 intersects the geometric center of central region 225. In this embodiment, central surface or region 225 is planar, and thus, may also be referred to as "planar" surface or facet. In addition, in this embodiment, central region 225 is oriented perpendicular to axis 205 and is rectangular. A linear boundary or edge is provided at the intersection of central region 225 and each region 221, 222, 223*a*, 223*b*. As best shown in FIGS. 5A and 5B, regions 225, 221 intersect at a linear edge 226*a*, regions 225, 223*a* intersect at a linear edge 226*b*, regions 225, 222 intersect at a linear edge 226*c*, and regions 225, 223*b* intersect at a linear edge 226*d*. Linear edge 226*a*, 226*b*, 226*c*, 226*d* defined the four sides of the rectangular central region 225, and each linear edge 224*a*, 224*b*, 224*c*, 224*d* extends from one corner of the rectangular central region 225.

In this embodiment, each cutting surface or region 221, 222, 223*a*, 223*b* on cutting face 220 is planar, and thus, each may be referred to as a "planar" surface or facet. As best shown in the front side view (FIG. 5C) and rear side view (FIG. 5E) (looking at cutting face 220 perpendicular to axis 205 and parallel to lateral facets 223*a*, 223*b*), in embodiments described herein, each lateral facet 223*a*, 223*b* slopes axially toward base 201 moving radially outward from facets 225, 221, 222 to outer surface 212. In particular, each lateral facet 223*a*, 223*b* is oriented at a non-zero acute angle $\alpha$ measured from the lateral facet 223*a*, 223*b* to a reference plane oriented perpendicular to central axis 205 in the front side view and the rear side view. In embodiments described herein, each angle $\alpha$ is less than 45°, preferably ranges from 5° to 25°, and more preferably ranges from 14° to 15°. In general, angles $\alpha$ can be the same or different. In this embodiment, angles $\alpha$ are the same, and further, each angle $\alpha$ is 14.5°.

As best shown in the lateral side view (FIG. 5D) (looking at cutting face 220 perpendicular to axis 205 and parallel to cutting face 221 and relief facet 222), in this embodiment, cutting facet 221 slopes axially toward base 201 moving radially outward from central facet 225 to outer surface 212 and relief facet 222 slopes axially toward base 201 moving radially outward from central facet 225 to outer surface 212. In particular, cutting facet 221 is oriented at a non-zero acute angle $\beta$ measured from facet 221 to a reference plane oriented perpendicular to central axis 205 in the lateral side view, and relief facet 222 is oriented at a non-zero acute angle $\beta$ measured from facet 222 to a reference plane oriented perpendicular to the central axis 205 in the lateral side view. Each angle $\beta$, $\theta$ is less than 45°, preferably ranges from 1° to 20°, and more preferably ranges from 2° to 10°. In general, angles $\beta$, $\theta$ can be the same or different. In this embodiment, angles $\beta$, $\theta$ are the same, and further, each angle $\beta$ is 4° and angle $\theta$ is 4°. Although both facets 221, 222 slope toward base 201 moving radially outward from central facet 225 to outer surface 212 in this embodiment, in other embodiments, one or both facets 221, 222 can slope away from base 201 moving radially outward from central facet 225 to outer surface 212.

As best shown in FIG. 5B, central region 225 has a length $L_{225}$ measured parallel to plane 228 from edge 226*a* to edge 226*c* in top view, and a width $W_{225}$ measured perpendicular to plane 228 from edge 226*b* to edge 226*d* in top view. In this embodiment, central region 225 is rectangular with linear edges 226*a*, 226*c* oriented parallel to each other and linear edges 226*b*, 226*d* oriented parallel to each other, and thus, the length $L_{225}$ measured between edges 226*a*, 226*c* is constant at all points along edges 226*a*, 226*c*, and further, the width $W_{225}$ measured between edges 226*b*, 226*d* is constant at all points along edges 226*b*, 226*d*. The geometry of central region 225 may be characterized by the ratio of the length $L_{225}$ to the diameter of cutter element 200 and an "aspect ratio" that is equal to the ratio of the length $L_{225}$ to the width $W_{225}$. In general, the diameter of a cutter element is the diameter of the base or substrate of the cutter element (e.g., the diameter of substrate 201). The ratio of the length $L_{225}$ to the diameter of cutter element 200 is less than 1.0, preferably between 0.10 and 0.90, more preferably between 0.20 and 0.80, and even more preferably between 0.25 and 0.75, and still even more preferably between 0.33 and 0.66; and the aspect ratio of central region 225 is preferably less than 50.0, more preferably between 0.10 and 30.0, more preferably between 0.50 and 30.0, even more preferably between 1.0 and 10.0, and still even more preferably between 1.0 and 5.0. In some embodiments, the aspect ratio of the central region (e.g., central region 225) is between 0.25 and 10.0. In this embodiment, the aspect ratio of central region 225 is 1.37.

Referring now to FIGS. 5A-5D, in this embodiment, a pair of planar surfaces or flats 230*a*, 230*b* extend across radially outer surfaces 202, 212 of substrate 201 and cutting layer 210, respectively. Each flat 230*a*, 230*b* extends axially from cutting face 220 along outer surface 212 of cutting layer 201 and across plane of intersection 209 into and along outer surface 202 of substrate 201. However, in this embodiment, flats 230*a*, 230*b* do not extend to second end 201*b* of substrate 201. Rather, flats 230*a*, 230*b* terminate proximal but axially spaced from end 201*b*. Each flat 230*a*, 230*b* is contiguous and smooth as it extends across outer surfaces 212, 202.

Figure 5F:
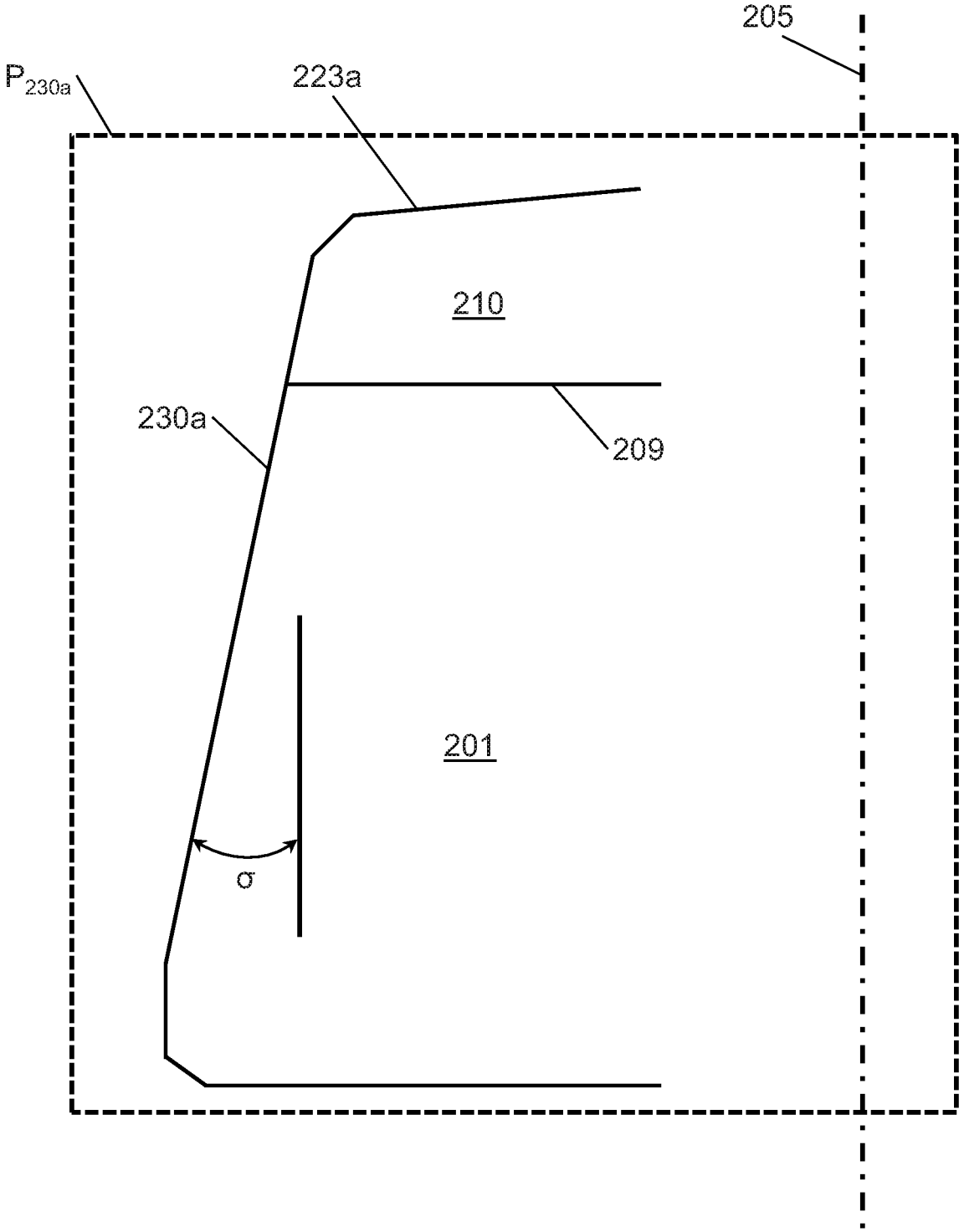
FIG. 5F is a partial cross-sectional view of one of the cutter elements of FIG. 2 taken in section 5F-5F of FIG. 5B.

Flats 230*a*, 230*b* are circumferentially spaced along outer surfaces 202, 212, and generally positioned on opposite circumferential sides of cutting facet 221. Flat 230*a* circumferentially spans a portion of cutting facet 221 and lateral facet 223*a* along outer surface 212 and flat 230*b* circumferentially spans a portion of cutting facet 221 and lateral facet 223*b*. In this embodiment, each flat 230*a*, 230*b* is oriented perpendicular to a plane $P_{230a}$, $P_{230b}$, respectively, containing the central axis 205. Planes $P_{230a}$, $P_{230b}$ are angularly spaced apart about axis 205 by an angle μ that is less than 180°, preferably 70° to 120°, and more preferably 80° to 100°. In this embodiment, angle μ is 90°. Further, each flat 230*a*, 230*b* generally slopes radially outward moving axially from its end at cutting face 220 to its end along substrate 201. More specifically, FIG. 5F illustrates a partial cross-section of cutter element 200 taken in section 5F-5F of FIG. 5B. Section 5F-5F lies in reference plane $P_{230a}$, and thus, FIG. 5F illustrates a partial cross-section of cutter element 200 as viewed perpendicular to plane $P_{230a}$ and parallel to flat 230*a*. As shown in FIG. 5F, flat 230*a* is oriented at an acute angle σ measured in plane $P_{230a}$ between central axis 205 and flat 230*a*. Angle σ is preferably 2° to 10°, and more preferably 6° to 8°. In this embodiment, angle σ is 7°. Although FIG. 5F illustrates the slope angle σ of flat 230*a*, it should be appreciated that flat 230*b* is similarly configured and oriented. In general, both flats 230*a*, 230*b* can be oriented at the same angle σ or different angles σ. In this embodiment, both flats 230*a*, 230*b* are oriented at the same angle σ of 7° measured in the corresponding plane $P_{230a}$, $P_{230b}$ relative to central axis 205. However, in other embodiments, the angle the angle σ between each flat 230*a*, 230*b* relative to central axis 205 measured in plane $P_{230a}$, $P_{230b}$, respectively, may be different.

Referring to FIGS. 5A-5D, as previously described, lateral facets 223*a*, 223*b* slope axially downward toward substrate 201 moving from regions 221, 225, 222 to outer surface 212. As a result, regions 221, 225, 222 define an elongate, generally raised ridge or crown 227 extending linearly completely across cutting face 220. Thus, ridge 227 may be described as having a first end at outer surface 212 at one side of cutter element 200 and a second end at outer surface 212 at the radially opposite side of cutter element 200. Ridge 227 (or at least a portion thereof) defines the maximum height of cutter element 200 measured axially from end 201*b* to cutting face 220 at end 210*a*.

As best shown in the top view of cutter element 200 in FIG. 5B (looking at cutting face 220 as viewed parallel to central axis 205), in this embodiment, cutting face 220 is symmetric about the reference plane 228 that contains central axis 205, is disposed between lateral regions 223*a*, 223*b*, and bisects crown 227 and regions 221, 222. In this embodiment, planes $P_{230a}$, $P_{230b}$ are equally angularly spaced from plane 228 (on opposite directions from plane 228). Thus, the angle between planes 228, $P_{230a}$ is ½ the angle μ and the angle between planes 228, $P_{230b}$ is ½ the angle μ.

Referring again to FIGS. 2 and 3, cutting elements 200 are mounted in bit body 110 such that cutting faces 220 are exposed to the formation material, and further, such that cutting faces 220 are oriented so that cutting edges 229, flats 230*a*, 230*b*, and regions 221, 222, 223*a*, 223*b*, 225 are positioned to perform their distinct functional roles in abrading/shearing, excavating, and removing rock from beneath the drill bit 110 during rotary drilling operations. More specifically, each cutter element 200 is mounted to a corresponding blade 141, 142 with substrate 201 received and secured in a pocket formed in the cutter support surface 144 of the blade 141, 142 to which it is fixed by brazing or other suitable means. Each cutter element 200 is oriented with axis 205 oriented generally parallel or tangent to cutting direction 106 and such that the corresponding cutting face 220 is exposed and leads the cutter element 200 relative to cutting direction 106 of bit 100. As previously described, cutting faces 220 are forward-facing. In addition, each cutter element 200 is oriented with plane 228 oriented perpendicular to the cutter support surface 144, cutting region 221 distal the corresponding cutter support surface 144, and relief region 222 proximal the corresponding cutter support surface 144. Consequently, the intersection between cutting region 221 and chamfer 211 (between flats 230*a*, 230*b*) of each cutter element 200 defines a cutting edge 229 of that cutter element 200. Each cutting edge 229 defines an extension height or the corresponding cutter element 200. In general, the extension height of a cutter element (e.g., cutter element 200) is generally the distance from the cutter support surface of the blade to which the cutter element is mounted to the outermost point or portion of the cutter element as measured perpendicular to the cutter supporting surface. The extension heights of cutter elements 200 can be selected to so as to ensure that cutting edges 229 of cutter elements 200 achieve the desired depth of cut, or at least be in contact with the rock during drilling.

During drilling operations, each cutting face 220 engages, penetrates, and shears the formation as the bit 100 is rotated in the cutting direction 106 and is advanced through the formation. Due to the orientation of cutter elements 200, cutting edges 229 of cutter elements 200 function as the primary cutting edges as cutter elements 200 engage the formation. The sheared formation material slides along cutting region 221 and lateral side regions 223*a*, 223*b* as cutting faces 220 pass through the formation with flats 230*a*, 230*b* and the portion of outer surface 202 therebetween sliding along and bearing against the exposed uncut formation. Thus, as each cutting face 220 advances through the formation, it cuts a kerf in the formation generally defined by the cutting profile of the cutting face 220. The geometry of cutting face 220 is particularly designed to offer the potential to improving cutting efficiency and cleaning efficiency to increase rate of penetration (ROP) and durability of bit 100. In particular, the downward slope of regions 221, 222 toward base 201 moving from central region 225 to outer surface 212 increases relief relative to the corresponding cutting edge 229, which allows drilling fluid to be directed toward the cutting edge 229 and formation cuttings to efficiently slide along cutting face 220. The downward slope of lateral side regions 223*a*, 223*b* toward base 201 moving laterally from ridge 227 allows cutting face 220 to draw the extrudates of formation material.

Referring now to FIGS. 6A-6D, another embodiment of a cutter element 300 is shown. In general, a plurality of cutter elements 300 can be used in place of cutter elements 200 on bit 100 previously described.

Cutter element 300 is substantially the same as cutter element 200 previously described with the exception that an additional pair of planar surfaces or flats 230*a*', 230*b*' extend across radially outer surfaces 202, 212 of substrate 201 and cutting layer 210, respectively, and two cutting edges 229, 229' are provided. More specifically, in this embodiment, insert 300 includes a base 201 and a cutting disc or layer 210 bonded to the base 201 at a plane of intersection 209. Base 201 and cutting layer 210 are each as previously described. Thus, base 201 has a central axis 205, a first end 201*a* bonded to cutting layer 210, a second end 201*b* distal cutting layer 210, and a radially outer surface 202 extending axially between ends 201*a*, 201*b*. In addition, cutting layer 210 has a first end 210*a* distal substrate 201, a second end 210*b* bonded to end 201*a* of substrate 201, and a radially outer surface 212 extending axially between ends 210*a*, 210*b*. The outer surface of cutting layer 210 at first end 210*a* defines the cutting face 220 of cutter element 300. In this embodiment, a chamfer or bevel 211 is provided at the intersection of cutting face 220 and outer surface 212 about the entire outer periphery of cutting face 220.

Cutting face 220 includes a central region or surface 225, a cutting region or surface 221 extending radially from central region 225 to outer surface 212, a relief region or surface 222 extending radially from central region 225 to outer surface 212, and a pair of lateral side regions or surfaces 223*a*, 223*b* extending from regions 225, 221, 222 to outer surface 212, each region 221, 222, 223*a*, 223*b*, 225 is as previously described. Thus, for example, the ratio of the length $L_{225}$ of central region 225 to the diameter of cutter element 300 is less than 1.0, preferably between 0.10 and 0.90, more preferably between 0.20 and 0.80, and even more preferably between 0.25 and 0.75, and still even more preferably between 0.33 and 0.66; and the aspect ratio of central region 225 is preferably less than 50.0, more preferably between 0.10 and 30.0, more preferably between 0.50 and 30.0, even more preferably between 1.0 and 10.0, and still even more preferably between 1.0 and 5.0. In some embodiments, the aspect ratio of the central region (e.g., central region 225) is between 0.25 and 10.0. The length $L_{225}$ and width $W_{225}$ of central region 225 of cutter element 300 are determined in the same manner as previously described with respect to cutter element 200. Further, a pair of planar surfaces or flats 230*a*, 230*b* as previously described extend across radially outer surfaces 202, 212 of substrate 201 and cutting layer 210, respectively. However, unlike cutter element 200 previously described, in this embodiment, another pair of planar surfaces or flats 230*a*', 230*b*' extend across radially outer surfaces 202, 212 of substrate 201 and cutting layer 210, respectively.

As will be described in more detail below, cutter element 300 is designed and configured such that it includes two cutting edges 229, 229' that are used one at a time such that cutter element 300 can engage and shear the formation with one cutting edge 229, and then when that cutting edge 229 is sufficiently worn, cutter element 300 can be removed from the bit (e.g., bit 100), rotated, and then reattached to the bit to allow the other unworn cutting edge 229' to engage and shear the formation. This offer the potential to enhance the overall operating lifetime of cutter element 300 as compared to cutter element 200 previously described that includes one cutting edge 229. Cutting edge 229 is disposed at the intersection of region 221 and chamfer 211 circumferentially between flats 230*a*, 230*b*, while cutting edge 229' is disposed at the intersection of region 222 and outer surface 212 circumferentially between flats 230*a*', 230*b*'. When cutting edge 229 is positioned to engage and shear the formation, region 221 functions as a cutting region while region 222 functions as a relief region, whereas when cutting edge 229' is positioned to engage and shear the formation, region 222 functions as a cutting region while region 221 functions as a relief region. Accordingly, in this embodiment, each region 221, 222 may be referred to as a "cutting" region or a "relief" region depending on the orientation of cutter element 300 when it is mounted to bit 100.

Referring still to FIGS. 6A-6E, flats 230*a*', 230*b*' are substantially the same as flats 230*a*, 230*b* previously described, but are generally disposed on the opposite side of ridge 227 as flats 230*a*, 230*b*. In particular, each flat 230*a*', 230*b*' extends axially from cutting face 220 along outer surface 212 of cutting layer 201 and across plane of intersection 209 into and along outer surface 202 of substrate 201. However, flats 230*a*', 230*b*' do not extend to second end 201*b* of substrate 201. Rather, flats 230*a*', 230*b*' terminate proximal but axially spaced from end 201*b*. Each flat 230*a*', 230*b*' is contiguous and smooth as it extends across outer surfaces 212, 202. In addition, flats 230*a*', 230*b*' are circumferentially spaced along outer surfaces 202, 212, and generally positioned on opposite circumferential sides of facet 222. Flat 230*a*' circumferentially spans a portion of cutting facet 222 and lateral facet 223*a* along outer surface 212 and flat 230*b*' circumferentially spans a portion of cutting facet 222 and lateral facet 223*b*. In this embodiment, each flat 230*a*', 230*b*' is oriented perpendicular to a plane $P_{230a}$', $P_{230b}$', respectively, containing the central axis 205. Planes $P_{230a}$', $P_{230b}$' are angularly spaced apart about axis 205 by an angle μ that is less than 180°, preferably 70° to 120°, and more preferably 80° to 100°. In this embodiment, angle μ is 90°. In this embodiment, the angle μ between flats 230*a*, 230*b* is the same as the angle μ between flats 230*a*', 230*b*'. However, in other embodiments, the angle μ between flats 230*a*, 230*b* may be different from the angle μ between flats 230*a*', 230*b*'.

Each flat 230*a*', 230*b*' generally slopes radially outward moving axially from its end at cutting face 220 to its end along substrate 201. As with flats 230*a*, 230*b* previously described and shown in FIG. 5F, each flat 230*a*', 230*b*' is oriented at an acute angle σ measured in plane $P_{230a}$', $P_{230b}$', respectively, between central axis 205 and flat 230*a*', 230*b*', respectively. Each angle σ is preferably 2° to 10°, and more preferably 6° to 8°. In this embodiment, each angle σ is 7°. Although the angle σ between each flat 230*a*', 230*b*' relative to central axis 205 measured in plane $P_{230a}'$, $P_{230b}'$ respectively, is the same in this embodiment, in other embodiments, the angle the angle σ between each flat 230*a*', 230*b*' relative to central axis 205 measured in plane $P_{230a}'$, $P_{230b}'$, respectively, may be different. Still further, in this embodiment, the angle σ at which each flat 230*a*, 230*b*, 230*a*', 230*b*' is oriented relative to central axis 205 is the same, however, in other embodiments, the angle σ of one or more flat(s) 230*a*, 230*b*, 230*a*', 230*b*' may be different than the others.

Figure 6A:
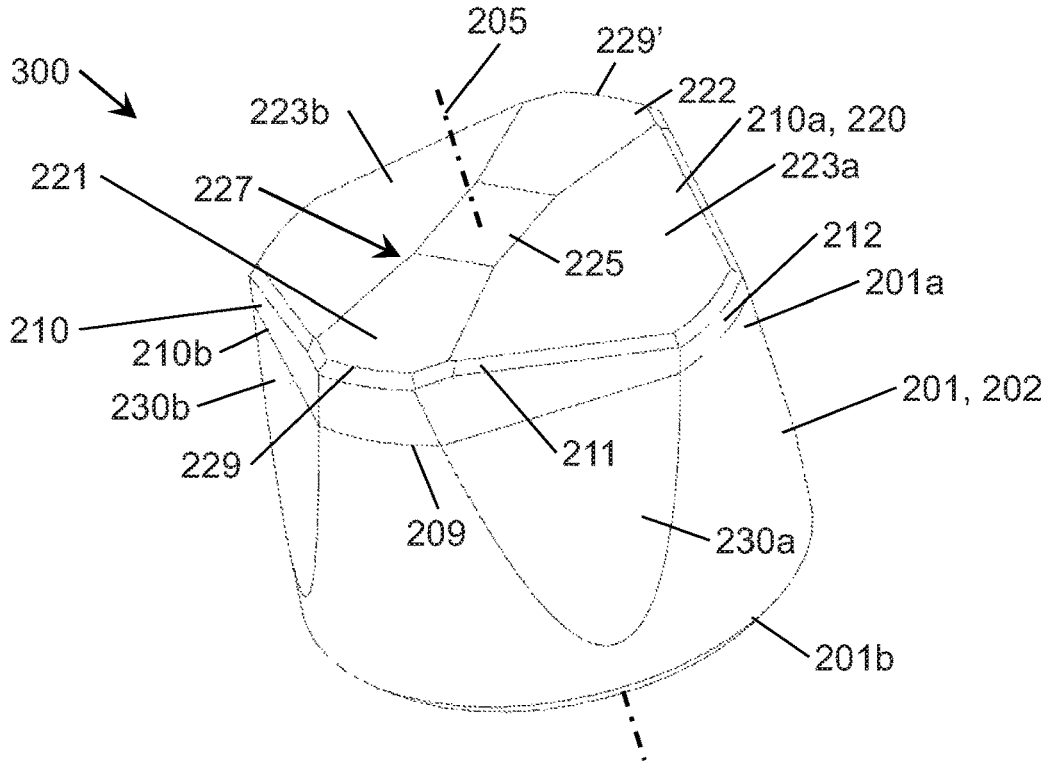
FIGS. 6A-6D are perspective, top, front side, and lateral side views, respectively, of an embodiment of a cutter element in accordance with the principles described herein.
Figure 6B:
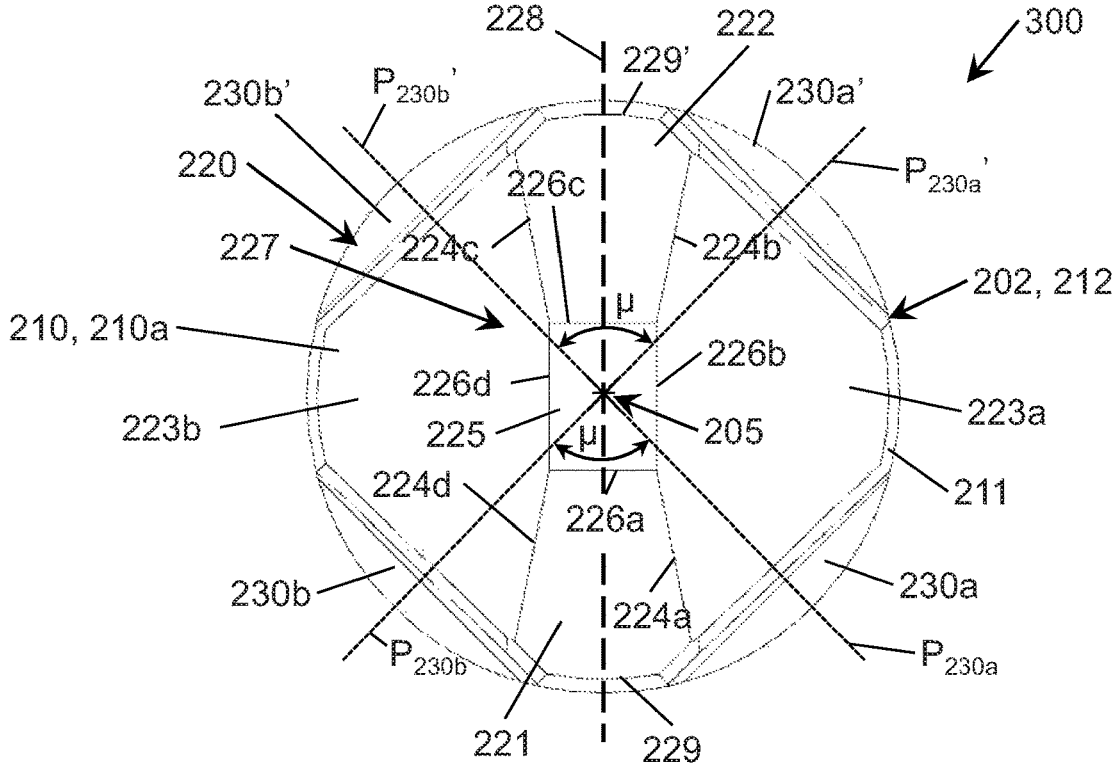
Figure 6C:
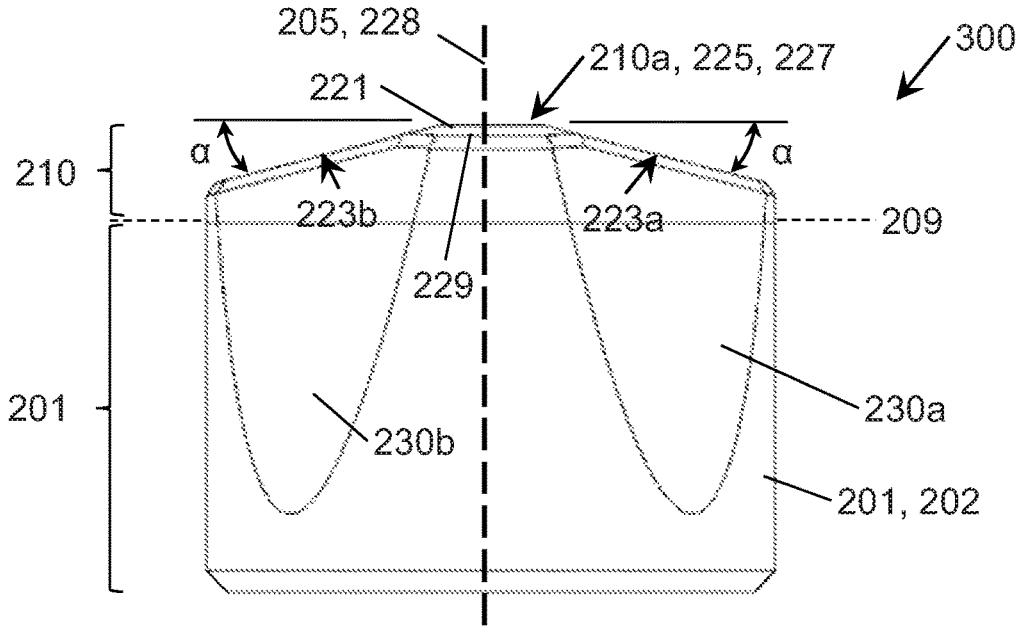
Figure 6D:
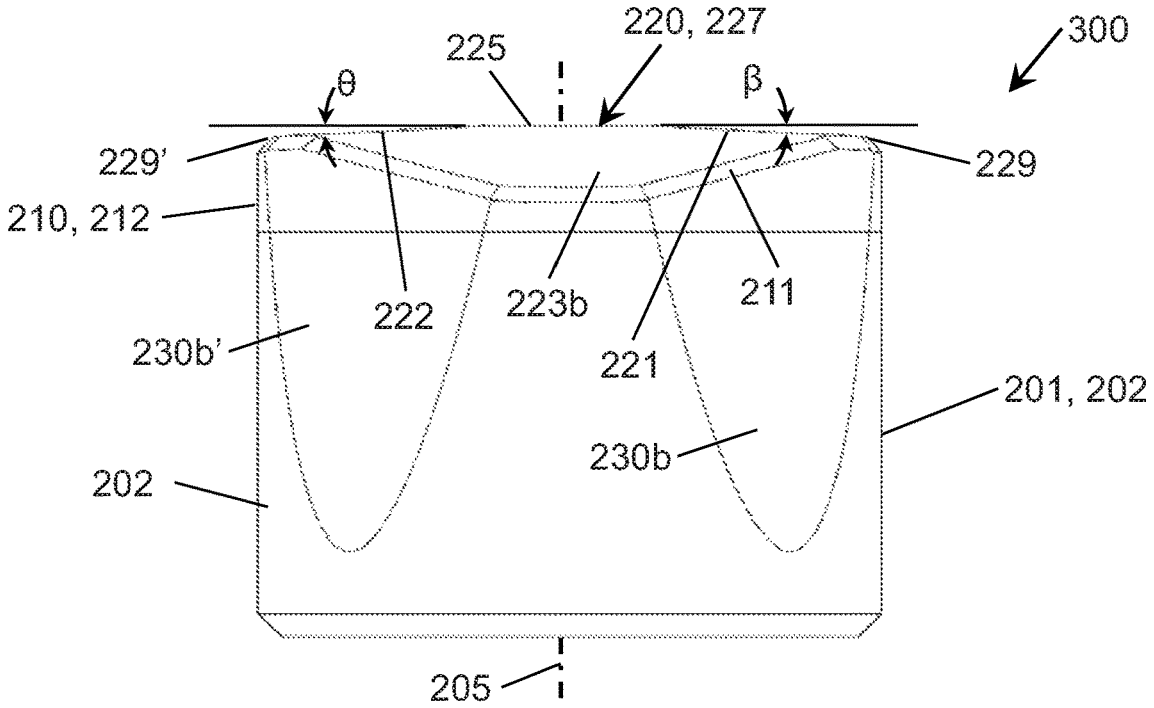

As best shown in the top view of cutter element 300 in FIG. 6B (looking at cutting face 220 as viewed parallel to central axis 205), in this embodiment, cutting face 220 is symmetric about the reference plane 228 that contains central axis 205, is disposed between lateral regions 223*a*, 223*b*, and bisects crown 227 and regions 221, 222. In this embodiment, planes $P_{230a}$, $P_{230b}$ are equally angularly spaced from plane 228 (on opposite directions from plane 228) and planes $P_{230a}'$, $P_{230b}'$ are equally angularly spaced from plane 228 (on opposite directions from plane 228). Thus, the angle between planes 228, $P_{230a}$ is ½ the angle μ between planes $P_{230a}$, $P_{230b}$, the angle between planes 228, $P_{230b}$ is ½ the angle μ between planes $P_{230a}$, $P_{230b}$, the angle between planes 228, $P_{230a}'$ is ½ the angle μ between planes $P_{230a}'$, $P_{230b}'$, and the angle between planes 228, $P_{230b}'$ is ½ the angle μ between planes $P_{230a}'$, $P_{230b}'$. In other embodiments, planes $P_{230a}$, $P_{230b}$ may not be equally angularly spaced from plane 228, and/or planes $P_{230a}'$, $P_{230b}'$ may not be equally angularly spaced from plane 228.

Cutting elements 300 are mounted in bit body 110 in the same manner and orientation as cutter elements 200 previously described. More specifically, each cutter element 300 is mounted to a corresponding blade 141, 142 with substrate 201 received and secured in a pocket formed in the cutter support surface 144 of the blade 141, 142 to which it is fixed by brazing or other suitable means. In addition, each cutter element 300 is oriented with axis 205 oriented generally parallel or tangent to cutting direction 106 and such that the corresponding cutting face 220 is exposed and leads the cutter element 300 relative to cutting direction 106 of bit 100. Further, cutter elements 300 are oriented with corresponding planes 228 oriented perpendicular to the cutter support surface 144, one region 221, 222 distal the corresponding cutter support surface 144 (with one cutting edge 229, 229' defining the extension height of the cutter element 300), and the other region 221, 222 proximal the corresponding cutter support surface 144.

During drilling operations, cutting faces 220 of cutter elements 300 engage, penetrate, and shear the formation in the same manner as cutting faces 220 of cutter elements 200 previously described. However, since cutting faces 220 of cutter elements 300 include two cutting edges 229, 229', one cutting edge 229, 229' of each cutter element 300 can be used first to engage, penetrate, and shear the formation, and then when those cutting edges 229, 229' are sufficiently worn (e.g., the cutting efficiency and rate of penetration of the bit are sufficiently low), cutter elements 300 can be removed from the bit body 110, and then re-mounted to bit body 110 with the other cutting edge 229, 229' positioned to engage, penetrate and shear the formation. The ability to reuse cutter elements 300 after one cutting edge 229, 229' is sufficiently worn offers the potential to significantly increase the operating lifetime of cutter elements 300 as compared to other cutter elements that include only one primary cutting edge.

In the embodiments of cutter elements 200, 300 previously described and shown in FIGS. 5A-5F and 6A-6D, respectively, ridge 227 was generally convex or bowed outwardly in front side view (FIGS. 5C and 6C) and in lateral side view (FIGS. 5D and 6D), both cutting region 221 and relief region 222 sloped upward and axially away from base 201 moving radially inward toward center region 225, each discrete region 221, 222, 225, 223*a*, 223*b* on cutting face 220 was planar, and each discrete region 221, 222, 225, 223*a*, 223*b* intersected each adjacent region 221, 222, 225, 223*a*, 223*b* along a linear edge 224*a*, 224*b*, 224*c*, 224*d*, 226*a*, 226*b*, 226*c*, 226*d*. However, in other embodiments, the ridge (e.g., ridge 227) may be generally concave or generally partly concave and partly convex in lateral side view; one or both of the cutting region and the relief region (e.g., regions 221, 222) may slope downward and axially toward the base (e.g., 201) moving radially toward the center region (e.g., region 225); one or more of the center region (e.g., region 225), the cutting region (e.g., region 221), and the relief region (e.g., region 222) may be continuously and smoothly curved (e.g., concave or convex); and some discrete regions (e.g., discrete regions 221, 222, 225, 223*a*, 223*b*) on the cutting face (e.g., cutting face 220) may intersect an adjacent region on the cutting face along a non-linear edge. Exemplary embodiments of cutter elements including such variations will now be described and shown in FIGS. 7A-7E, 8A-8E, and 9A-9E.

Referring now to FIGS. 7A-7E, an embodiment of a cutter element 400 is shown. In general, a plurality of cutter elements 400 can be used in place of cutter elements 200 on bit 100 previously described. Cutter element 400 is substantially the same as cutter element 200 previously described with the exception that the cutting region (e.g, cutting region 221) and the relief region (e.g., relief region 222) of the cutting face (e.g., cutting face 220) are smoothly curved and concave. More specifically, in this embodiment, cutter element 400 includes a base 201 and a cutting disc or layer 410 bonded to the base 201 at a plane of intersection 209. Base 201 is as previously described. Thus, base 201 has a central axis 205, a first end 201*a* bonded to cutting layer 410, a second end 201*b* distal cutting layer 410, and a radially outer surface 202 extending axially between ends 201*a*, 201*b*.

Cutting layer 410 is substantially the same as cutting layer 210 previously described except that the cutting region (e.g., cutting region 221) and the relief region (e.g., relief region 222) of the cutting face (e.g., cutting face 220) are not planar. In particular, cutting layer 410 has a first end 410*a* distal substrate 201, a second end 410*b* bonded to end 201*a* of substrate 201, and a cylindrical radially outer surface 412 extending axially between ends 410*a*, 410*b*. The outer surface of cutting layer 410 at first end 410*a* defines the cutting face 420 of cutter element 400. In this embodiment, a chamfer or bevel 411 is provided at the intersection of cutting face 420 and outer surface 412 about the entire outer periphery of cutting face 420.

Cutting face 420 is defined by a plurality of discrete regions or surfaces. More specifically, cutting face 420 includes a rectangular central region or surface 225, a cutting region or surface 421 extending radially from central region 225 to outer surface 412, a relief region or surface 422 extending radially from central region 225 to outer surface 412, and a pair of lateral side regions or surfaces 223*a*, 223*b* extending from regions 225, 421, 422 to outer surface 412. Regions 421, 422, 223*a*, 223*b* are circumferentially disposed about axis 205 and central region 225. In addition, regions 421, 422, 223*a*, 223*b* are positioned circumferentially adjacent each other with each region 421, 422 circumferentially disposed between regions 223*a*, 223*b* and each region 223*a*, 223*b* circumferentially disposed between regions 421, 422. The centerlines of regions 421, 422 are angularly spaced 180° apart about axis 205. Accordingly, regions 421, 422 extend radially in opposite directions from central region 225 to outer surface 412. Each region 225, 223*a*, 223*b* is as previously described. Namely, region 225 is planar, centered relative to axis 205, and oriented perpendicular to axis 205, and regions 223*a*, 223*b* are planar, slope axially downward toward base 201 moving radially outward from regions 225, 421, 422 to outer surface 412, and are oriented at the non-zero acute angle $\alpha$ measured from the lateral region 223*a*, 223*b* to a reference plane oriented perpendicular to central axis 205 in the front side view and the rear side view as previously described. In addition, the ratio of the length $L_{225}$ of central region 225 to the diameter of cutter element 400 is less than 1.0, preferably between 0.10 and 0.90, more preferably between 0.20 and 0.80, and even more preferably between 0.25 and 0.75, and still even more preferably between 0.33 and 0.66; and the aspect ratio of central region 225 is preferably less than 50.0, more preferably between 0.10 and 30.0, more preferably between 0.50 and 30.0, even more preferably between 1.0 and 10.0, and still even more preferably between 1.0 and 5.0. In some embodiments, the aspect ratio of the central region (e.g., central region 225) is between 0.25 and 10.0. The length $L_{225}$ and width $W_{225}$ of central region 225 of cutter element 400 are determined in the same manner as previously described with respect to cutter element 200. However, unlike cutting region 221 and relief region 222 of cutting face 220 of cutter element 200 previously described, in this embodiment, cutting region 421 is smoothly and continuously curved and concave and relief region 422 is smoothly and continuously curved and concave. Thus, cutting region 421 curves axially upward and away from base 201 moving radially from center region 225 to outer surface 412, and relief region 422 curves axially upward and away from base 201 moving from center region 225 to outer surface 412. As a result, and described in more detail below, an elongate ridge 427 defined by regions 421, 225, 422 is generally concave in lateral side view (FIG. 7D), and the lateral side regions 223*a*, 223*b* intersect cutting region 421 and relief region 422 along non-linear edges 424*a*, 424*b*, 424*c*, 424*d*. In this embodiment, both regions 421, 422 smoothly transition and blend into center region 225.

In this embodiment, each region 421, 422 is a cylindrical surface disposed at a corresponding radius of curvature. As best shown in FIG. 7D, each region 421, 422 is a cylindrical surface disposed at a radius $R_{421}$, $R_{422}$, respectively, relative to a corresponding axis oriented perpendicular to a reference plane 428 that contains central axis 205, is disposed between lateral regions 223*a*, 223*b*, and bisects crown 427 and regions 421, 422 Each radius $R_{421}$, $R_{422}$ ranges from 15.0 to 100.0 mm, and more preferably ranges from 20.0 to 80.0 mm. In general, radii radius $R_{421}$, $R_{422}$ can be the same or different. In this embodiment, each radius $R_{421}$, $R_{422}$ is the same, and in particular, each radius $R_{421}$, $R_{422}$ is 30.0 mm.

As previously described, lateral regions 223*a*, 223*b* slope axially downward toward substrate 201 moving from regions 421, 225, 422 to outer surface 412. As a result, regions 421, 225, 422 define an elongate, generally raised ridge or crown 427 extending linearly completely across cutting face 420. Thus, ridge 427 may be described as having a first end at outer surface 412 at one side of cutter element 400 and a second end at outer surface 412 at the radially opposite side of cutter element 400. Ridge 427 (or at least a portion thereof) defines the maximum height of cutter element 400 measured axially from end 201*b* to cutting face 420 at end 410*a*.

Due to the geometry of regions 223*a*, 223*b*, 225, 421, 422, and unlike crown 227 previously described, crown 427 is generally convex in front side view (FIG. 7C) but generally concave in lateral side view (FIG. 7D). In addition, due to the geometry of regions 225, 223*a*, 223*b*, region 225 intersects regions 223*a*, 223*b* along linear edges 226*b*, 226*d*, while regions 421, 422 intersect lateral regions 223*a*, 223*b* along curved edges 424*a*, 424*b*, 424*c*, 424*d*. Curved regions 421, 422 smoothly transition into planar central region 225, and thus, there is not a distinct edge between regions 421, 225 or regions 422, 225 in this embodiment. However, for purposes of clarity, the transitions from planar central region 225 into smoothly curved convex regions 421, 422 are identified with dashed lines 426*a*, 426*c*, respectively. Since dashed lines 426*a*, 426*c* define the locations at which the slope of crown 427 changes moving from central region 425 into curved regions 421, 422, lines 426*a*, 426*c* may also be referred to as transition lines. For purposes of clarity, the length $L_{225}$ of central region 225 of crown 427 is measured parallel to plane 428 from line 426*a* to line 426*b*.

Figure 7A:
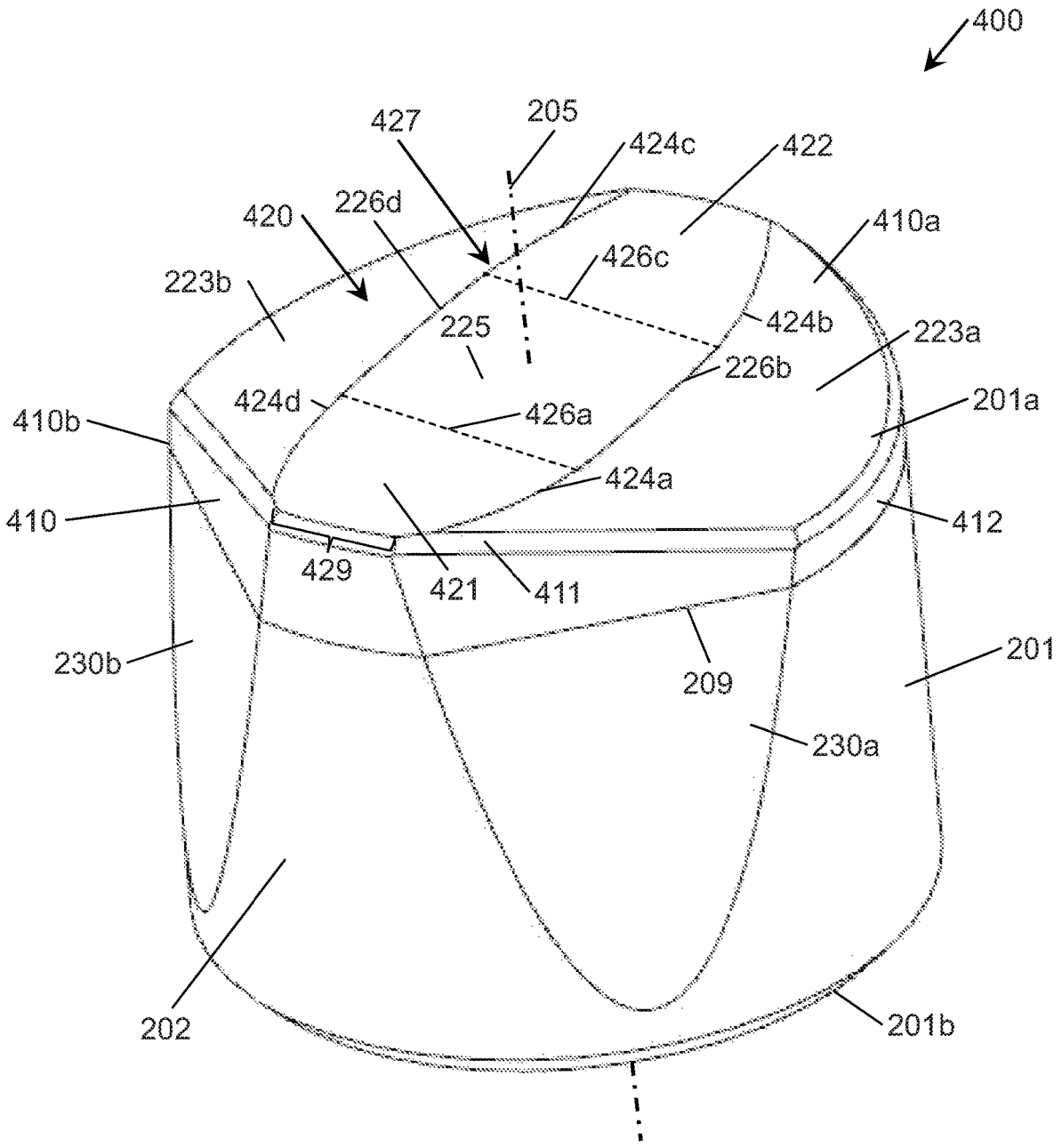
FIGS. 7A-7E are perspective, top, front side, lateral side, and rear side views, respectively, of an embodiment of a cutter element in accordance with the principles described herein.
Figure 7B:
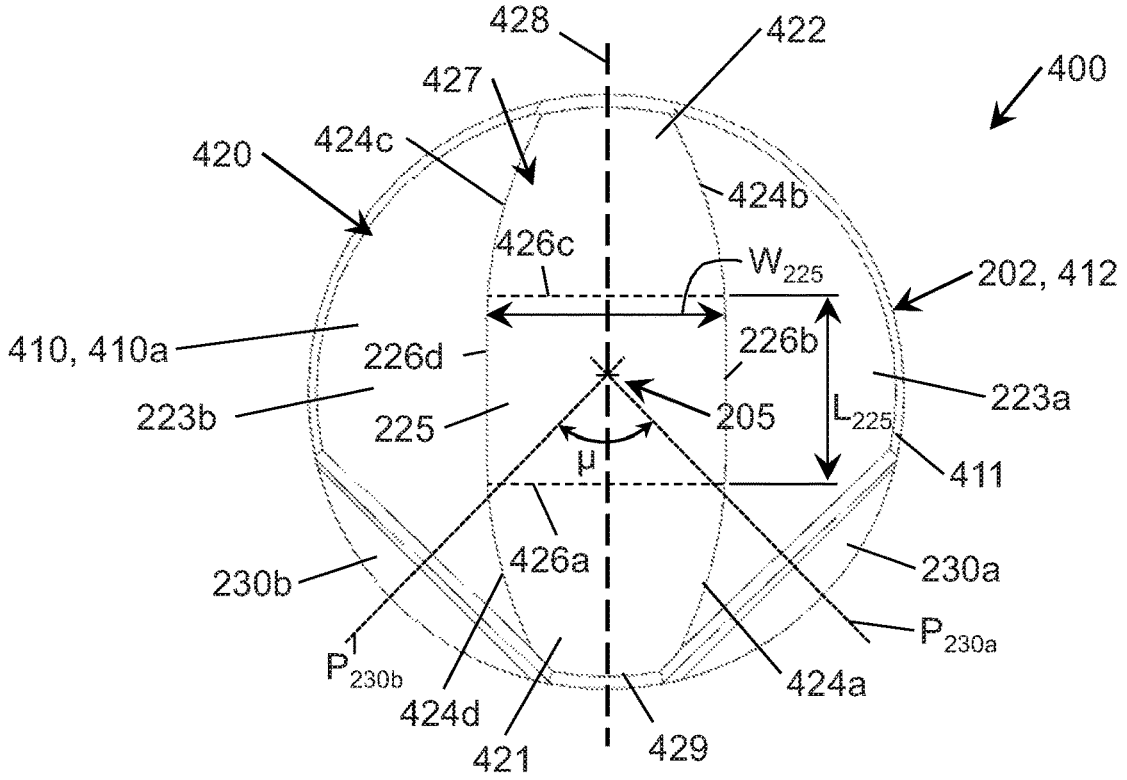
Figure 7C:
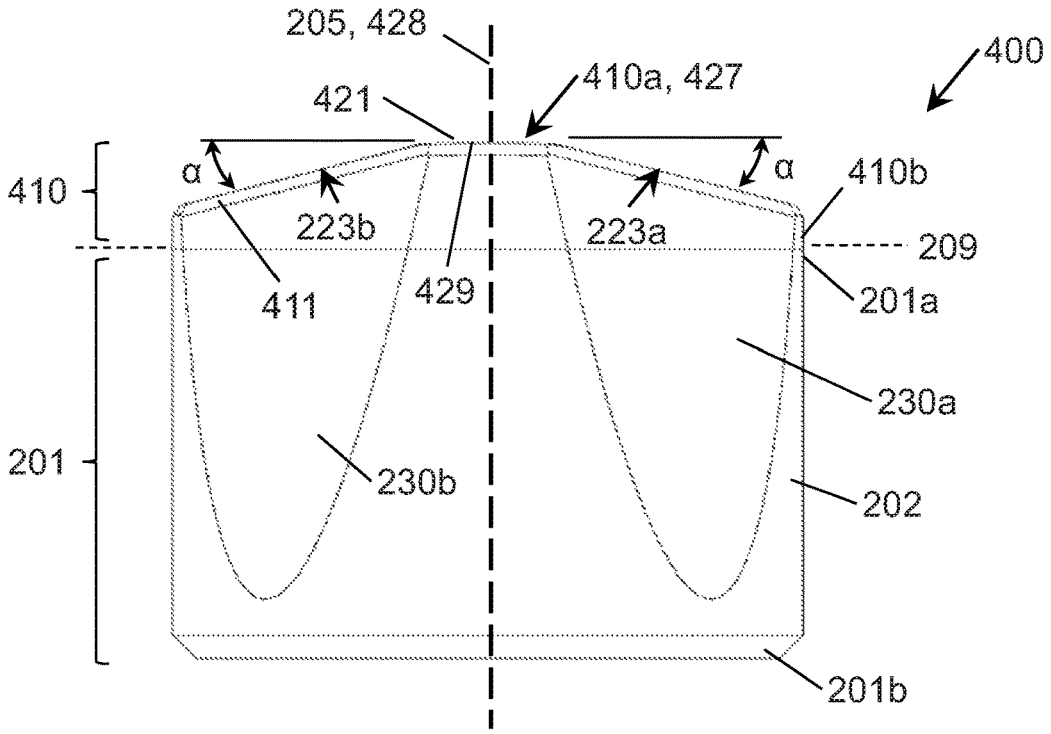
Figure 7D:
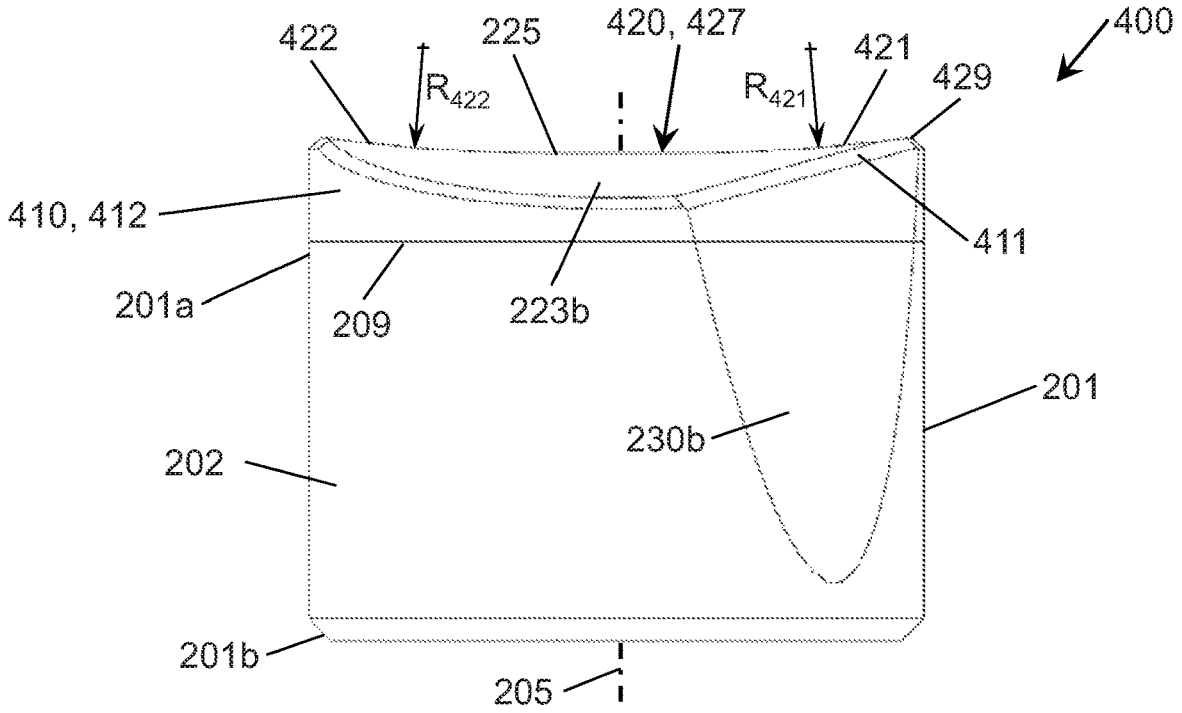
Figure 7E:
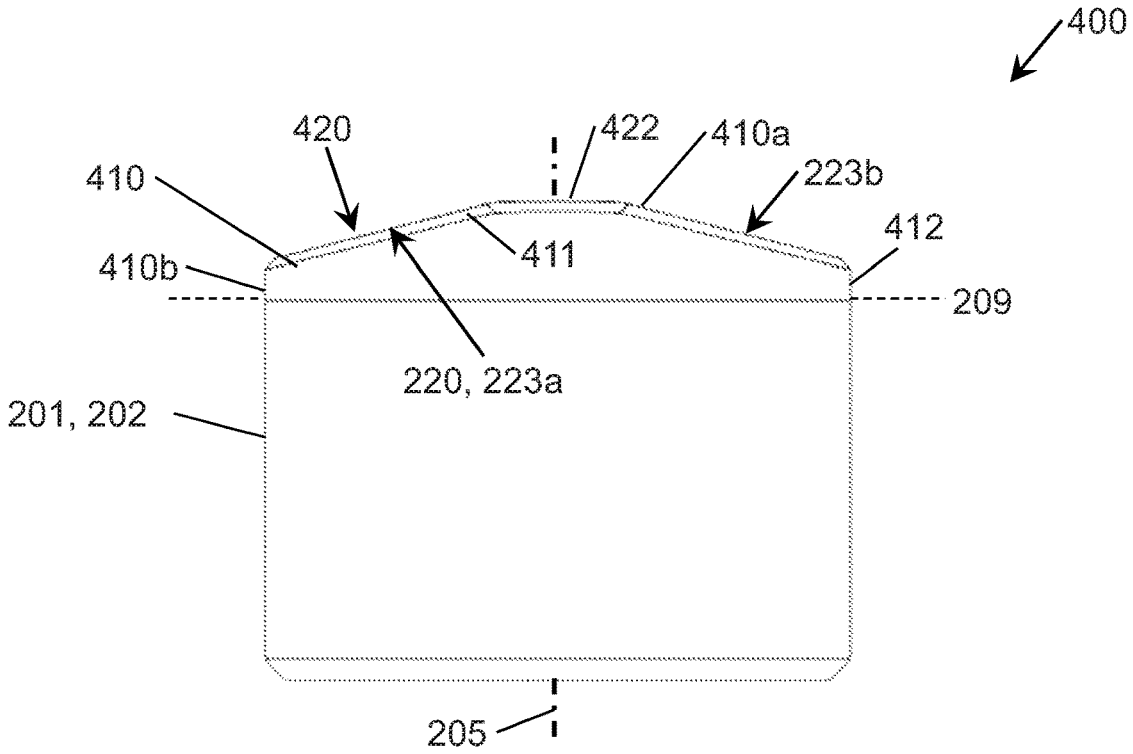

As best shown in the top view of cutter element 400 in FIG. 7B (looking at cutting face 420 as viewed parallel to central axis 205), in this embodiment, curved edges 424*a*, 424*d* generally move toward each other moving radially along cutting region 421 from central region 225 to outer surface 412, and curved edges 424*b*, 424*c* generally move toward each other moving radially along relief region 222 from central region 225 to outer surface 412. As a result, and unlike cutter element 200 previously described, cutting region 421 has a width measured perpendicular to a reference plane 428 containing central axis 205 in top view that decreases moving radially from central region 225 to outer surface 412, and similarly, relief region 422 has a width measured perpendicular to reference plane 428 in top view that decreases moving radially from central region 225 to outer surface 412.

Referring still to FIGS. 7A-7E, a pair of planar surfaces or flats 230*a*, 230*b* extend across radially outer surfaces 202, 412 of substrate 201 and cutting layer 410, respectively. Flats 230*a*, 230*b* are as previously described. For example, flats 230*a*, 230*b* are circumferentially spaced along outer surfaces 202, 412, and generally positioned on opposite circumferential sides of cutting region 421. Flat 230*a* circumferentially spans a portion of cutting region 421 and lateral facet 223*a* along outer surface 412 and flat 230*b* circumferentially spans a portion of cutting region 421 and lateral facet 223*b* along outer surface 412. In addition, in this embodiment, each flat 230*a*, 230*b* is oriented perpendicular to a plane $P_{230a}$, $P_{230b}$, respectively, containing the central axis 205 Planes $P_{230a}$, $P_{230b}$ are angularly spaced apart about axis 205 by an angle $\mu$ that is less than 180°, preferably 70° to 120°, and more preferably 80° to 100°. In this embodiment, angle $\mu$ is 90°. Further, each flat 230*a*, 230*b* generally slopes radially outward moving axially from its end at cutting face 420 to its end along substrate 201. More specifically, in this embodiment, each flat 230*a*, 230*b* is oriented at an acute angle $\sigma$ measured in plane $P_{230a}$ between central axis 205 and flat 230*a*. Angle $\sigma$ is preferably 2° to 10°, and more preferably 6° to 8°. In this embodiment, angle $\sigma$ is 7°.

As best shown in the top view of cutter element 400 in FIG. 7B (looking at cutting face 420 as viewed parallel to central axis 205), in this embodiment, cutting face 420 is symmetric about the reference plane 428 that contains central axis 205, is disposed between lateral regions 223*a*, 223*b*, and bisects crown 427 and regions 421, 422. A cutting edge 429 is defined at the intersection of cutting region 421 and chamfer 411 between flats 230*a*, 230*b*.

A plurality of cutting elements 400 are mounted in bit body 110 in the same manner and orientation as cutter elements 200 previously described. More specifically, each cutter element 400 is mounted to a corresponding blade 141, 142 with substrate 201 received and secured in a pocket formed in the cutter support surface 144 of the blade 141, 142 to which it is fixed by brazing or other suitable means. In addition, each cutter element 400 is oriented with axis 205 oriented generally parallel or tangent to cutting direction 106 and such that the corresponding cutting face 420 is exposed and leads the cutter element 400 relative to cutting direction 106 of bit 100. Further, cutter elements 400 are oriented with corresponding planes 428 oriented perpendicular to the cutter support surface 144, cutting region 421 distal the corresponding cutter support surface 144 (with cutting edge 429 defining the extension height of the cutter element 400), and relief region 421 proximal the corresponding cutter support surface 144. During drilling operations, cutting faces 420 of cutter elements 400 engage, penetrate, and shear the formation in the same manner as cutting faces 220 of cutter elements 200 previously described.

In the embodiment of cutter element 200 described above and shown in FIGS. 5A-5F, regions 221, 222, 225 are planar; and in the embodiment of cutter element 400 described above and shown in FIGS. 7A-7E, regions 421, 422 are smoothly curved and concave, while central region 225 is planar. However, in other embodiments, the cutting region (e.g., cutting region 221, 421) may be smoothly curved and convex, the relief region (e.g., relief region 222, 422) may be smoothly curved and convex, the central region (e.g., central region 225) may be smoothly curved (concave or convex), or combinations thereof.

Referring now to FIGS. 8A-8E, an embodiment of a cutter element 500 is shown. In general, a plurality of cutter elements 500 can be used in place of cutter elements 200 on bit 100 previously described. Cutter element 500 is substantially the same as cutter element 200 previously described with the exception that the central region (e.g., central region 225) of the cutting face (e.g., cutting face 220) is smoothly curved and concave. More specifically, in this embodiment, cutter element 500 includes a base 201 and a cutting disc or layer 510 bonded to the base 201 at a plane of intersection 209. Base 201 is as previously described. Thus, base 201 has a central axis 205, a first end 201*a* bonded to cutting layer 510, a second end 201*b* distal cutting layer 510, and a radially outer surface 202 extending axially between ends 201*a*, 201*b*.

Cutting layer 510 is substantially the same as cutting layer 210 previously described except that both planar cutting regions 221, 222 slope upward and axially away from base 201 moving radially outward and the central region (e.g., central region 225) is not planar. In particular, cutting layer 510 has a first end 510*a* distal substrate 201, a second end 510*b* bonded to end 201*a* of substrate 201, and a cylindrical radially outer surface 512 extending axially between ends 510*a*, 510*b*. The outer surface of cutting layer 510 at first end 510*a* defines the cutting face 520 of cutter element 500. In this embodiment, a chamfer or bevel 511 is provided at the intersection of cutting face 520 and outer surface 512 about the entire outer periphery of cutting face 520.

Cutting face 520 is defined by a plurality of discrete regions or surfaces. More specifically, cutting face 520 includes a generally rectangular central region or surface 525, a cutting region or surface 221 extending radially from central region 525 to outer surface 512, a relief region or surface 222 extending radially from central region 525 to outer surface 512, and a pair of lateral side regions or surfaces 223*a*, 223*b* extending from regions 525, 221, 222 to outer surface 512. Regions 221, 222, 223*a*, 223*b* are circumferentially disposed about axis 205 and central region 525. In addition, regions 221, 222, 223*a*, 223*b* are positioned circumferentially adjacent each other with each region 221, 222 circumferentially disposed between regions 223*a*, 223*b* and each region 223*a*, 223*b* circumferentially disposed between regions 221, 222. The centerlines of regions 221, 222 are angularly spaced 180° apart about axis 205. Accordingly, regions 221, 222 extend radially in opposite directions from central region 525 to outer surface 512. Each region 221, 222, 223*a*, 223*b* is as previously described except that regions 221, 222 slope upward and axially away from base 201 moving radially outward from central region 525 to outer surface 512. Namely, each region 221, 222 is planar and oriented at non-zero acute angle β, θ, respectively, measured from region 221, 222, respectively, to a reference plane oriented perpendicular to central axis 205 in the lateral side view. Each angle β, θ is less than 45°, preferably ranges from 1° to 20°, and more preferably ranges from 2° to 10°. In this embodiment, angle β is 6° and angle θ is 6°. In general, angles β, θ can be the same or different. In addition, regions 223*a*, 223*b* are planar, slope axially downward toward base 201 moving radially outward from regions 525, 221, 222 to outer surface 512, and are oriented at the non-zero acute angle α measured from the lateral region 223*a*, 223*b* to a reference plane oriented perpendicular to central axis 205 in the front side view and the rear side view as previously described. However, unlike central region 225 of cutting face 220 of cutter element 200 previously described, in this embodiment, central region 525 is smoothly curved and concave. Thus, central region 525 curves axially upward and away from base 201 moving radially from axis 205 to cutting region 221 and curves axially upward and away from base 201 moving radially from axis 205 to relief region 222. As a result of the slope of regions 221, 222 and the concave geometry of central region 525, and described in more detail below, an elongate ridge 527 defined by regions 221, 525, 222 is generally concave in lateral side view (FIG. 8D), and the lateral side regions 223*a*, 223*b* intersect cutting central region 525 along non-linear edges 526*b*, 526*d*, respectively. In this embodiment, a plane tangent to central region 525 at the intersection of axis 205 and region 525 is oriented perpendicular to axis 205. Central region 525 smoothly transitions and blends into regions 221, 222.

In this embodiment, central region 525 is a cylindrical surface disposed at a radius of curvature. As best shown in FIG. 8D, region 525 is a cylindrical surface disposed at a radius $R_{525}$ relative to an axis oriented perpendicular to a reference plane 528 that contains central axis 205, is disposed between lateral regions 223*a*, 223*b*, and bisects crown 527 and regions 221, 222. Radius $R_{525}$ ranges from 1.0 to 50.0 mm, and more preferably ranges from 5.0 to 20.0 mm. In this embodiment, radius $R_{525}$ is 27 mm.

As previously described, lateral regions 223*a*, 223*b* slope axially downward toward substrate 201 moving from regions 221, 525, 222 to outer surface 512. As a result, regions 221, 525, 222 define an elongate, generally raised ridge or crown 527 extending linearly completely across cutting face 520. Thus, ridge 527 may be described as having a first end at outer surface 512 at one side of cutter element 500 and a second end at outer surface 512 at the radially opposite side of cutter element 500. Ridge 527 (or at least a portion thereof) defines the maximum height of cutter element 500 measured axially from end 201*b* to cutting face 520 at end 510*a*.

Due to the geometry of regions 223*a*, 223*b*, 525, 221, 222, crown 527 is generally convex in front side view (FIG. 8C) but generally concave in lateral side view (FIG. 8D). In addition, due to the geometry of regions 525, 223*a*, 223*b*, region 525 intersects regions 223*a*, 223*b* along non-linear edges 526*b*, 526*d*, while regions 221, 222 intersect lateral regions 223*a*, 223*b* along linear edges 224*a*, 224*b*, 224*c*, 224*d*. Planar regions 221, 222 smoothly transition into concave central region 525, and thus, there is not a distinct edge between regions 221, 525 or regions 222, 525 in this embodiment. However, for purposes of clarity, the transitions from central region 525 into planar regions 221, 222 are identified with dashed lines 526*a*, 526*c*, respectively. Since dashed lines 526*a*, 526*c* define the locations at which the slope of crown 527 changes moving from concave central region 525 into planar regions 221, 222, lines 526*a*, 526*c* may also be referred to as transition lines. For purposes of clarity, the length $L_{525}$ of central region 225 of crown 527 is measured parallel to plane 528 from line 526*a* to line 526*b*.

Figure 8A:
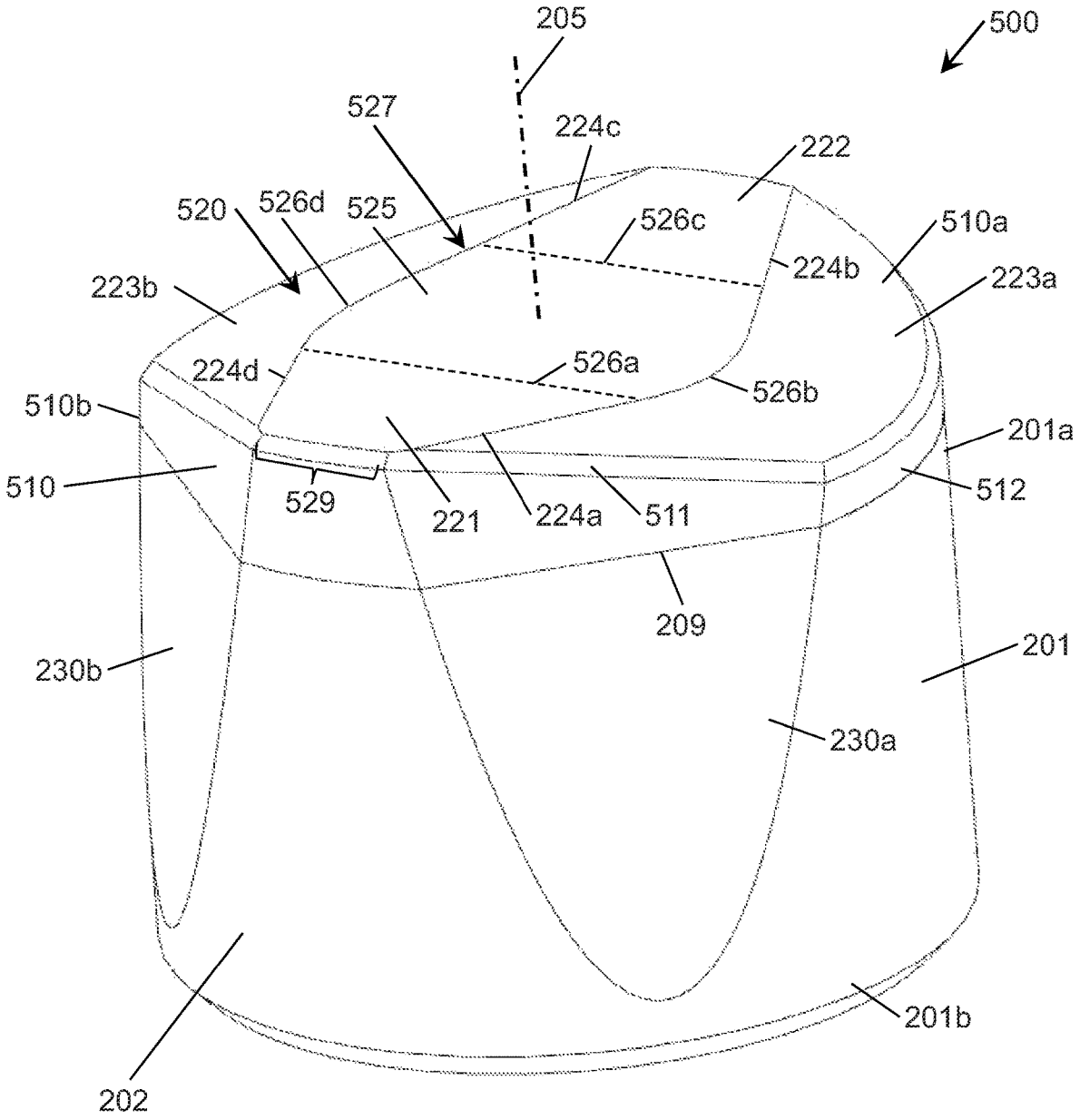
FIGS. 8A-8E are perspective, top, front side, lateral side, and rear side views, respectively, of an embodiment of a cutter element in accordance with the principles described herein.
Figure 8B:
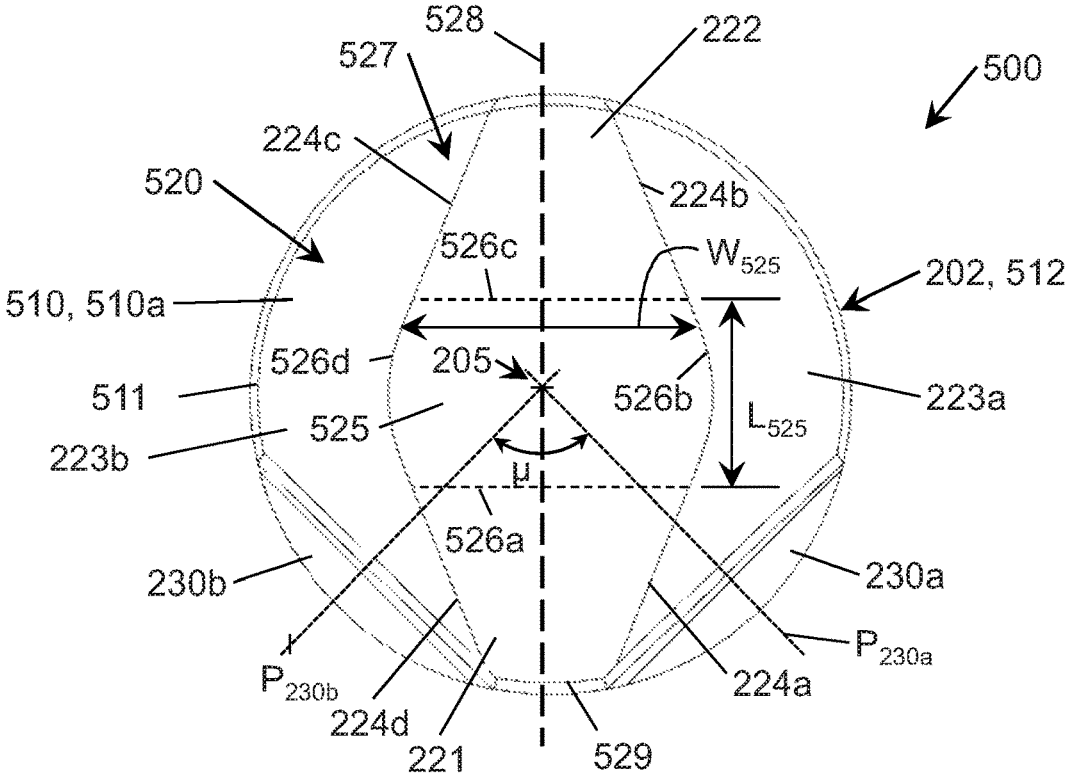
Figure 8C:
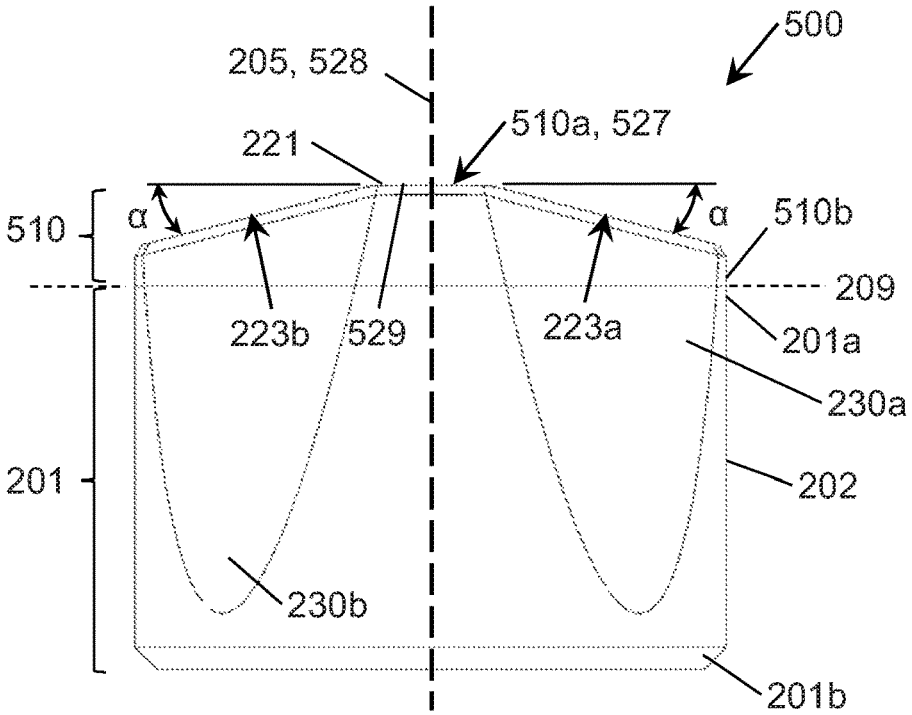
Figure 8D:
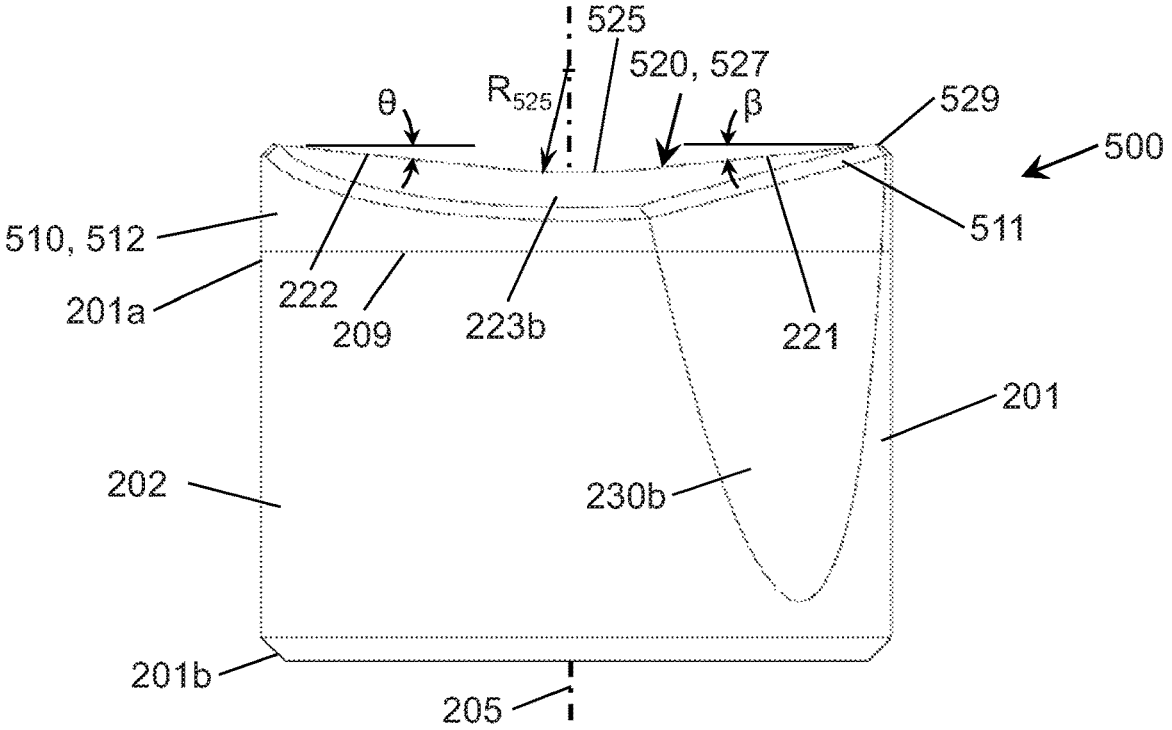
Figure 8E:
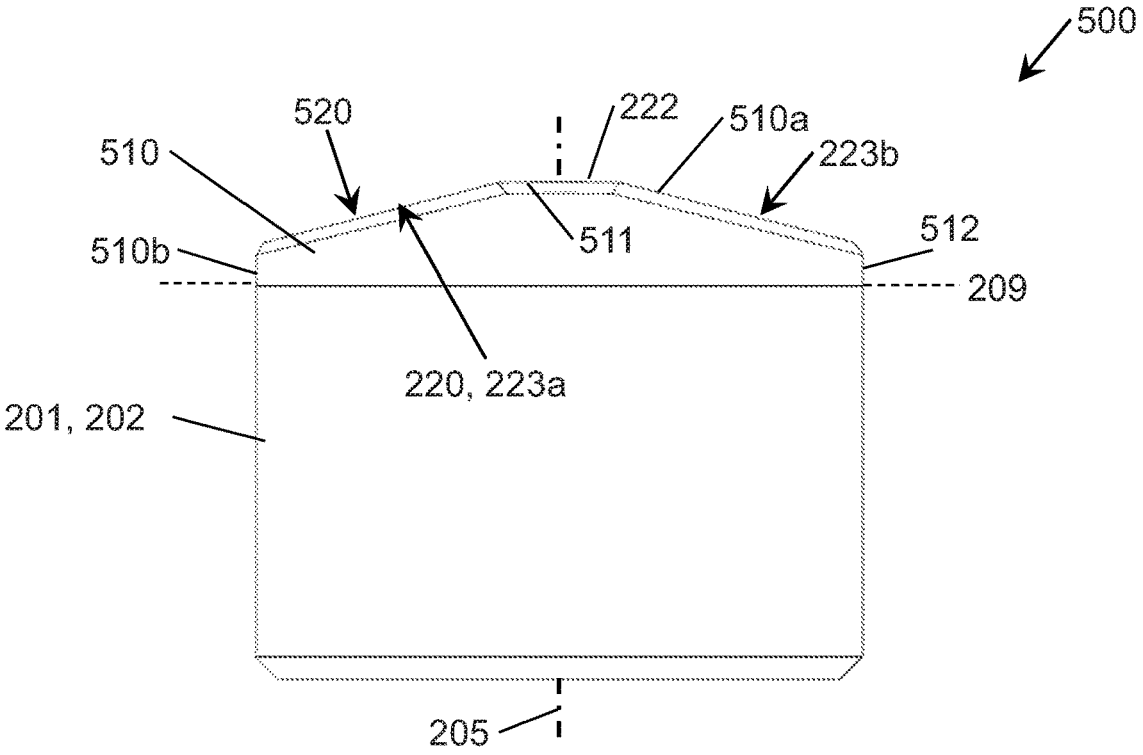
Figure 9A:
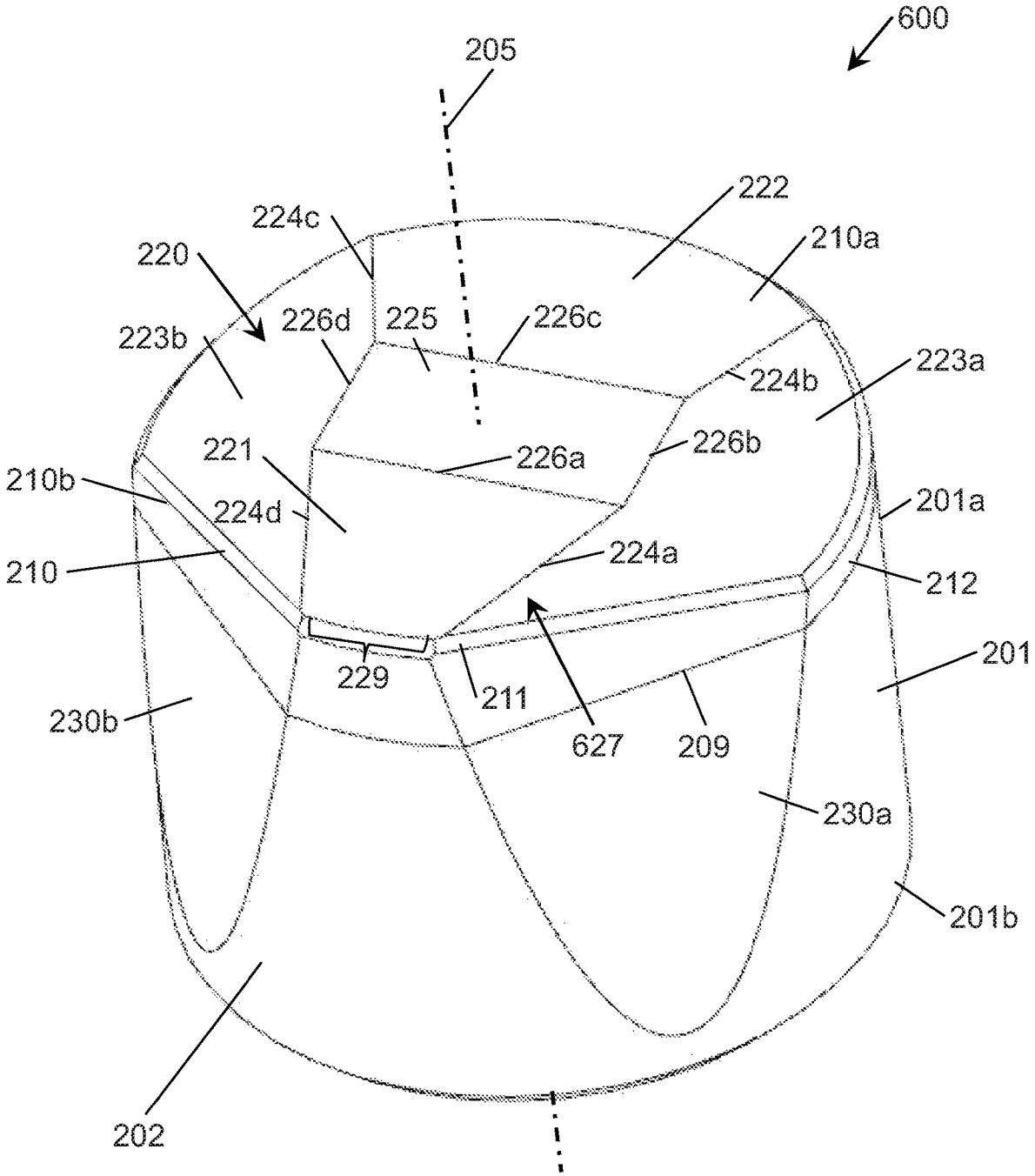
FIGS. 9A-9E are perspective, top, front side, lateral side, and rear side views, respectively, of an embodiment of a cutter element in accordance with the principles described herein.
Figure 9B:
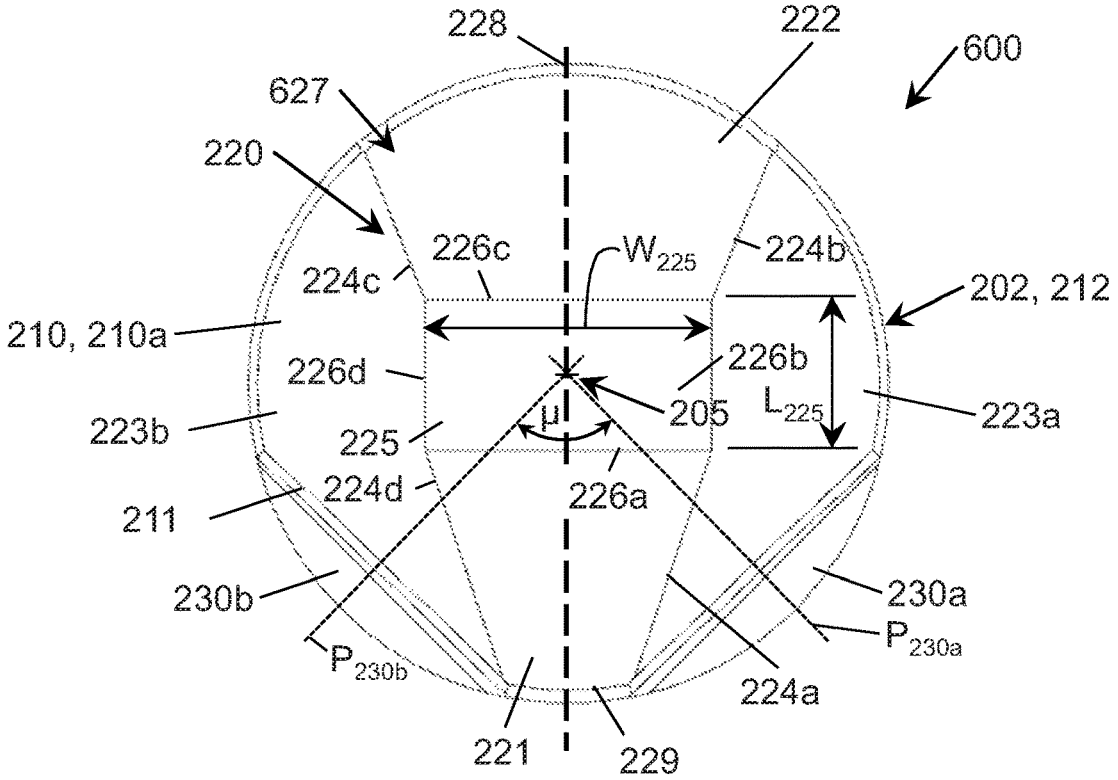
Figure 9C:
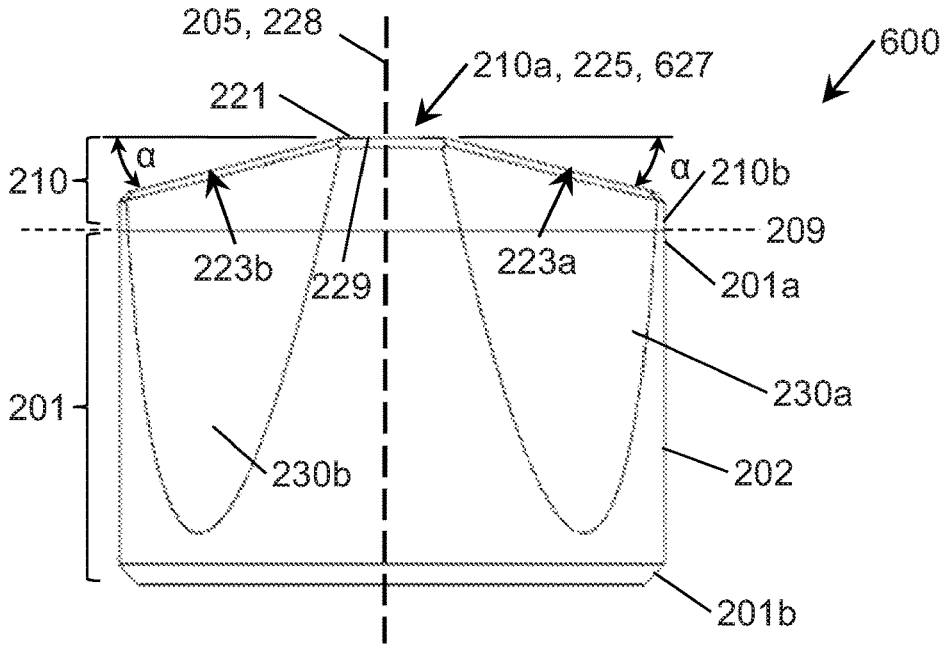
Figure 9D:
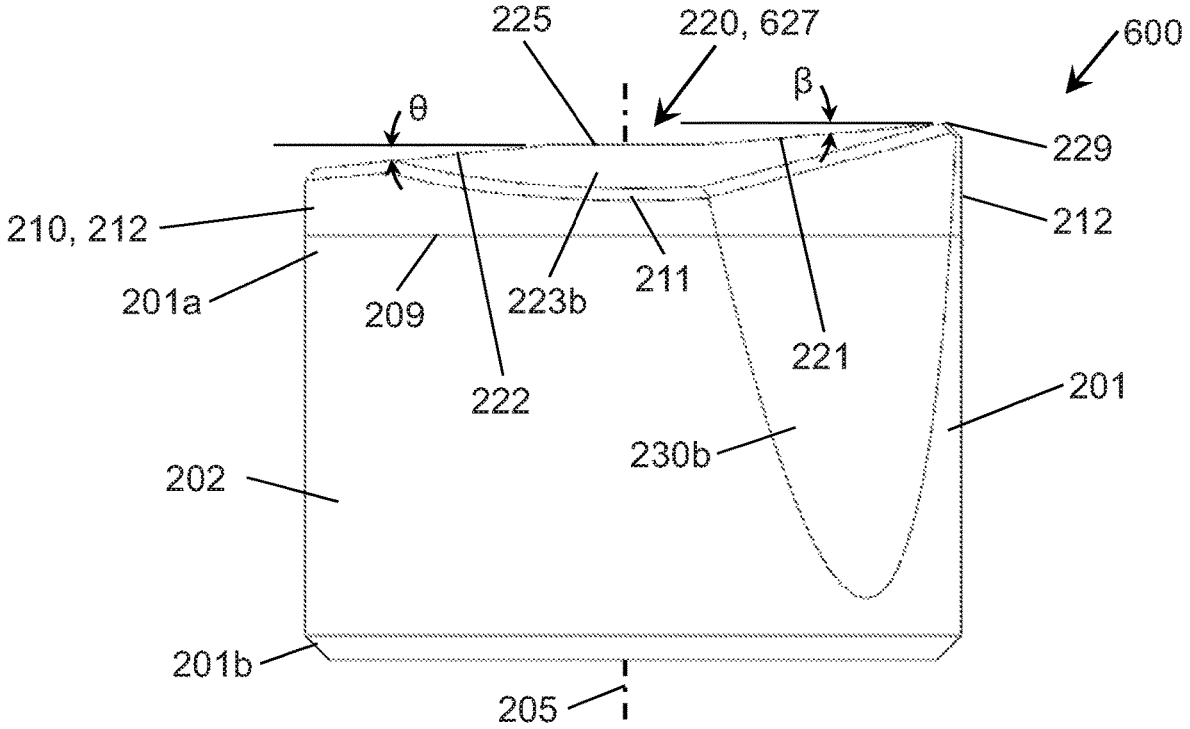
Figure 9E:
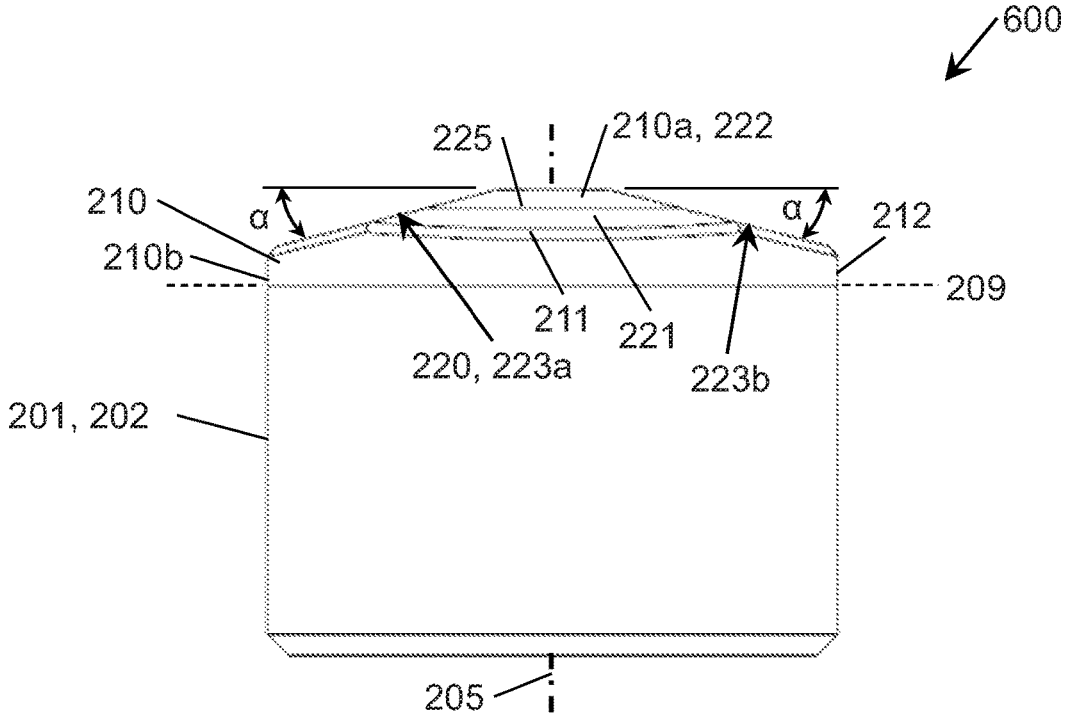
Figure 10A:
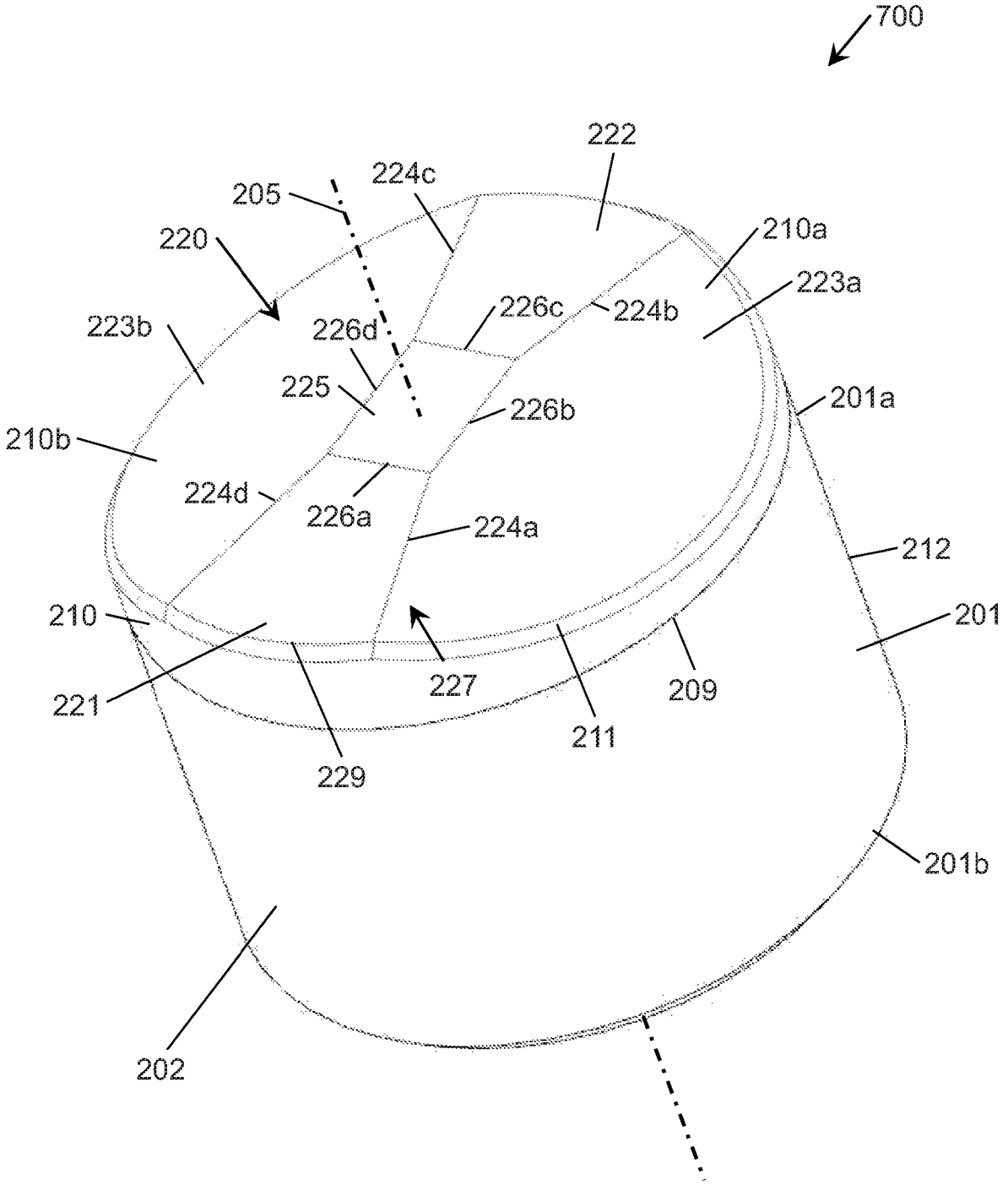
FIGS. 10A-10D are perspective, top, front side, and lateral side views, respectively, of an embodiment of a cutter element in accordance with the principles described herein.
Figure 10B:
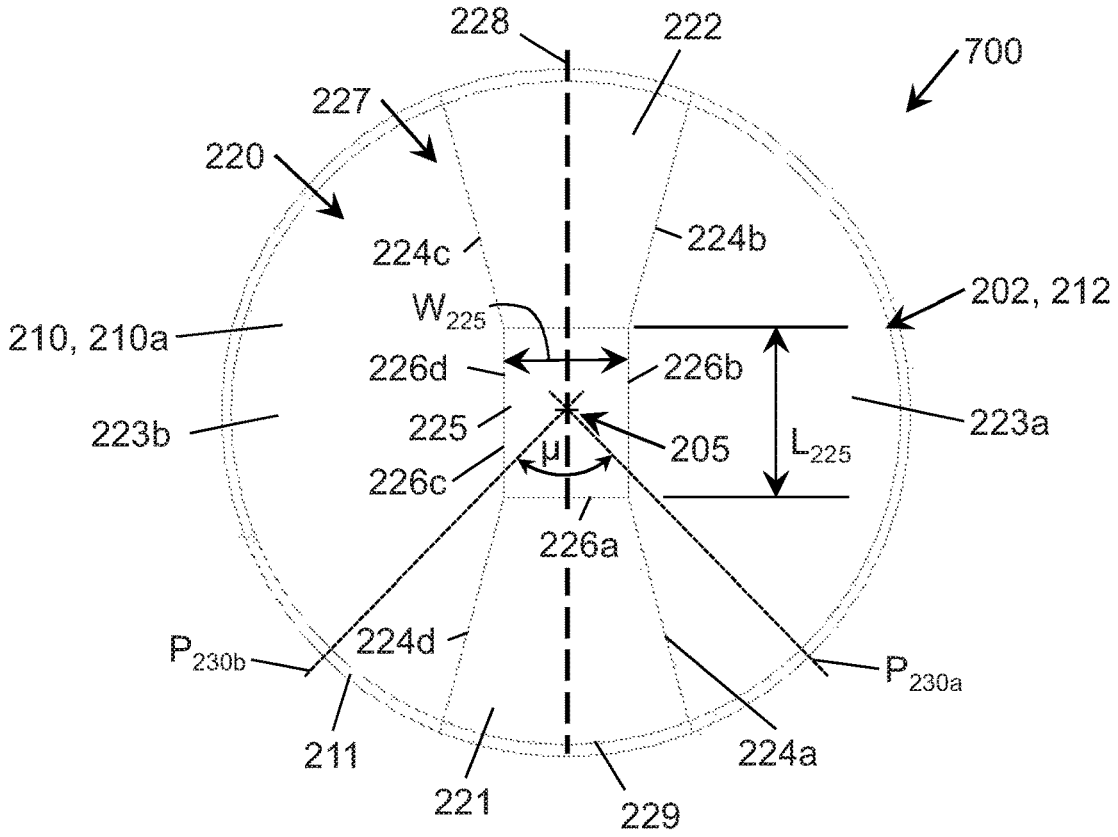
Figure 10C:
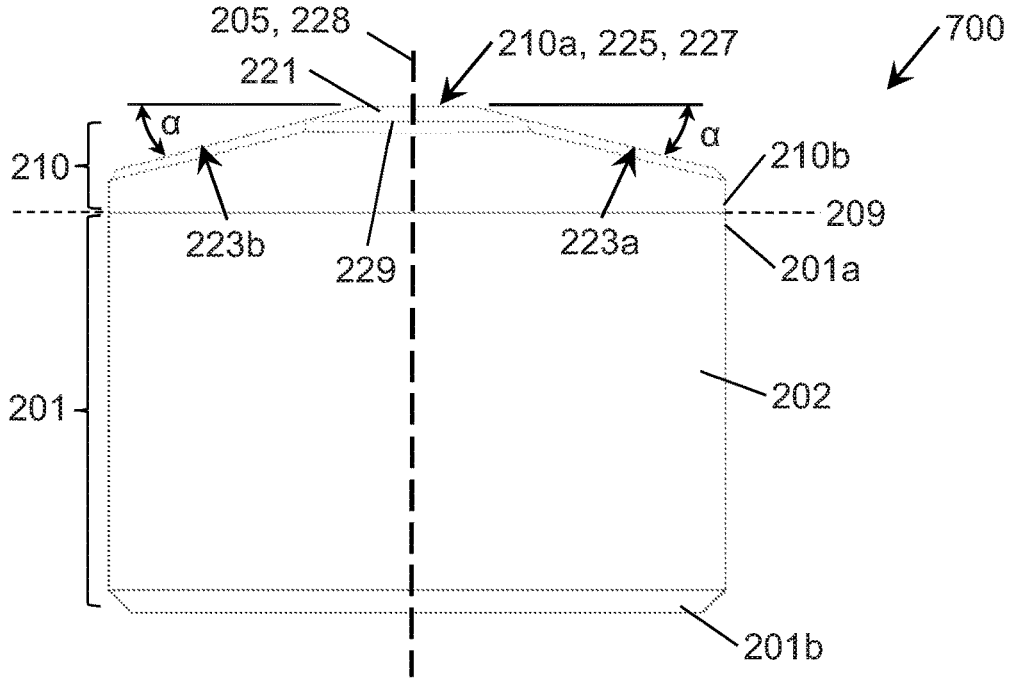
Figure 10D:
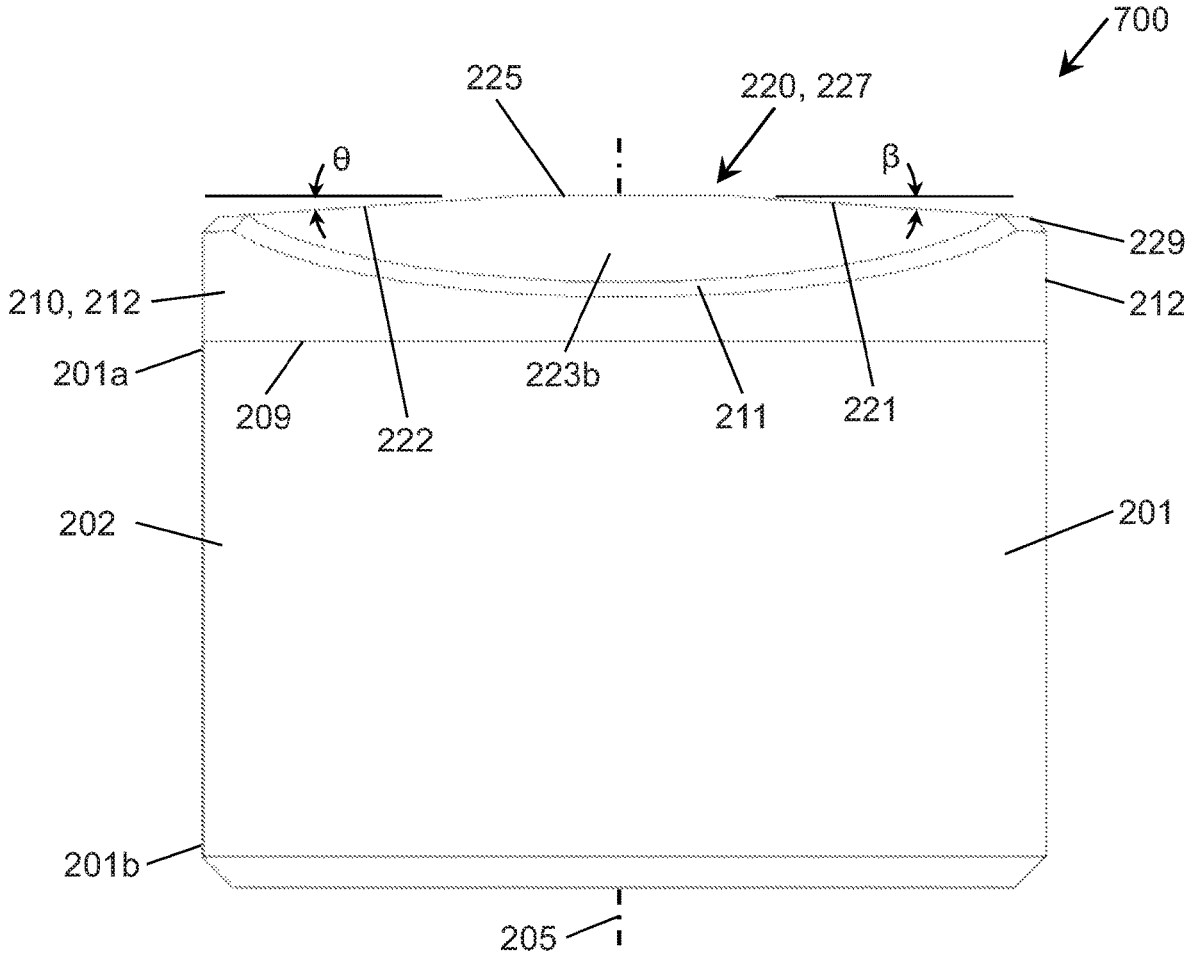

As best shown in the top view of cutter element 500 in FIG. 8B (looking at cutting face 520 as viewed parallel to central axis 205), in this embodiment, linear edges 224*a*, 224*d* generally slope toward each other moving radially along cutting region 221 from central region 525 to outer surface 512, and linear edges 224*b*, 224*c* generally move toward each other moving radially along relief region 222 from central region 525 to outer surface 512. As a result, and unlike cutter element 200 previously described, cutting region 221 has a width measured perpendicular to a reference plane 528 containing central axis 205 in top view that decreases moving radially from central region 525 to outer surface 512, and similarly, relief region 222 has a width measured perpendicular to reference plane 528 in top view that decreases moving radially from central region 525 to outer surface 512.

As best shown in FIG. 8B, central region 525 has a length $L_{525}$ measured parallel to plane 528 from transition line 526*a* to transition line 526*c* in top view, and a width $W_{525}$ measured perpendicular to plane 528 from edge 526*b* to edge 526*d* in top view. As previously described, the geometry of the central region of the cutting face (e.g., central region 525 of cutting face 520) can be characterized by the ratio of the length of the central region (e.g., length $L_{525}$) to the diameter of the corresponding cutter element and the aspect ratio of the central region (e.g., the ratio of the length $L_{525}$ to the width $W_{525}$). Thus, in this embodiment, the geometry of central region 525 may be characterized by the ratio of the length $L_{525}$ to the diameter of cutter element 500 and the aspect ratio equal to the ratio of the length $L_{525}$ to the width $W_{525}$. Similar to embodiments of central region 225 previously described, in this embodiment, the ratio of the length $L_{525}$ to the diameter of cutter element 500 is less than 1.0, preferably between 0.10 and 0.90, more preferably between 0.20 and 0.80, and even more preferably between 0.25 and 0.75, and still even more preferably between 0.33 and 0.66; and the aspect ratio of central region 525 is preferably less than 50.0, more preferably between 0.10 and 30.0, more preferably between 0.50 and 30.0, even more preferably between 1.0 and 10.0, and still even more preferably between 1.0 and 5.0. In some embodiments, the aspect ratio of the central region (e.g., central region 525) is between 0.25 and 10.0.

It should be appreciated that unlike previous embodiments in which the central region is rectangular (e.g., central region 225) with the length being measured between parallel linear edges (e.g., between parallel linear edges 226*a*, 226*c*) and the width being measured between parallel linear edges (e.g., between parallel linear edges 226*b*, 226*d*), in this embodiment, the length $L_{525}$ is measured between parallel linear edges 526*a*, 526*c* but the width $W_{525}$ is measured between non-parallel, non-linear transition lines 526*b*, 526*d*. Consequently, the length $L_{525}$ is constant at all points along edges 526*a*, 526*c*, whereas the width $W_{525}$ varies depending on where it is measured along edges 526*b*, 526*d*. For purposes of clarity, in embodiments where the length of the central region (e.g., the length $L_{525}$) and/or the width of the central region (e.g., the width $W_{525}$) varies depending on where it is measured, the maximum length of the central region and the maximum width of the central region are used to determine the ratio of the length of the central region to the diameter of the corresponding cutter element and the aspect ratio.

Referring still to FIGS. 8A-8E, a pair of planar surfaces or flats 230*a*, 230*b* extend across radially outer surfaces 202, 512 of substrate 201 and cutting layer 510, respectively. Flats 230*a*, 230*b* are as previously described. For example, flats 230*a*, 230*b* are circumferentially spaced along outer surfaces 202, 512, and generally positioned on opposite circumferential sides of cutting region 221. Flat 230*a* circumferentially spans a portion of cutting region 221 and lateral facet 223*a* along outer surface 512 and flat 230*b* circumferentially spans a portion of cutting region 221 and lateral facet 223*b* along outer surface 512. In addition, in this embodiment, each flat 230*a*, 230*b* is oriented perpendicular to a plane $P_{230a}$, $P_{230b}$, respectively, containing the central axis 205. Planes $P_{230a}$, $P_{230b}$ are angularly spaced apart about axis 205 by an angle $\mu$ that is less than 180°, preferably 70° to 120°, and more preferably 80° to 100°. In this embodiment, angle $\mu$ is 90°. Further, each flat 230*a*, 230*b* generally slopes radially outward moving axially from its end at cutting face 420 to its end along substrate 201. More specifically, in this embodiment, each flat 230*a*, 230*b* is oriented at an acute angle $\sigma$ measured in plane $P_{230a}$ between central axis 205 and flat 230*a*. Angle $\sigma$ is preferably 2° to 10°, and more preferably 6° to 8°. In this embodiment, angle $\sigma$ is 7°.

As best shown in the top view of cutter element 500 in FIG. 8B (looking at cutting face 520 as viewed parallel to central axis 205), in this embodiment, cutting face 520 is symmetric about the reference plane 528 that contains central axis 205, is disposed between lateral regions 223*a*, 223*b*, and bisects crown 527 and regions 221, 222. A cutting edge 529 is defined at the intersection of cutting region 221 and chamfer 511 between flats 230*a*, 230*b*.

A plurality of cutting elements 500 are mounted in bit body 110 in the same manner and orientation as cutter elements 200 previously described. More specifically, each cutter element 500 is mounted to a corresponding blade 141, 142 with substrate 201 received and secured in a pocket formed in the cutter support surface 144 of the blade 141, 142 to which it is fixed by brazing or other suitable means. In addition, each cutter element 500 is oriented with axis 205 oriented generally parallel or tangent to cutting direction 106 and such that the corresponding cutting face 520 is exposed and leads the cutter element 500 relative to cutting direction 106 of bit 100. Further, cutter elements 500 are oriented with corresponding planes 528 oriented perpendicular to the cutter support surface 144, cutting region 221 distal the corresponding cutter support surface 144 (with cutting edge 529 defining the extension height of the cutter element 500), and relief region 221 proximal the corresponding cutter support surface 144. During drilling operations, cutting faces 520 of cutter elements 500 engage, penetrate, and shear the formation in the same manner as cutting faces 220 of cutter elements 200 previously described.

In the embodiment of cutter element 200 described above and shown in FIGS. 5A-5F, both planar regions 221, 222 slope downward and axially toward base 201 moving radially from central region 225 to outer surface 212, and the widths of regions 221, 222 increase moving radially from central region 225 to outer surface 212 in top view (FIG. 5B); and in the embodiment of cutter element 500 described above and shown in FIGS. 8A-8E, both planar regions 221, 222 slope upward and axially away from base 201 moving radially from central region 525 to outer surface 512, and the widths of regions 221, 222 decrease moving radially from central region 525 to outer surface 512 in top view (FIG. 8B). However, in other embodiments, the planar cutting region (e.g., cutting region 221) and the planar relief region (e.g., relief region 222) may slope in opposite directions, and further, the cutting region and the relief region may have widths that increase and decrease, respectively, or vice versa.

Referring now to FIGS. 9A-9E, an embodiment of a cutter element 600 is shown. In general, a plurality of cutter elements 600 can be used in place of cutter elements 200 on bit 100 previously described. Cutter element 600 is the same as cutter element 200 previously described with the exception that cutting region 221 and relief region 222 slope in opposite directions, and the width of cutting region 221 measured perpendicular to reference plane 228 in top view (FIG. 9B) decreases moving radially from central region 225 to outer surface 212.

In this embodiment, planar cutting region 221 slopes upward and axially away from base 201 moving radially outward from central region 225 to outer surface 212 while planar relief region 222 slopes downward and axially toward base 201 moving radially outward from central region 225 to outer surface 212. As a result, cutter element 600 has a raise ridge or crown 627 including a portion defined by regions 221, 225 that is generally convex in lateral side view (FIG. 8D) and another portion defined by regions 222, 225 that is generally concave in lateral side view. Ridge 627 extends linearly completely across cutting face 220. Thus, ridge 627 may be described as having a first end at outer surface 212 at one side of cutter element 600 and a second end at outer surface 212 at the radially opposite side of cutter element 600. Ridge 627 (or at least a portion thereof) defines the maximum height of cutter element 600 measured axially from end 201*b* to cutting face 220 at end 210*a*.

Each region 221, 222 is oriented at non-zero acute angle β, θ, respectively, measured from region 221, 222, respectively, to a reference plane oriented perpendicular to central axis 205 in the lateral side view (FIG. 8D). Each angle β, θ is less than 45°, preferably ranges from 1° to 20°, and more preferably ranges from 2° to 10°. In this embodiment, angle β is 5° and angle θ is 5°. Otherwise, cutter element 600 is the same as cutter element 200 previously described.

Central region 225 is as previously described, and thus, the ratio of the length $L_{225}$ of central region 225 to the diameter of cutter element 600 is less than 1.0, preferably between 0.10 and 0.90, more preferably between 0.20 and 0.80, and even more preferably between 0.25 and 0.75, and still even more preferably between 0.33 and 0.66; and the aspect ratio of central region 225 is preferably less than 50.0, more preferably between 0.10 and 30.0, more preferably between 0.50 and 30.0, even more preferably between 1.0 and 10.0, and still even more preferably between 1.0 and 5.0. In some embodiments, the aspect ratio of the central region (e.g., central region 525) is between 0.25 and 10.0. The length $L_{225}$ and width $W_{225}$ of central region 225 of cutter element 600 are determined in the same manner as previously described with respect to cutter element 200.

A plurality of cutting elements 600 are mounted in bit body 110 in the same manner and orientation as cutter elements 200 previously described. More specifically, each cutter element 600 is mounted to a corresponding blade 141, 142 with substrate 201 received and secured in a pocket formed in the cutter support surface 144 of the blade 141, 142 to which it is fixed by brazing or other suitable means. In addition, each cutter element 600 is oriented with axis 205 oriented generally parallel or tangent to cutting direction 106 and such that the corresponding cutting face 220 is exposed and leads the cutter element 600 relative to cutting direction 106 of bit 100. Further, cutter elements 600 are oriented with corresponding planes 228 oriented perpendicular to the cutter support surface 144, cutting region 221 distal the corresponding cutter support surface 144 (with cutting edge 229 defining the extension height of the cutter element 600), and relief region 221 proximal the corresponding cutter support surface 144. During drilling operations, cutting faces 220 of cutter elements 600 engage, penetrate, and shear the formation in the same manner as cutting faces 220 of cutter elements 200 previously described.

In the embodiments of cutter elements 200, 400, 500, 600 described above, a pair of planar surfaces or flats 230*a*, 230*b* extend across the radially outer surface 202 of substrate 201 and the radially outer surface 212, 412, 512 of the corresponding cutting layer 210, 410, 510. In addition, in the embodiment of cutter element 300 described above, two pair of planar surfaces or flats 230*a*, 230*b*, 230*a*', 230*b*' extend across the radially outer surfaces 202, 212 of substrate 201 and cutting layer 212, respectively. In general, embodiments of cutter elements described herein can include two or four flats (e.g., flats 230*a*, 230*b*, 230*a*', 230*b*'). Still further, in some embodiments, no flats are provided.

Referring now to FIGS. 10A-10D, an embodiment of a cutter element 700 is shown. In general, a plurality of cutter elements 700 can be used in place of cutter elements 200 on bit 100 previously described. Cutter element 700 is the same as cutter element 200 previously described with the exception that flats 230*a*, 230*b* have been eliminated. In other words, in this embodiment, no planar flats are provided. Otherwise, cutter element 700 is the same as cutter element 200 previously described.

A plurality of cutting elements 700 are mounted in bit body 110 in the same manner and orientation as cutter elements 200 previously described. More specifically, each cutter element 700 is mounted to a corresponding blade 141, 142 with substrate 201 received and secured in a pocket formed in the cutter support surface 144 of the blade 141, 142 to which it is fixed by brazing or other suitable means. In addition, each cutter element 700 is oriented with axis 205 oriented generally parallel or tangent to cutting direction 106 and such that the corresponding cutting face 220 is exposed and leads the cutter element 700 relative to cutting direction 106 of bit 100. Further, cutter elements 700 are oriented with corresponding planes 228 oriented perpendicular to the cutter support surface 144, cutting region 221 distal the corresponding cutter support surface 144 (with cutting edge 229 defining the extension height of the cutter element 600), and relief region 221 proximal the corresponding cutter support surface 144. During drilling operations, cutting faces 220 of cutter elements 700 engage, penetrate, and shear the formation in the same manner as cutting faces 220 of cutter elements 200 previously described.

Referring now to FIGS. 11A-11D, an embodiment of a cutter element 800 is shown. In general, a plurality of cutter elements 800 can be used in place of cutter elements 200 on bit 100 previously described. Cutter element 800 is substantially the same as cutter element 500 previously described with the exception that the central region (e.g., central region 525) of the cutting face (e.g., cutting face 520) is planar and flats 230*a*, 230*b* have been eliminated. More specifically, in this embodiment, cutter element 800 includes a base 201 and a cutting disc or layer 810 bonded to the base 201 at a plane of intersection 209. Base 201 is as previously described with the sole exception that no flats (e.g., flats 230*a*, 230*b*) are provided. Thus, base 201 has a central axis 205, a first end 201*a* bonded to cutting layer 810, a second end 201*b* distal cutting layer 810, and a radially outer surface 202 extending axially between ends 201*a*, 201*b*. As no flats are provided, outer surface 202 is a cylindrical surface extending about the entire circumference of base 201.

Cutting layer 810 is substantially the same as cutting layer 510 previously described. In particular, cutting layer 810 has a first end 810*a* distal substrate 201, a second end 810*b* bonded to end 201*a* of substrate 201, and a cylindrical radially outer surface 812 extending axially between ends 810*a*, 810*b*. The outer surface of cutting layer 810 at first end 810*a* defines the cutting face 820 of cutter element 800. In this embodiment, a chamfer or bevel 811 is provided at the intersection of cutting face 820 and outer surface 812 about the entire outer periphery of cutting face 820.

Cutting face 820 is defined by a plurality of discrete regions or surfaces. More specifically, cutting face 820 includes a generally rectangular central region or surface 825, a cutting region or surface 221 extending radially from central region 825 to outer surface 812, a relief region or surface 222 extending radially from central region 825 to outer surface 812, and a pair of lateral side regions or surfaces 223*a*, 223*b* extending from regions 825, 221, 222 to outer surface 812. Each region 223*a*, 223*b* is as previously described, and each region 221, 222 is as previously with respect to cutter element 500. In particular, regions 221, 222, 223*a*, 223*b* are circumferentially disposed about axis 205 and central region 825. In addition, regions 221, 222, 223*a*, 223*b* are positioned circumferentially adjacent each other with each region 221, 222 circumferentially disposed between regions 223*a*, 223*b* and each region 223*a*, 223*b* circumferentially disposed between regions 221, 222. The centerlines of regions 221, 222 are angularly spaced 180° apart about axis 205. Accordingly, regions 221, 222 extend radially in opposite directions from central region 825 to outer surface 812. Regions 221, 222 slope upward and axially away from base 201 moving radially outward from central region 825 to outer surface 812. In addition, each region 221, 222 is planar and oriented at non-zero acute angle β, θ, respectively, measured from region 221, 222, respectively, to a reference plane oriented perpendicular to central axis 205 in the lateral side view. As previously described, each angle β, θ is less than 45°, preferably ranges from 1° to 20°, and more preferably ranges from 2° to 10°. Regions 223*a*, 223*b* are planar, slope axially downward toward base 201 moving radially outward from regions 825, 221, 222 to outer surface 812, and are oriented at the non-zero acute angle α measured from the lateral region 223*a*, 223*b* to a reference plane oriented perpendicular to central axis 205 in the front side view and the rear side view.

Unlike central region 525 of cutting face 520 of cutter element 500 previously described, in this embodiment, central region 825 is planar, and more specifically, is disposed in a plane oriented perpendicular to axis 205. As a result of the slope of regions 221, 222 and the planar geometry of central region 825, and described in more detail below, an elongate ridge 827 defined by regions 221, 825, 222 is generally concave in lateral side view (FIG. 11D).

As previously described, lateral regions 223*a*, 223*b* slope axially downward toward substrate 201 moving from regions 221, 825, 222 to outer surface 812. As a result, regions 221, 825, 222 define an elongate, generally raised ridge or crown 827 extending linearly completely across cutting face 820. Thus, ridge 827 may be described as having a first end at outer surface 812 at one side of cutter element 800 and a second end at outer surface 812 at the radially opposite side of cutter element 800. Ridge 827 (or at least a portion thereof) defines the maximum height of cutter element 800 measured axially from end 201*b* to cutting face 820 at end 810*a*.

Figure 11A:
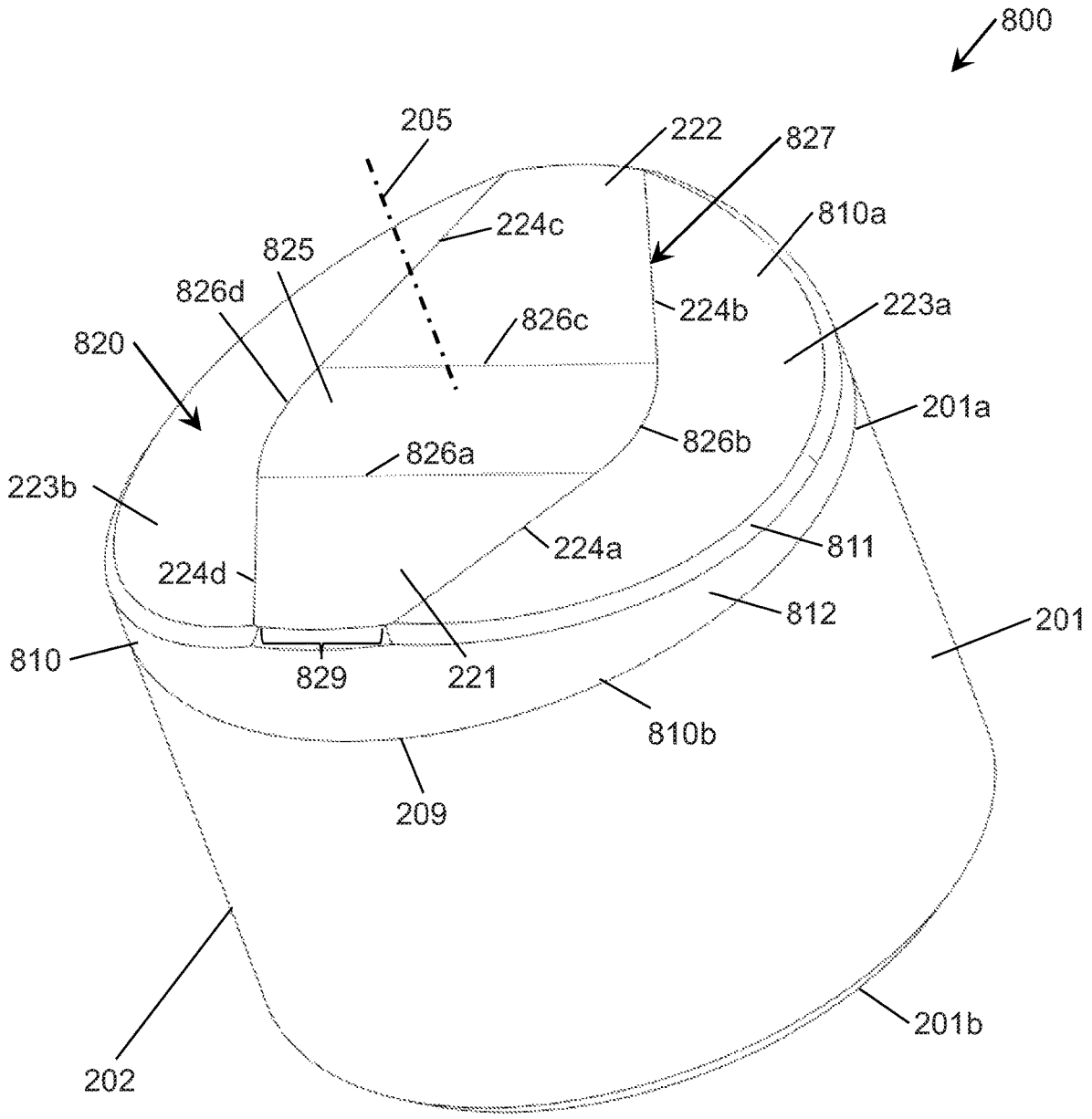
FIGS. 11A-11D are perspective, top, front side, and lateral side views, respectively, of an embodiment of a cutter element in accordance with the principles described herein.
Figure 11B:
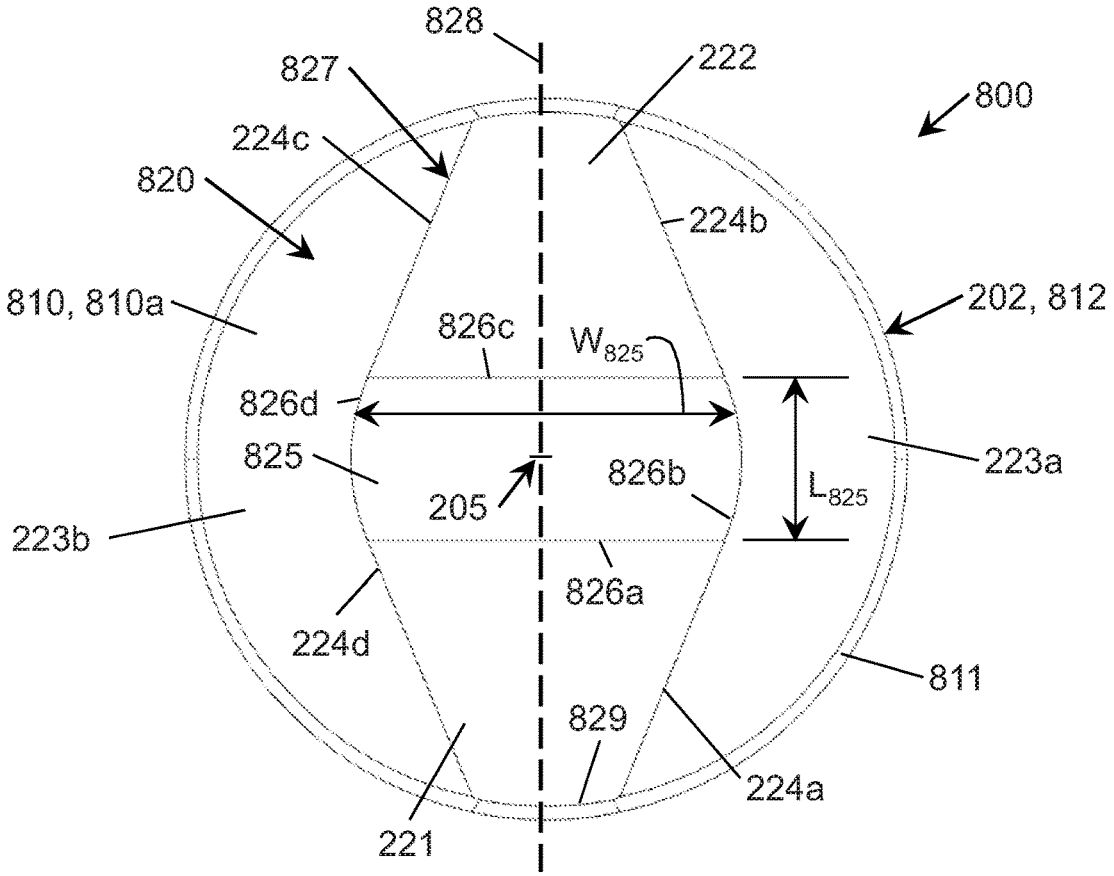
Figure 11C:
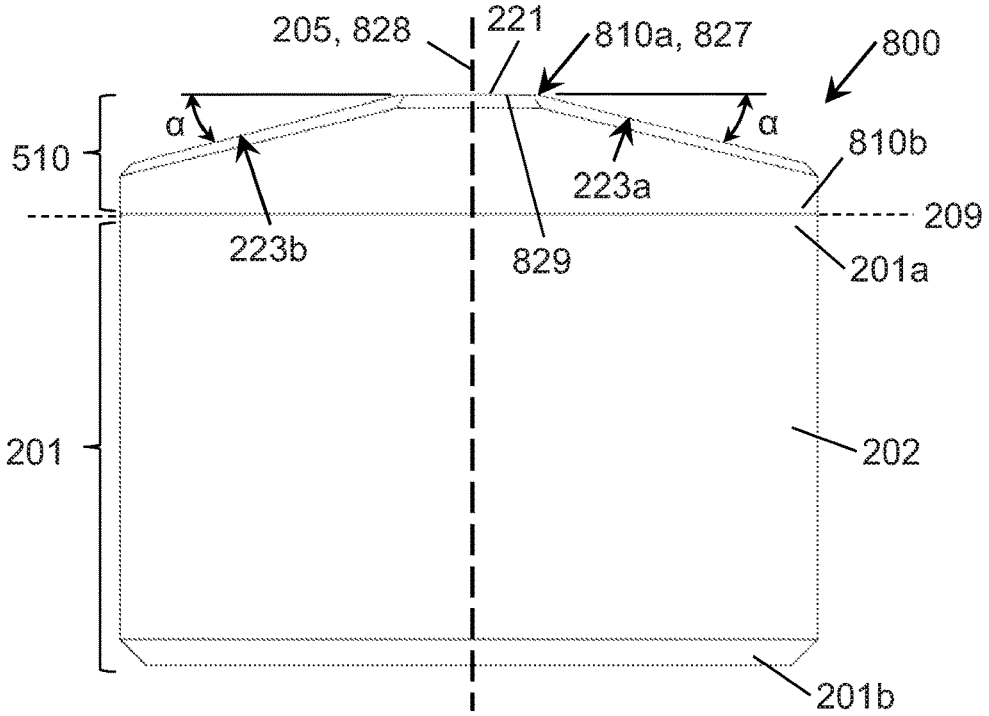
Figure 11D:
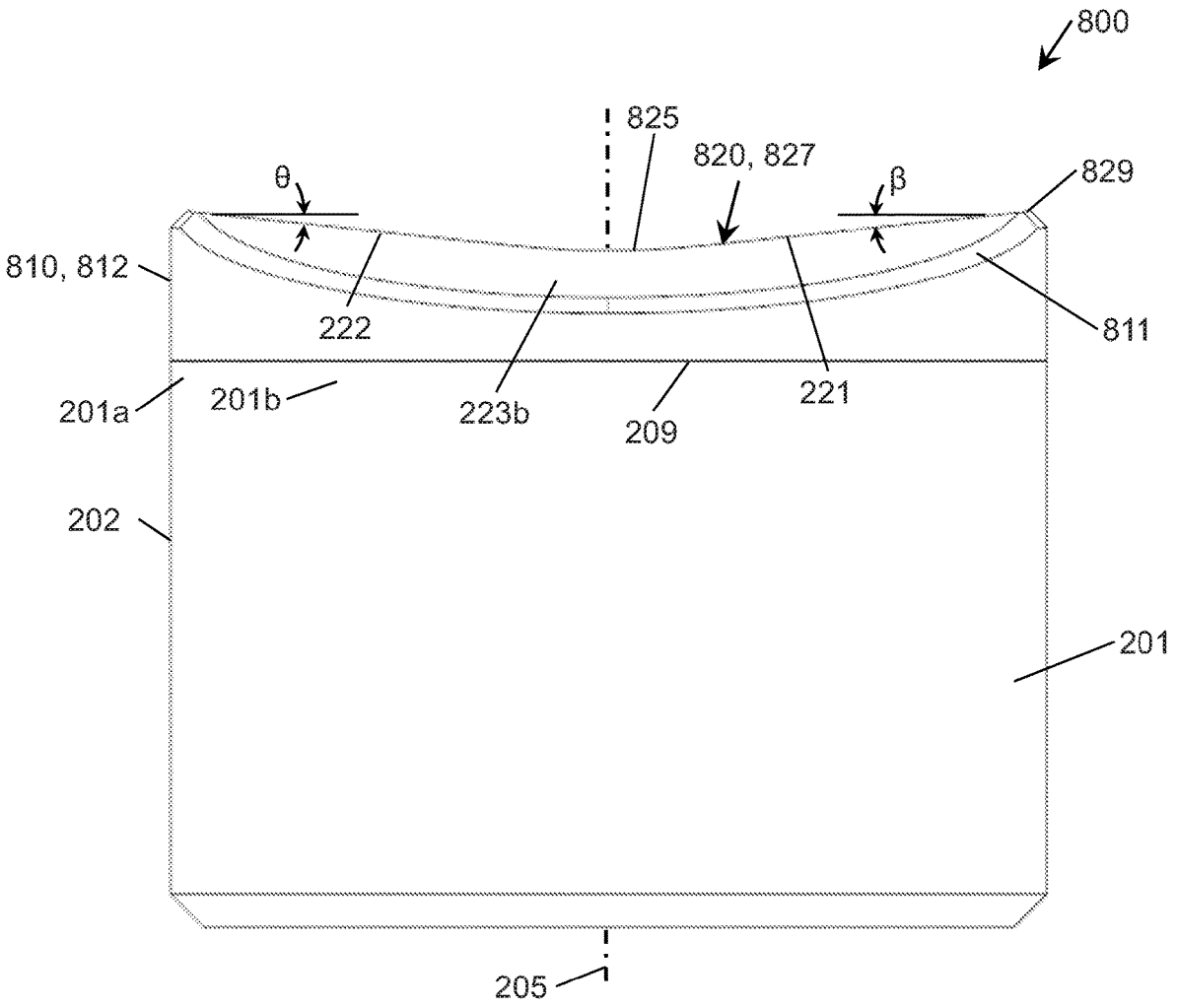
Figure 12A:
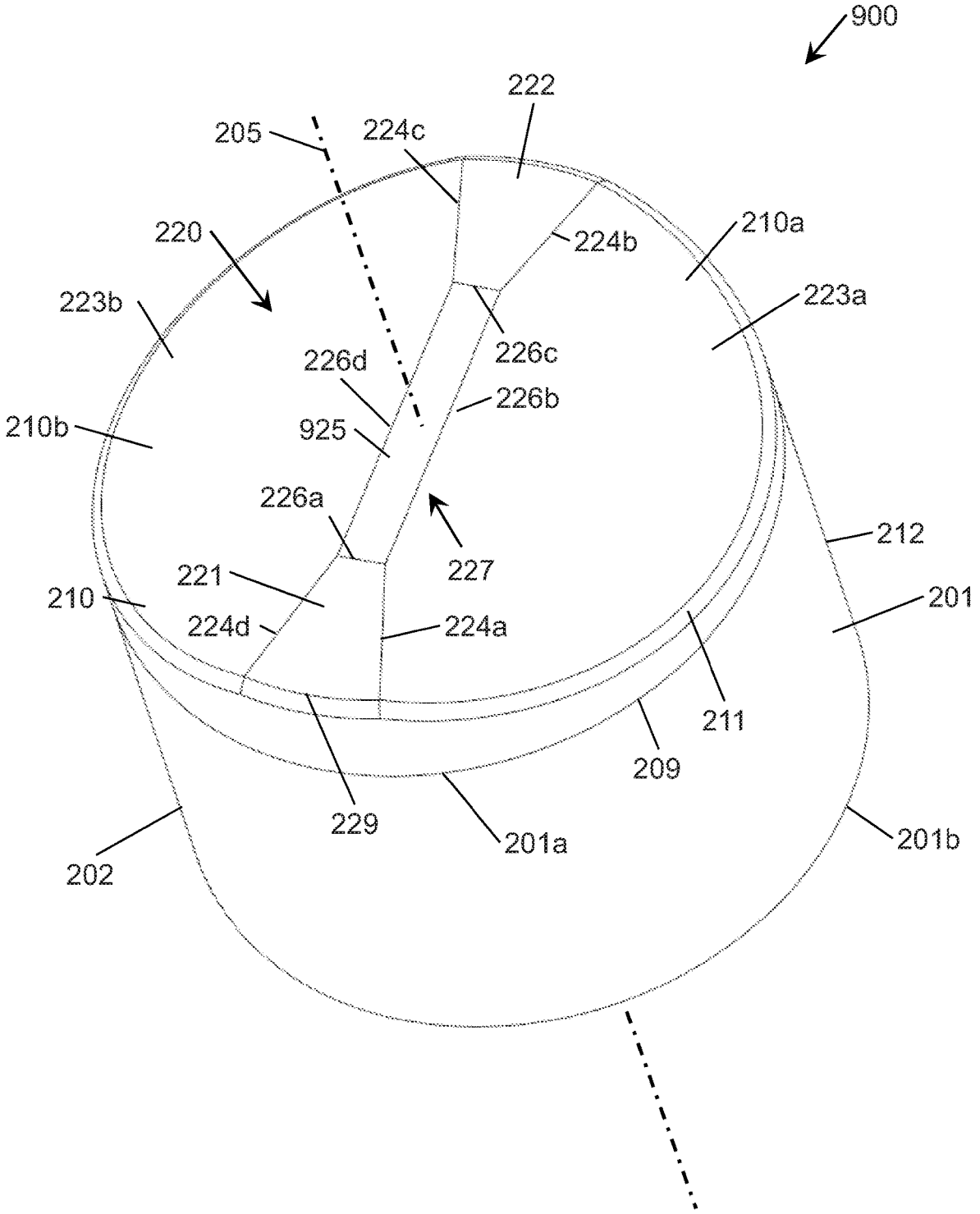
FIGS. 12A-12D are perspective, top, front side, and lateral side views, respectively, of an embodiment of a cutter element in accordance with the principles described herein.
Figure 12B:
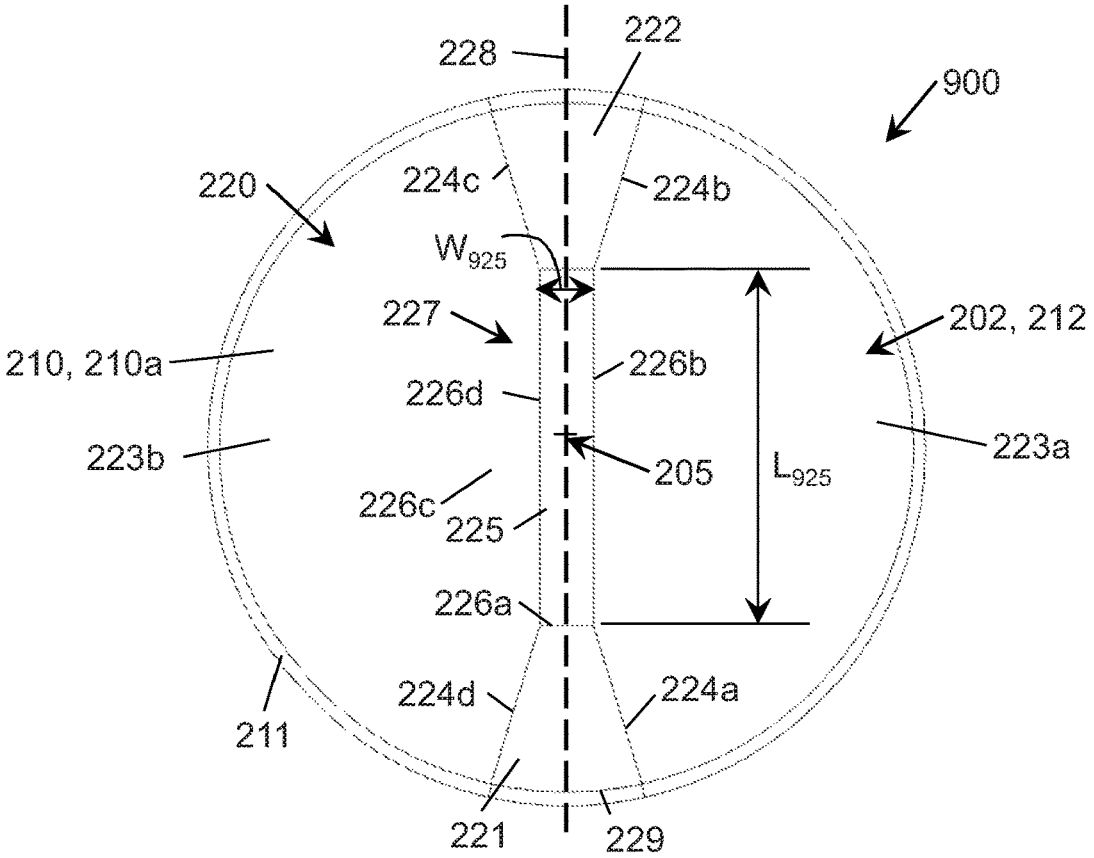
Figure 12C:
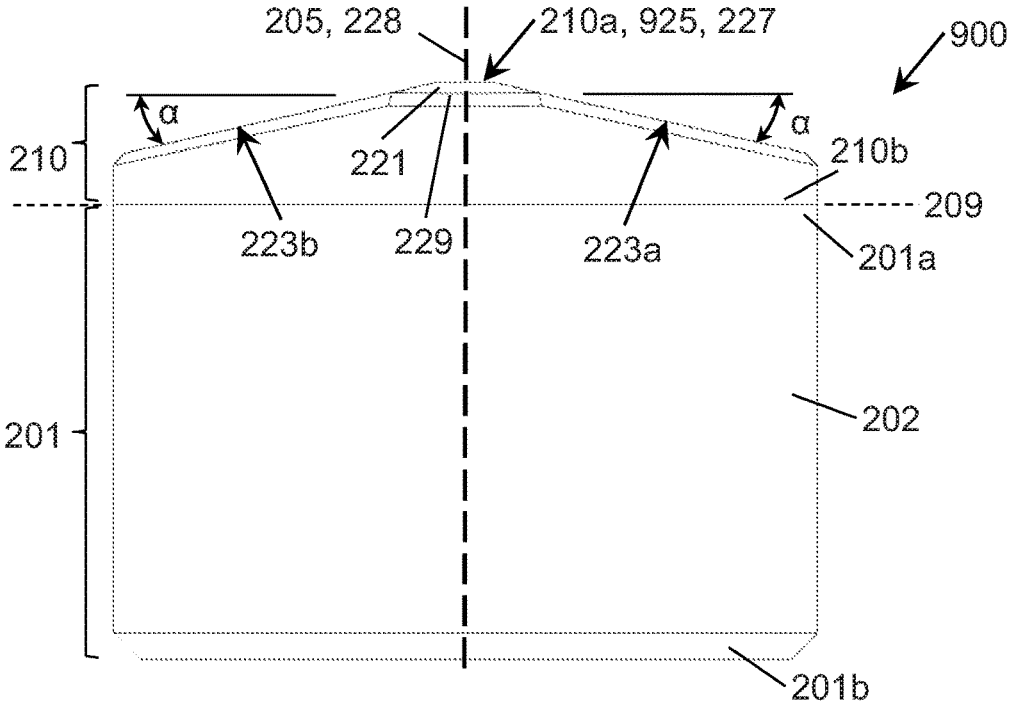
Figure 12D:
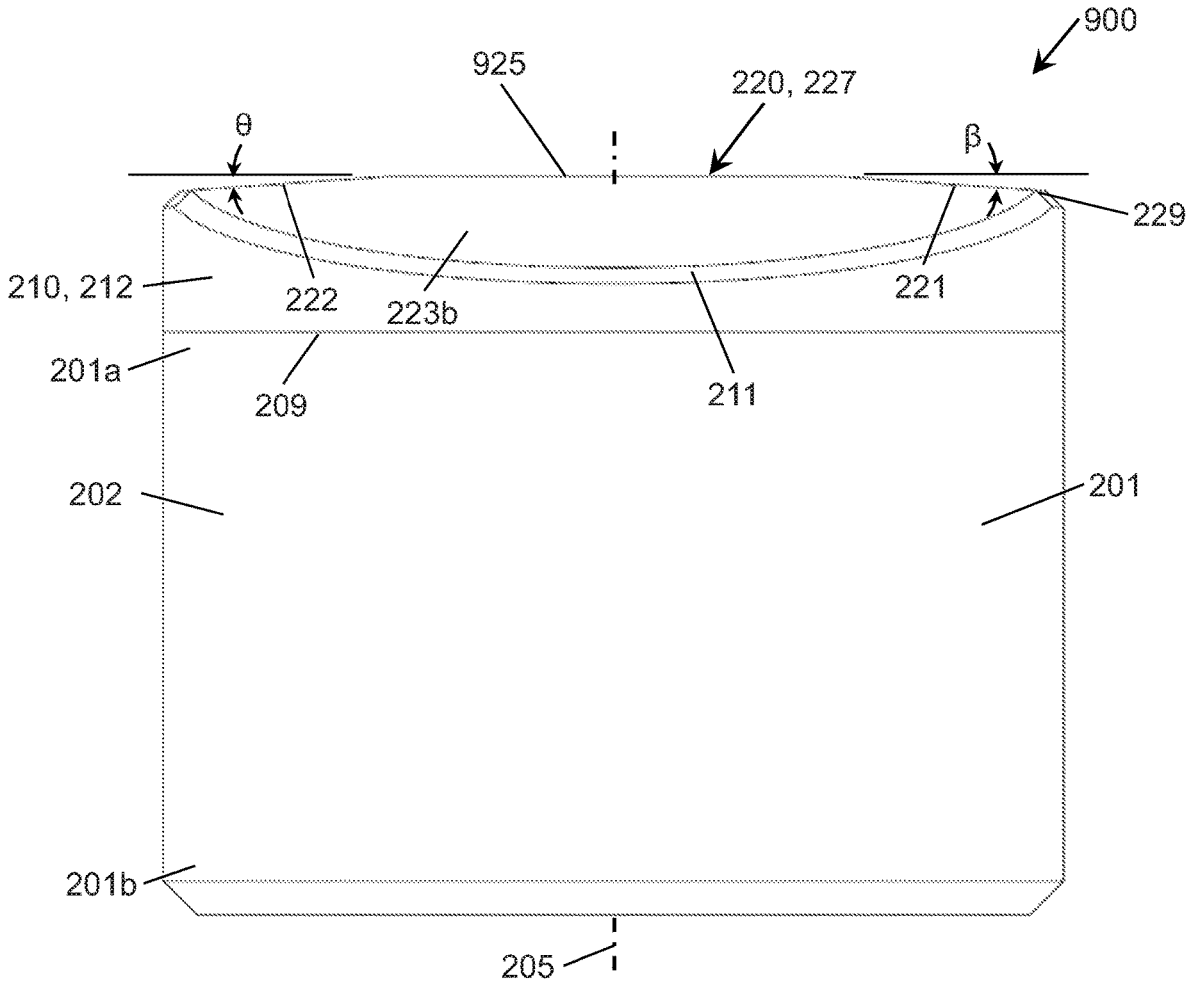

Due to the geometry of regions 223*a*, 223*b*, 825, 221, 222, crown 827 is generally convex in front side view (FIG. 11C) but generally concave in lateral side view (FIG. 11D). In addition, region 825 intersects regions 223*a*, 223*b* along non-linear edges 826*b*, 826*d*, respectively, and regions 221, 222 intersect lateral regions 223*a*, 223*b* along linear edges 224*a*, 224*b*, 224*c*, 224*d*. Since central region 825 and regions 221, 222 are planar, a distinct, linear edge 826*a*, 826*c* is defined at the intersection of central region 825 and each region 221, 222, respectively.

As best shown in FIG. 11B, central region 825 has a length $L_{825}$ measured parallel to plane 828 from edge 826*a* to edge 826*c* in top view, and a width $W_{825}$ measured perpendicular to plane 828 from edge 826*b* to edge 826*d* in top view. In this embodiment, linear edges 826*a*, 826*c* are oriented parallel to each other while non-linear edges 826*b*, 826*d* are not oriented parallel to each other. Thus, the length $L_{825}$ measured between edges 826*a*, 826*c* is constant at all points along edges 826*a*, 826*c*, while the width $W_{825}$ varies depending on where it is measured along edges 826*b*, 826*d*. The geometry of central region 825 may be characterized by the ratio of the length $L_{825}$ to the diameter of cutter element 800 and an "aspect ratio" that is equal to the ratio of the length $L_{825}$ to the width $W_{825}$. The ratio of the length $L_{825}$ to the diameter of cutter element 800 is less than 1.0, preferably between 0.10 and 0.90, more preferably between 0.20 and 0.80, and even more preferably between 0.25 and 0.75, and still even more preferably between 0.33 and 0.66; and the aspect ratio of central region 825 is preferably less than 50.0, more preferably between 0.10 and 30.0, more preferably between 0.50 and 30.0, even more preferably between 1.0 and 10.0, and still even more preferably between 1.00 and 5.0. In some embodiments, the aspect ratio of the central region (e.g., central region 825) is between 0.25 and 10.0. In this embodiment, the aspect ratio of central region 825 is 0.68. As previously described, in embodiments where the width of the central region (e.g., the width $W_{825}$) varies depending on where it is measured, the maximum width of the central region is used to determine the ratio of the length of the central region to the diameter of the corresponding cutter element and the aspect ratio.

As best shown in the top view of cutter element 800 in FIG. 11B (looking at cutting face 820 as viewed parallel to central axis 205), in this embodiment, linear edges 224*a*, 224*d* generally slope toward each other moving radially along cutting region 221 from central region 825 to outer surface 812, and linear edges 224*b*, 224*c* generally slope toward each other moving radially along relief region 222 from central region 825 to outer surface 812. As a result, and unlike cutter element 200 previously described, cutting region 221 has a width measured perpendicular to a reference plane 828 containing central axis 205 in top view that decreases moving radially from central region 825 to outer surface 812, and similarly, relief region 222 has a width measured perpendicular to reference plane 828 in top view that decreases moving radially from central region 825 to outer surface 812. As best shown in the top view of cutter element 800 in FIG. 11B (looking at cutting face 820 as viewed parallel to central axis 205), in this embodiment, cutting face 820 is symmetric about the reference plane 828 that contains central axis 205, is disposed between lateral regions 223*a*, 223*b*, and bisects crown 827 and regions 221, 222. A cutting edge 829 is defined at the intersection of cutting region 221 and chamfer 811.

A plurality of cutting elements 800 are mounted in bit body 110 in the same manner and orientation as cutter elements 200 previously described. More specifically, each cutter element 800 is mounted to a corresponding blade 141, 142 with substrate 201 received and secured in a pocket formed in the cutter support surface 144 of the blade 141, 142 to which it is fixed by brazing or other suitable means. In addition, each cutter element 800 is oriented with axis 205 oriented generally parallel or tangent to cutting direction 106 and such that the corresponding cutting face 820 is exposed and leads the cutter element 800 relative to cutting direction 106 of bit 100. Further, cutter elements 800 are oriented with corresponding planes 828 oriented perpendicular to the cutter support surface 144, cutting region 221 distal the corresponding cutter support surface 144 (with cutting edge 829 defining the extension height of the cutter element 800), and relief region 821 proximal the corresponding cutter support surface 144. During drilling operations, cutting faces 820 of cutter elements 800 engage, penetrate, and shear the formation in the same manner as cutting faces 220 of cutter elements 200 previously described.

Referring now to FIGS. 12A-12D, an embodiment of a cutter element 900 is shown. In general, a plurality of cutter elements 900 can be used in place of cutter elements 200 on bit 100 previously described. Cutter element 900 is substantially the same as cutter element 700 previously described with the exception of the geometry of the central region (e.g., central region 225). Namely, cutter element 900 includes a base or substrate 201 and a cutting disc or layer 210 bonded to the substrate 201. Substrate 201 is as previously described, and cutting layer 210 is as previously described except that central region 225 is replaced with a central region 925 having a different geometry. In particular, central region 925 has a length $L_{925}$ measured parallel to plane 228 from edge 226*a* to edge 226*c* in top view, and a width $W_{925}$ measured perpendicular to plane 228 from edge 226*b* to edge 226*d* in top view. Central region 925 is rectangular with linear edges 226*a*, 226*c* oriented parallel to each other and linear edges 226*b*, 226*d* oriented parallel to each other, and thus, the length $L_{925}$ measured between edges 226*a*, 226*c* is constant at all points along edges 226*a*, 226*c*, and further, the width $W_{925}$ measured between edges 226*b*, 226*d* is constant at all points along edges 226*b*, 226*d*. The ratio of the length $L_{925}$ to the diameter of cutter element 900 is less than 1.0, preferably between 0.10 and 0.90, more preferably between 0.20 and 0.80, and even more preferably between 0.25 and 0.75, and still even more preferably between 0.33 and 0.66; and the aspect ratio of central region 925 is preferably less than 50.0, more preferably between 0.10 and 30.0, more preferably between 0.50 and 30.0, even more preferably between 1.0 and 10.0, and still even more preferably between 1.0 and 5.0. In some embodiments, the aspect ratio of the central region (e.g., central region 925) is between 0.25 and 10.0. In this embodiment, the ratio of the length $L_{925}$ to the diameter of cutter element 900 is 0.5 and the aspect ratio of central region 925 is 8.0.

A plurality of cutting elements 900 are mounted in bit body 110 in the same manner and orientation as cutter elements 200 previously described. More specifically, each cutter element 900 is mounted to a corresponding blade 141, 142 with substrate 201 received and secured in a pocket formed in the cutter support surface 144 of the blade 141, 142 to which it is fixed by brazing or other suitable means. In addition, each cutter element 900 is oriented with axis 205 oriented generally parallel or tangent to cutting direction 106 and such that the corresponding cutting face 220 is exposed and leads the cutter element 900 relative to cutting direction 106 of bit 100. Further, cutter elements 900 are oriented with corresponding planes 228 oriented perpendicular to the cutter support surface 144, cutting region 221 distal the corresponding cutter support surface 144 (with cutting edge 229 defining the extension height of the cutter element 900), and relief region 221 proximal the corresponding cutter support surface 144. During drilling operations, cutting faces 220 of cutter elements 900 engage, penetrate, and shear the formation in the same manner as cutting faces 220 of cutter elements 200 previously described.

Referring now to FIGS. 13A-13D, an embodiment of a cutter element 1000 is shown. In general, a plurality of cutter elements 1000 can be used in place of cutter elements 200 on bit 100 previously described. Cutter element 1000 is substantially the same as cutter element 500 previously described with the exception of the geometry of the central region (e.g., central region 525) and that flats 230*a*, 230*b* have been eliminated. In other words, in this embodiment, no planar flats are provided. Thus, in this embodiment, cutter element 1000 includes a base or substrate 201 and a cutting disc or layer 510 bonded to the substrate 201. Base 201 is as previously described with the sole exception that no flats (e.g., flats 230*a*, 230*b*) are provided. Thus, base 201 has a central axis 205, a first end 201*a* bonded to cutting layer 810, a second end 201*b* distal cutting layer 810, and a radially outer surface 202 extending axially between ends 201*a*, 201*b*. As no flats are provided, outer surface 202 is a cylindrical surface extending about the entire circumference of base 201.

Cutting layer 510 is as previously described except that central region 525 is replaced with a central region 1025 having a different geometry. In particular, central region 1025 is a cylindrical surface disposed at a radius of curvature. As best shown in FIG. 13D, region 1025 is a cylindrical surface disposed at a radius $R_{1025}$ relative to an axis oriented perpendicular to reference plane 528 that contains central axis 205, is disposed between lateral regions 223*a*, 223*b*, and bisects crown 527 and regions 221, 222. Similar to radius $R_{525}$ previously described, radius $R_{1025}$ ranges from 1.0 to 50.0 mm, and more preferably ranges from 5.0 to 20.0 mm. In this embodiment, radius $R_{1025}$ is 45 mm.

Figure 13A:
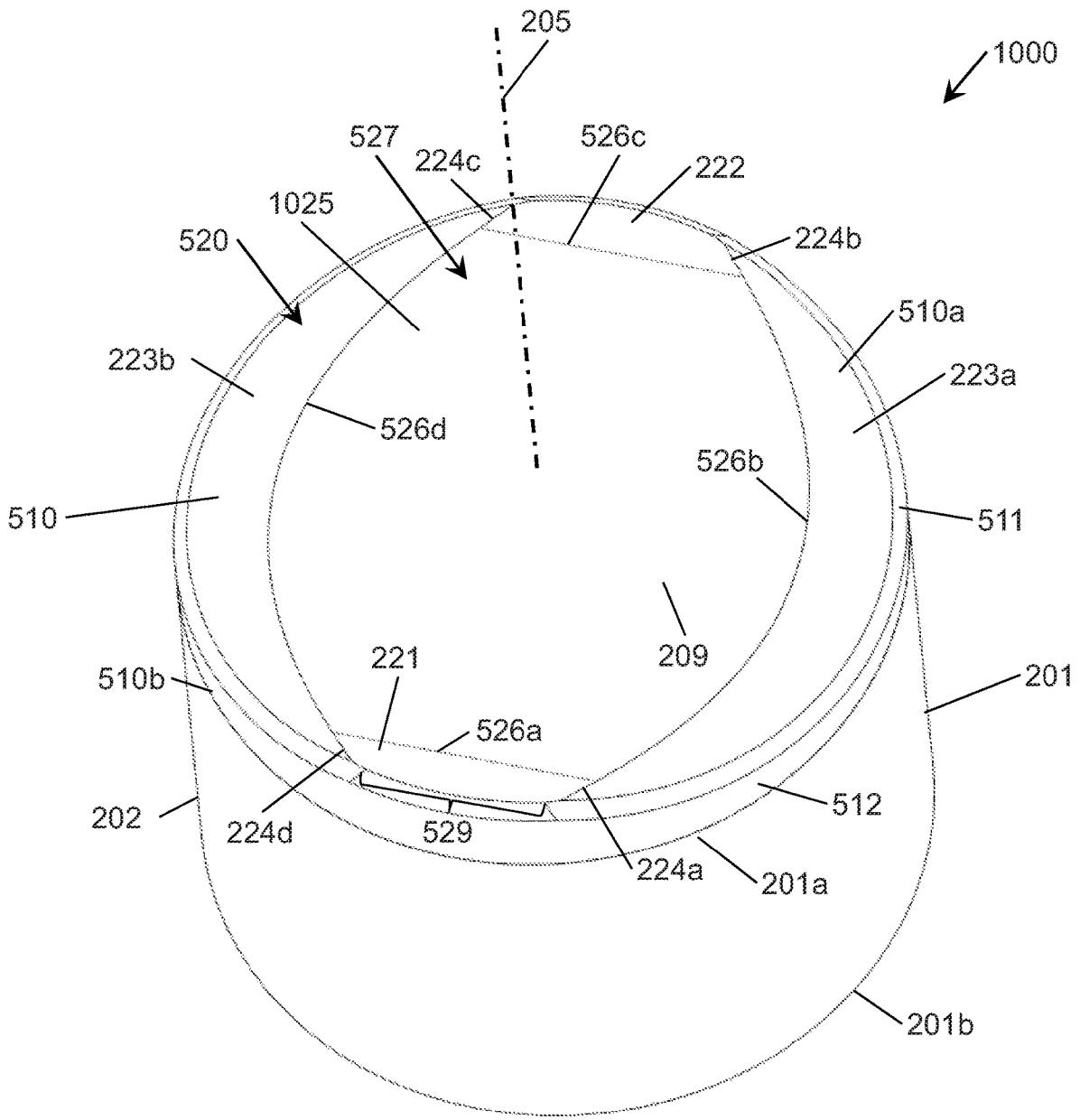
FIGS. 13A-13D are perspective, top, front side, and lateral side views, respectively, of an embodiment of a cutter element in accordance with the principles described herein.
Figure 13B:
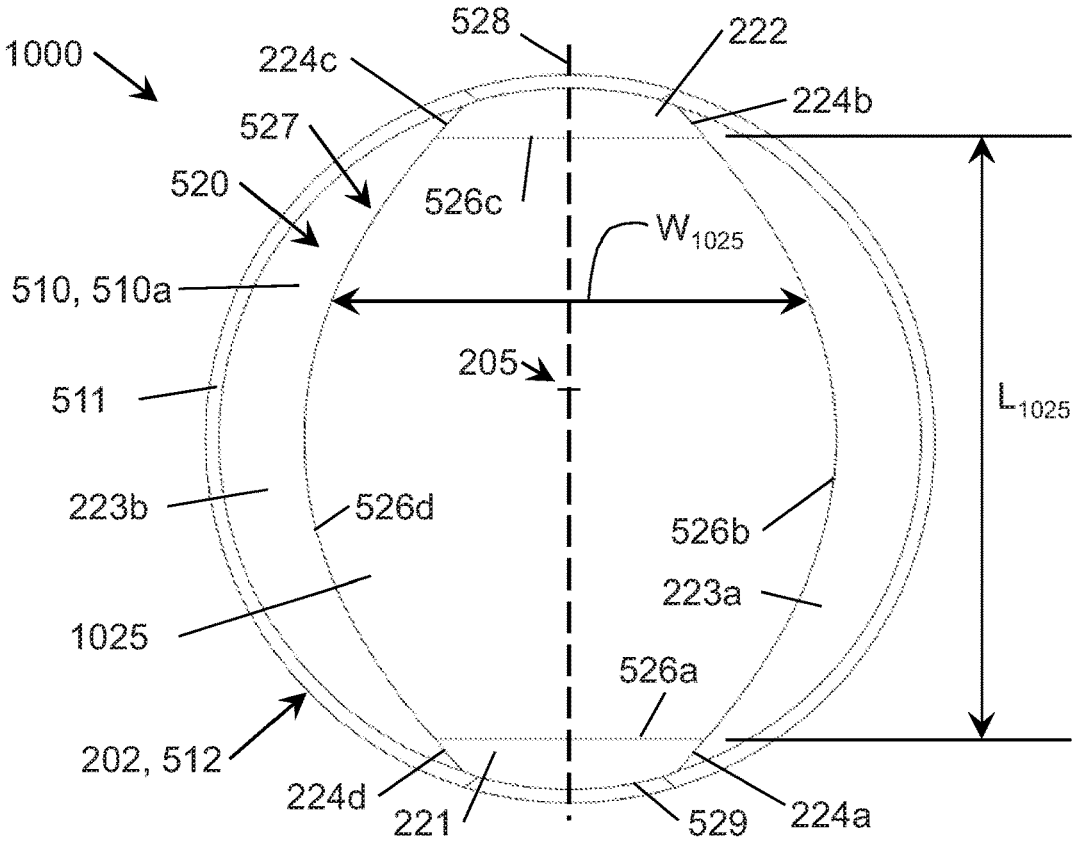
Figure 13C:
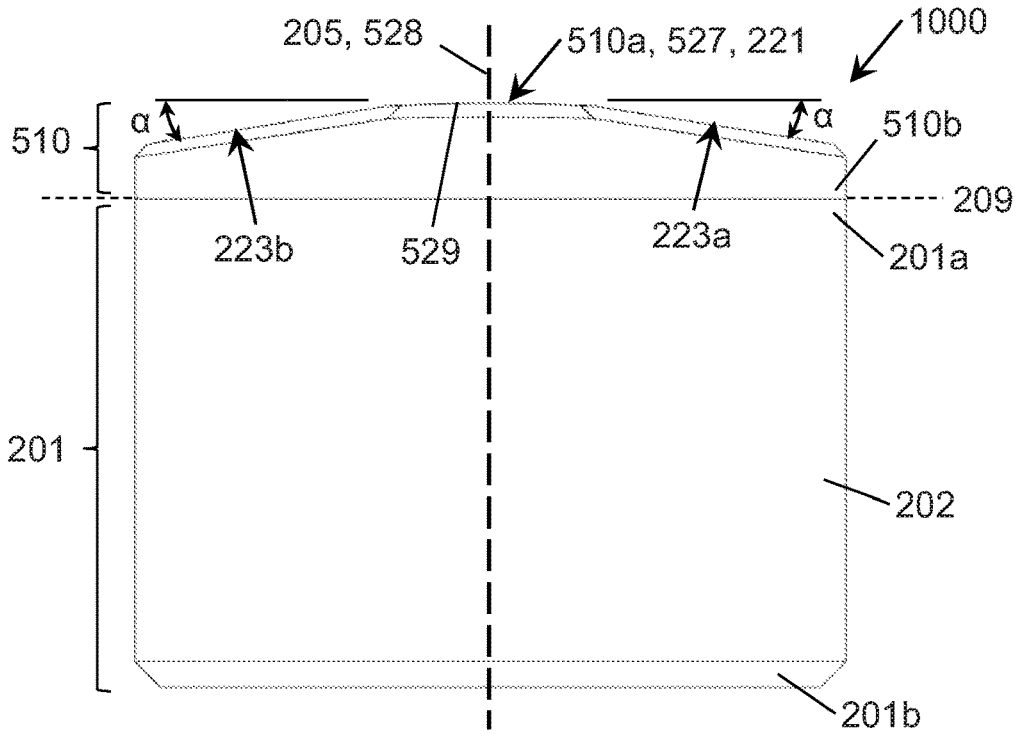
Figure 13D:
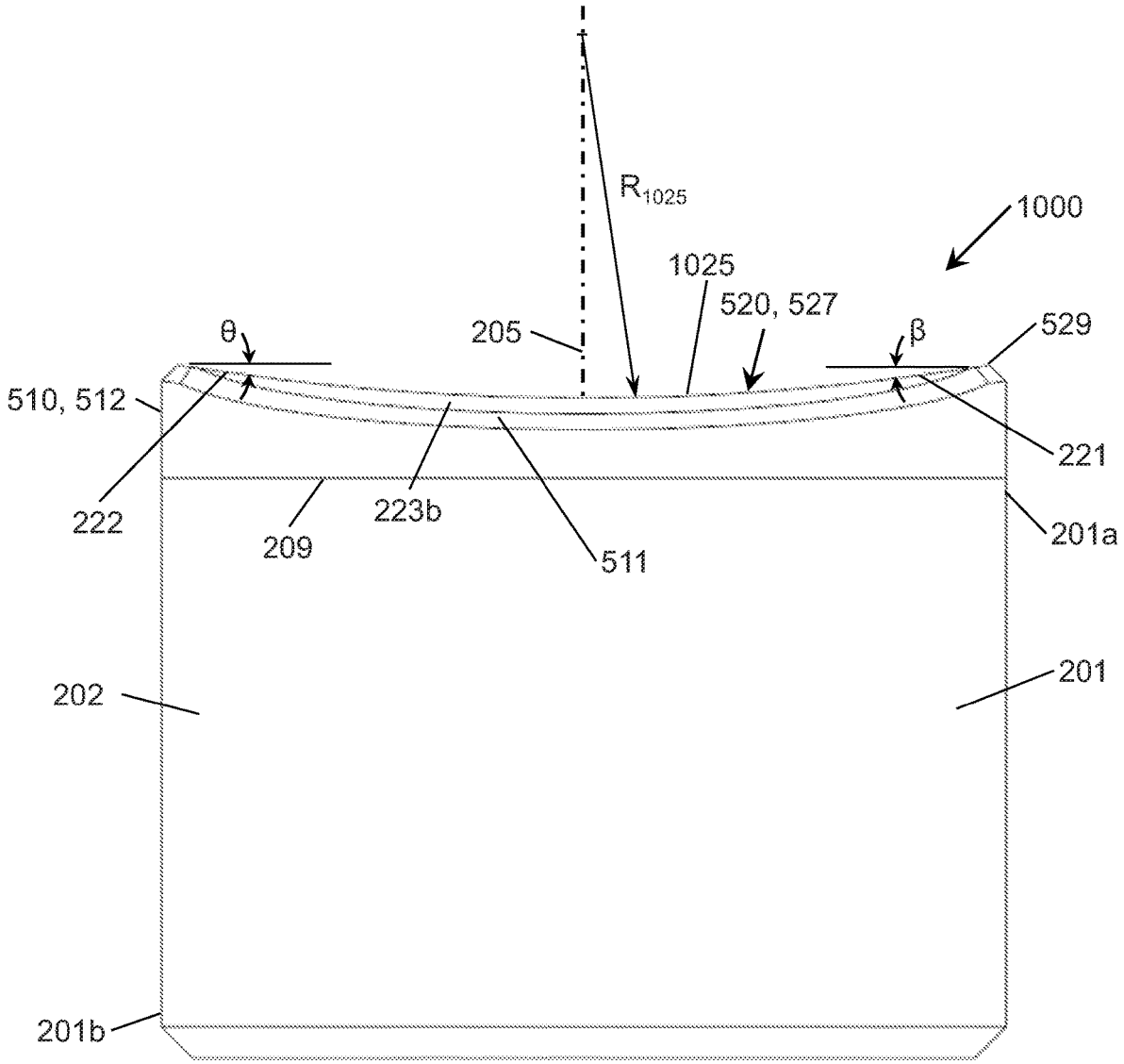

As best shown in FIG. 13B, in this embodiment, central region 1025 has a length $L_{1025}$ measured parallel to plane 528 from edge 526*a* to edge 526*c* in top view, and a width $W_{1025}$ measured perpendicular to plane 228 from edge 526*b* to edge 526*d* in top view. In this embodiment, linear edges 526*a*, 526*c* are oriented parallel to each other while non-linear edges 526*b*, 526*d* are not oriented parallel to each other. Thus, the length $L_{1025}$ measured between edges 526*a*, 526*c* is constant at all points along edges 526*a*, 526*c*, while the width $W_{1025}$ varies depending on where it is measured along edges 526*b*, 526*d*. The geometry of central region 1025 may be characterized by the ratio of the length $L_{1025}$ to the diameter of cutter element 1000 and an "aspect ratio"

that is equal to the ratio of the length $L_{1025}$ to the width $W_{1025}$. The ratio of the length $L_{1025}$ to the diameter of cutter element 1000 is less than 1.0, preferably between 0.10 and 0.90, more preferably between 0.20 and 0.80, and even more preferably between 0.25 and 0.75, and still even more preferably between 0.33 and 0.66; and the aspect ratio of central region 1025 is preferably less than 50.0, more preferably between 0.10 and 30.0, more preferably between 0.50 and 30.0, even more preferably between 1.0 and 10.0, and still even more preferably between 1.0 and 5.0. In some embodiments, the aspect ratio of the central region (e.g., central region 1025) is between 0.25 and 10.0. In this embodiment, the aspect ratio of central region 1025 is 1.13. As previously described, in embodiments where the width of the central region (e.g., the width $W_{1025}$) varies depending on where it is measured, the maximum width of the central region is used to determine the ratio of the length of the central region to the diameter of the corresponding cutter element and the aspect ratio.

A plurality of cutting elements 1000 are mounted in bit body 110 in the same manner and orientation as cutter elements 200 previously described. More specifically, each cutter element 1000 is mounted to a corresponding blade 141, 142 with substrate 201 received and secured in a pocket formed in the cutter support surface 144 of the blade 141, 142 to which it is fixed by brazing or other suitable means. In addition, each cutter element 1000 is oriented with axis 205 oriented generally parallel or tangent to cutting direction 106 and such that the corresponding cutting face 520 is exposed and leads the cutter element 1000 relative to cutting direction 106 of bit 100. Further, cutter elements 1000 are oriented with corresponding planes 528 oriented perpendicular to the cutter support surface 144, cutting region 221 distal the corresponding cutter support surface 144 (with cutting edge 529 defining the extension height of the cutter element 1000), and relief region 221 proximal the corresponding cutter support surface 144. During drilling operations, cutting faces 220 of cutter elements 1000 engage, penetrate, and shear the formation in the same manner as cutting faces 220 of cutter elements 200 previously described.

While preferred embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A cutter element for a drill bit configured to drill a borehole in a subterranean formation, the cutter element comprising:

a base portion having a central axis, a first end, a second end, and a radially outer cylindrical surface extending axially from the first end to the second end;

a cutting layer fixably mounted to the first end of the base portion, wherein the cutting layer includes a cutting face distal the base portion and a radially outer cylindrical surface extending axially from the cutting face to the radially outer cylindrical surface of the base portion, wherein the radically outer cylindrical surface of the cutting layer is contiguous with the radially outer cylindrical surface of the base portion;

wherein the cutting face comprises:

an elongate raised ridge extending across the cutting face, wherein the raised ridge has a first end at the radially outer surface of the cutting layer and a second end at the radially outer cylindrical surface of the cutting layer, and wherein the raised ridge defines a maximum height of the cutter element measured axially from the second end of the base portion to the cutting face;

a first planar lateral side surface extending from the raised ridge to the radially outer cylindrical surface of the cutting layer; and a second planar lateral side surface extending from the raised ridge to the radially outer cylindrical surface of the cutting layer;

wherein the raised ridge of the cutting face comprises a central surface, a cutting surface extending radially from the central surface toward the radially outer cylindrical surface of the cutting layer, and a relief surface extending radially from the central surface toward the radically outer cylindrical surface, wherein the central surface is planar;

wherein the central surface has a length L measured from a first intersection of the central surface and the cutting surface to a second intersection of the central surface and the relief surface in top view;

wherein the central surface has a width W measured from a third intersection of the central surface and the first planar lateral side surface to a fourth intersection of the central surface and the second planar lateral side surface in top view;

wherein the ratio of the length L to a diameter of the base portion is between 0.10 and 0.90; and wherein an aspect ratio of the central surface equal to the ratio of the length L to the width W is between 0.10 and 30.0.

2. The cutter element of claim 1, wherein each planar lateral side surface extends axially toward the base portion moving from the raised ridge toward the radially outer cylindrical surface of the cutting layer.

3. The cutter element of claim 2, wherein each planar lateral side surface is oriented at an angle $\alpha$ relative to a reference plane oriented perpendicular to the central axis, wherein each angle $\alpha$ ranges from 5° to 25°.

4. The cutter element of claim 3, wherein the angle $\alpha$ between the first planar lateral side surface and the reference plane is equal to the angle $\alpha$ between the second planar lateral side surface and the reference plane.

5. The cutter element of claim 1, wherein the central surface is oriented perpendicular to the central axis.

6. The cutter element of claim 5, wherein the central surface is radially centered on the cutting face.

7. The cutting element of claim 5, wherein the central surface is rectangular.

8. The cutting element of claim 1, wherein the cutting surface is planar and the relief surface is planar.

9. The cutting element of claim 8, wherein the cutting surface is oriented at an acute angle $\beta$ relative to a reference plane oriented perpendicular to the central axis, and wherein the relief surface is oriented at an acute angle θ relative to the reference plane oriented perpendicular to the central axis, wherein the angle β ranges from 1° to 20° and the angle θ ranges from 1° to 20°.

10. The cutting element of claim 8, wherein the cutting surface slopes axially toward the base portion moving radially outward from the central surface toward the radially outer cylindrical surface of the cutting layer and the relief surface slopes axially toward the base portion moving radially outward from the central surface toward the radially outer cylindrical surface of the cutting layer.

11. The cutting element of claim 1, wherein the cutting surface is continuously curved and concave or convex between the central surface and the radially outer cylindrical surface of the cutting layer and the relief surface is continuously curved and concave or convex between the central surface and the radially outer cylindrical surface of the cutting layer.

12. The cutter element of claim 1, further comprising:

a first planar flat extending from the cutting face along the radially outer cylindrical surface of the cutting layer into the radially outer cylindrical surface of the base portion;

a second planar flat extending from the cutting face along the radially outer cylindrical surface of the cutting layer into the radially outer cylindrical surface of the base portion, wherein the first planar flat and the second planar flat are circumferentially spaced part.

13. The cutter element of claim 12, wherein the first planar flat extends circumferentially along a portion of the first planar lateral side surface and a portion of the cutting surface;

wherein the second planar flat extends circumferentially along a portion of the second planar lateral side surface and a portion of the cutting surface.

14. The cutter element of claim 12, wherein the first planar flat is oriented perpendicular to a first reference plane containing the central axis and the second planar flat is oriented perpendicular to a second reference plane containing the central axis;

wherein the first reference plane and the second reference plane are angularly spaced apart about the central axis by an angle μ that ranges from 70° to 120°.

15. The cutter element of claim 14, wherein each planar flat slopes radially outward moving axially from the cutting face into the base portion.

16. The cutter element of claim 15, wherein the first planar flat is oriented at an angle $\sigma_1$ relative to the central axis as measured in the first reference plane and the second planar flat is oriented at an angle $\sigma_2$ relative to the central axis as measured in the second reference plane, wherein the angle $\sigma_1$ ranges from 2° to 10° and the angle $\sigma_2$ ranges from 2° to 10°.

17. The cutter element of claim 16, wherein the cutting face is symmetric about a reference plane containing the central axis and bisecting the raised ridge.

18. A cutter element for a drill bit configured to drill a borehole in a subterranean formation, the cutter element comprising:

a base portion having a central axis, a first end, a second end, and a radially outer cylindrical surface extending axially from the first end to the second end;

a cutting layer fixably mounted to the first end of the base portion, wherein the cutting layer includes a cutting face distal the base portion and a radially outer cylindrical surface extending axially from the cutting face to the radially outer cylindrical surface of the base portion, wherein the radically outer cylindrical surface of the cutting layer is contiguous with the radially outer cylindrical surface of the base portion;

wherein the cutting face comprises:

an elongate raised ridge extending across the cutting face, wherein the raised ridge has a first end at the radially outer surface of the cutting layer and a second end at the radially outer cylindrical surface of the cutting layer, and wherein the raised ridge defines a maximum height of the cutter element measured axially from the second end of the base portion to the cutting face;

a first planar lateral side surface extending from the raised ridge to the radially outer cylindrical surface of the cutting layer; and a second planar lateral side surface extending from the raised ridge to the radially outer cylindrical surface of the cutting layer wherein the raised ridge of the cutting face comprises a central surface, a cutting surface extending radially from the central surface toward the radially outer cylindrical surface of the cutting layer, and a relief surface extending radially from the central surface toward the radially outer cylindrical surface, wherein the cutting surface is planar and the relief surface is planar;

wherein the central surface is continuously curved and convex or concave between the cutting surface and the relief surface;

wherein the central surface has a length L measured from a first intersection of the central surface and the cutting surface to a second intersection of the central surface and the relief surface in top view;

wherein the central surface has a width W measured from a third intersection of the central surface and the first planar lateral side surface to a fourth intersection of the central surface and the second planar lateral side surface in top view;

wherein the ratio of the length L to a diameter of the base portion is between 0.10 and 0.90; and wherein an aspect ratio of the central surface equal to the ratio of the length L to the width W is between 0.10 and 30.0.

19. The cutter element of claim 18, wherein each planar lateral side surface extends axially toward the base portion moving from the raised ridge toward the radially outer cylindrical surface of the cutting layer.

20. The cutter element of claim 19, wherein each planar lateral side surface is oriented at an angle α relative to a reference plane oriented perpendicular to the central axis, wherein each angle α ranges from 5° to 25°.

21. The cutter element of claim 20, wherein the angle α between the first planar lateral side surface and the reference plane is equal to the angle α between the second planar lateral side surface and the reference plane.

22. The cutter element of claim 18, wherein the central surface is radially centered on the cutting face.

23. The cutting element of claim 18, wherein the central surface is rectangular.

24. The cutting element of claim 18, wherein the cutting surface is oriented at an acute angle β relative to a reference plane oriented perpendicular to the central axis, and wherein the relief surface is oriented at an acute angle θ relative to the reference plane oriented perpendicular to the central axis, wherein the angle β ranges from 1° to 20° and the angle θ ranges from 1° to 20°.

25. The cutting element of claim 18, wherein the cutting surface slopes axially toward the base portion moving radially outward from the central surface toward the radially outer cylindrical surface of the cutting layer and the relief surface slopes axially toward the base portion moving radially outward from the central surface toward the radially outer cylindrical surface of the cutting layer.

26. The cutter element of claim 18, further comprising:

a first planar flat extending from the cutting face along the radially outer cylindrical surface of the cutting layer into the radially outer cylindrical surface of the base portion;

a second planar flat extending from the cutting face along the radially outer cylindrical surface of the cutting layer into the radially outer cylindrical surface of the base portion, wherein the first planar flat and the second planar flat are circumferentially spaced part.

27. The cutter element of claim 26, wherein the first planar flat extends circumferentially along a portion of the first planar lateral side surface and a portion of the cutting surface;

wherein the second planar flat extends circumferentially along a portion of the second planar lateral side surface and a portion of the cutting surface.

28. The cutter element of claim 26, wherein the first planar flat is oriented perpendicular to a first reference plane containing the central axis and the second planar flat is oriented perpendicular to a second reference plane containing the central axis;

wherein the first reference plane and the second reference plane are angularly spaced apart about the central axis by an angle $\mu$ that ranges from 70° to 120°.

29. The cutter element of claim 28, wherein each planar flat slopes radially outward moving axially from the cutting face into the base portion.

30. The cutter element of claim 29, wherein the first planar flat is oriented at an angle $\sigma_1$ relative to the central axis as measured in the first reference plane and the second planar flat is oriented at an angle $\sigma_2$ relative to the central axis as measured in the second reference plane, wherein the angle $\sigma_1$ ranges from 2° to 10° and the angle $\sigma_2$ ranges from 2° to 10°.

31. The cutter element of claim 30, wherein the cutting face is symmetric about a reference plane containing the central axis and bisecting the raised ridge.

32. A cutter element for a drill bit configured to drill a borehole in a subterranean formation, the cutter element comprising:

a base portion having a central axis, a first end, a second end, and a radially outer cylindrical surface extending axially from the first end to the second end;

a cutting layer fixably mounted to the first end of the base portion, wherein the cutting layer includes a cutting face distal the base portion and a radially outer cylindrical surface extending axially from the cutting face to the radially outer cylindrical surface of the base portion, wherein the radically outer cylindrical surface of the cutting layer is contiguous with the radially outer cylindrical surface of the base portion;

wherein the cutting face comprises:

a planar central region;

a planar cutting region extending radially from the planar central region to the radially outer surface of the cutting layer;

a planar relief region extending radially from the planar central region to the radially outer surface of the cutting layer;

a first planar lateral side region extending laterally from the planar central region, the planar cutting region, and the planar relief region to the radially outer surface of the cutting layer; and a second planar lateral side region extending laterally from the planar central region, the planar cutting region, and the planar relief region to the radially outer surface of the cutting layer;

wherein the first planar lateral side region slopes axially downward moving laterally from the planar central region, the planar cutting region, and the planar relief region toward the radially outer surface of the cutting layer;

wherein the second planar lateral side region slopes axially downward moving laterally from the planar central region, the planar cutting region, and the planar relief region to the radially outer surface of the cutting layer;

wherein the planar cutting region is circumferentially positioned between the first planar lateral side region and the second planar lateral side region;

wherein the planar relief region is circumferentially positioned between the first planar lateral side region and the second planar lateral side region;

wherein the planar central region is disposed between the first planar lateral side region and the second planar lateral side region;

wherein the planar central region has a length L measured from a first intersection of the planar central region and the planar cutting region to a second intersection of the planar central region and the planar relief region in top view;

wherein the planar central region has a width W measured from a third intersection of the planar central region and the first planar lateral side surface to a fourth intersection of the planar central region and the second planar lateral side surface in top view;

wherein the ratio of the length L to a diameter of the base portion is between 0.10 and 0.90; and wherein an aspect ratio of the planar central region equal to the ratio of the length L to the width W is between 0.10 and 30.0.

33. The cutter element of claim 32, wherein the planar central region is oriented perpendicular to the central axis.

34. The cutter element of claim 33, wherein each planar lateral side region is oriented at an angle $\alpha$ relative to a reference plane oriented perpendicular to the central axis, wherein each angle $\alpha$ ranges from 5° to 25°.

35. The cutter element of claim 34, wherein the angle $\alpha$ between the first planar lateral side region and the reference plane is equal to the angle $\alpha$ between the second planar lateral side region and the reference plane.

36. The cutting element of claim 34, wherein the planar cutting region is oriented at an acute angle $\beta$ relative to the reference plane and the planar relief region is oriented at an acute angle $\theta$ relative to the reference plane, wherein the angle $\beta$ ranges from 1° to 20° and the angle $\theta$ ranges from 1° to 20°.

37. The cutter element of claim 32, wherein the planar central region is radially centered on the cutting face.

38. The cutting element of claim 37, wherein the planar central region is rectangular.

39. The cutting element of claim 32, wherein the planar cutting region slopes axially toward the base portion moving radially outward from the central region to the radially outer surface of the cutting layer and the planar relief region slopes axially toward the base portion moving radially outward from the planar central region to the radially outer surface of the cutting layer.

40. The cutter element of claim 32, wherein the radially outer surface of the base portion is cylindrical and the radially outer surface of the cutting layer is cylindrical.

41. The cutter element of claim 40, further comprising:

a first planar flat extending from the cutting face along the radially outer surface of the cutting layer into the radially outer surface of the base portion;

a second planar flat extending from the cutting face along the radially outer surface of the cutting layer into the radially outer surface of the base portion, wherein the first planar flat and the second planar flat are circumferentially spaced part.

42. The cutter element of claim 41, wherein the first planar flat extends circumferentially along a portion of the first planar lateral side surface and a portion of the planar cutting surface;

wherein the second planar flat extends circumferentially along a portion of the second planar lateral side surface and a portion of the planar cutting surface.

43. The cutter element of claim 41, wherein the first planar flat is oriented perpendicular to a first reference plane containing the central axis and the second planar flat is oriented perpendicular to a second reference plane containing the central axis;

wherein the first reference plane and the second reference plane are angularly spaced apart about the central axis by an angle $\mu$ that ranges from 70° to 120°.

44. The cutter element of claim 43, wherein each planar flat slopes radially outward moving axially from the cutting face into the base portion.

45. The cutter element of claim 44, wherein the first planar flat is oriented at an angle $\sigma_1$ relative to the central axis as measured in the first reference plane and the second planar flat is oriented at an angle $\sigma_2$ relative to the central axis as measured in the second reference plane, wherein the angle $\sigma_1$ ranges from 2° to 10° and the angle $\sigma_2$ ranges from 2° to 10°.

46. The cutter element of claim 32, wherein the cutting face is symmetric about a reference plane containing the central axis and bisecting the planar central region, the planar cutting region, and the planar relief region.

* * * * *